US006024017A

United States Patent [19]

Okuda

[11] Patent Number: 6,024,017

[45] Date of Patent: Feb. 15, 2000

[54] PRINTING APPARATUS

[75] Inventor: Kuniharu Okuda, Kyoto, Japan

[73] Assignee: Dainippon Screen Mfg. Co., Ltd., Kyoto, Japan

[21] Appl. No.: 09/154,590

[22] Filed: Sep. 17, 1998

[30] Foreign Application Priority Data

Sep. 26, 1997 [JP] Japan ..... 9-279442
Sep. 26, 1997 [JP] Japan ..... 9-279446

[51] Int. Cl.[7] ..... B41F 31/00

[52] U.S. Cl. ..... 101/351.2; 101/148

[58] Field of Search ..... 101/218, 247, 101/350.1, 351.1, 351.2, 351.3, 352.01, 352.02, 352.03, 352.04, 147, 148, 177, 182, 184, 185

[56] References Cited

U.S. PATENT DOCUMENTS

| | | | |
|---|---|---|---|
| 2,911,907 | 11/1959 | Davidson . | |
| 4,458,591 | 7/1984 | Guaraldi | 101/247 |
| 5,101,723 | 4/1992 | Holl et al. | 101/148 |
| 5,469,787 | 11/1995 | Turner et al. . | |
| 5,623,873 | 4/1997 | Ikeda | 101/137 |

FOREIGN PATENT DOCUMENTS

| | | |
|---|---|---|
| 0 512 549 | 11/1992 | European Pat. Off. . |
| 3-143634 | 6/1991 | Japan . |

*Primary Examiner*—Ren Yan

*Attorney, Agent, or Firm*—Nikaido, Marmelstein, Murray & Oram LLP

[57] ABSTRACT

A printing apparatus having ink feeders for selectively feeding inks to a plurality of image areas on a plate or plates mounted on a plate cylinder. A plate cylinder supports, peripherally thereof, a single plate having a first and a second image areas. A plurality of cams are rotatable synchronously with the plate cylinder, and are arranged in positions laterally of the plate cylinder corresponding to the image areas. A plurality of ink rollers are arranged circumferentially of the plate cylinder for contacting a surface of the plate to feed ink to the image areas. A plurality of ink roller support arms rotatably support the ink rollers. An ink roller support arm swing mechanism includes cam followers for contacting the cams to swing the ink roller support arms successively, with rotation of the cams, between an ink feeding position in which the ink rollers contact the surface of the plate and a retracted position in which the ink rollers are separated from the surface of the plate. A water applying roller contacts the surface of the plate to feed dampening water to the image areas and is supported by water applying roller support arms on a water applying roller support arm swing mechanism having cam followers for contacting the cams to swing the water applying roller support arms, with rotation of the cams, between an dampening water feeding position in which the water applying roller contacts the surface of the plate and a retracted position in which the water applying roller is separated from the surface of the plate.

18 Claims, 42 Drawing Sheets

PRINTING APPARATUS

BACKGROUND OF THE INVENTION

1. Field of the Invention

The present invention relates to a printing apparatus for printing images by selectively feeding inks and water to a plurality of image areas on a plate mounted on a plate cylinder.

2. Description of the Related Art

A printing apparatus is known which includes a plate cylinder for supporting a plurality of plates mounted peripherally thereof, and a plurality of ink feeders for feeding different color inks to image areas on the plurality of plates mounted on the plate cylinder, respectively. This printing apparatus prints images with a plurality of color inks by using the single plate cylinder and a single impression cylinder.

Japanese Patent Publication (Unexamined) H3-143634 (1991), for example, describes a printing apparatus for printing images on printing paper with two color inks. This apparatus includes a plate cylinder for supporting two plates mounted peripherally thereof, two ink feeders for feeding the different inks to the respective plates on the plate cylinder, a single dampening water feeder for feeding dampening water to the respective plates on the plate cylinder, and an impression cylinder having half a diameter of the plate cylinder. A sheet of printing paper is fed for every two rotations of the impression cylinder.

Each ink feeder in the printing apparatus described in the above publication has an ink applying roller for applying ink to one of the plates. The ink applying roller is vertically movable by a cam mechanism synchronously with rotation of the plate cylinder, whereby the ink applying roller is placed in contact with only the corresponding plate.

In each ink feeder used in the above printing apparatus, when the single ink applying roller is placed in contact with the surface of the plate to feed ink thereto, the ink tends to be fed to the plate in an insufficient quantity and tends to be applied unevenly over the plate. To avoid such inconveniences, it is desirable to arrange a plurality of ink applying rollers circumferentially of the plate cylinder.

When vertically moved en bloc, these ink applying rollers will contact different positions of the plate. Consequently, the ink may be fed in different quantities to different positions of the image areas on the plate. Further, an operation for feeding the ink from the ink applying rollers to the plate is carried out in parallel with a printing operation. When the ink applying rollers are vertically moved en bloc, vibrations caused by the vertical movement will be transmitted to the plate cylinder, thereby impairing printing precision.

In the multicolor printing apparatus described in Patent Publication (Unexamined) H3-143634 (1991), the single dampening water feeder feeds dampening water to the plates to be printed with different color inks. With such a construction, however, the inks adhere in emulsified state to a roller such as a water applying roller of the dampening water feeder. Then, inks of other colors than the intended color inks are applied to the image areas on the plates. This gives rise to a problem of smudging prints.

In the multicolor printing apparatus noted above, two plates are mounted peripherally of the single plate cylinder. The plate cylinder is complicated in construction since grippers must be arranged peripherally thereof for holding the forward end and rear end of each of the two plates.

Moreover, a plate mounting operation is time-consuming in attaching two plates to the outer periphery of the plate cylinder.

These drawbacks may be overcome by attaching a single plate to the periphery of the plate cylinder, and forming a first and a second image areas on the plate to be printed with different color inks. In this case, when feeding the different color inks from the ink feeders to the first and second image areas, it is necessary to prevent the inks from adhering to an area between the first and second image areas on the plate.

SUMMARY OF THE INVENTION

An object of the present invention, therefore, is to provide a printing apparatus for feeding inks uniformly over entire image areas on a plate without impairing printing precision.

The above object is fulfilled, according to the present invention, by a printing apparatus having ink feeders for selectively feeding inks to a plurality of image areas on a plate or plates mounted on a plate cylinder, comprising:

- a plate cylinder for supporting, peripherally thereof, a plate having a plurality of image areas;
- a plurality of cams rotatable synchronously with the plate cylinder, the cams being arranged in positions laterally of the plate cylinder corresponding to the image areas;
- a plurality of ink rollers arranged circumferentially of the plate cylinder for contacting a surface of the plate to feed ink to the image areas;
- a plurality of ink roller support arms for rotatably supporting the ink rollers, respectively; and
- an ink roller support arm moving mechanism including cam followers for contacting the cams to move the ink roller support arms successively, with rotation of the cams, between an ink feeding position in which the ink rollers contact the surface of the plate and a retracted position in which the ink rollers are separated from the surface of the plate.

With this printing apparatus, the plurality of ink rollers may be swung successively between the ink feeding position for contacting the surface of the plate and the retracted position separated from the surface of the plate. Thus, ink may be fed uniformly over the entire image areas of the plate. It is also possible to avoid a deterioration in printing precision due to vibrations resulting from movement of the ink rollers.

In another aspect of the invention, there is provided a printing apparatus having ink feeders for selectively feeding inks to two image areas on a plate or plates mounted on a plate cylinder, which apparatus comprises:

- a plate cylinder for supporting, peripherally thereof, a plate having two image areas;
- two ink feeders arranged around the plate cylinder, each of the ink feeders having a plurality of ink rollers arranged circumferentially of the plate cylinder for feeding different color inks to the image areas;
- a plurality of ink roller support arms for rotatably supporting the ink rollers, respectively;
- an ink roller support arm moving mechanism for moving the ink roller support arms successively between an ink feeding position in which the ink rollers contact the surface of the plate and a retracted position in which the ink rollers are separated from the surface of the plate; and
- a stopper mechanism for stopping the ink roller support arms in the ink feeding position;
- a retracting mechanism for stopping the ink roller support arms in the retracted position to prevent the ink rollers from contacting the plate;

wherein the stop mechanism and the retracting mechanism are controllable to select between a mode for causing the two ink feeders to feed the inks to the two image areas, respectively, and a mode for causing one of the two ink feeders to fed one of the inks to both of the two image areas, with the other ink feeder rendered inoperative to feed the other ink the image areas.

Another object of the present invention is to provide a printing apparatus effective to avoid smudging of prints.

This object is fulfilled by a multicolor printing apparatus having ink feeders for feeding different color inks respectively to a plurality of image areas on a plate or plates mounted on a plate cylinder, comprising:

a plate cylinder for supporting, peripherally thereof, a plate having a first and a second image areas to be printed with the different color inks;

a first dampening water feeder having a water applying roller reciprocable between a feeding position for contacting a surface of the plate to feed dampening water to the first image area, and a retracted position separated from the surface of the plate;

a second dampening water feeder having a water applying roller reciprocable between a feeding position for contacting the surface of the plate to feed dampening water to the second image area, and a retracted position separated from the surface of the plate; and a water applying roller moving mechanism for reciprocating the water applying rollers of the first and second dampening water feeders between the feeding positions and the retracted positions, such that a rear end of an area of the surface of the plate where the dampening water is fed by the first dampening water feeder overlaps a forward end of an area of the surface of the plate where the dampening water is fed by the second dampening water feeder.

With this printing apparatus, the rear end of an area where the dampening water is fed by the first dampening water feeder overlaps the forward end of an area where the dampening water is fed by the second dampening water feeder. This feature effectively avoids smudging due to the ink adhering to the area between the first and second image areas of the plate.

Other features and advantages of the present invention will be apparent from the following detailed description of the embodiments of the invention.

BRIEF DESCRIPTION OF THE DRAWINGS

For the purpose of illustrating the invention, there are shown in the drawings several forms which are presently preferred, it being understood, however, that the invention is not limited to the precise arrangement and instrumentalities shown.

DESCRIPTION OF THE PREFERRED EMBODIMENTS

Figure 1:
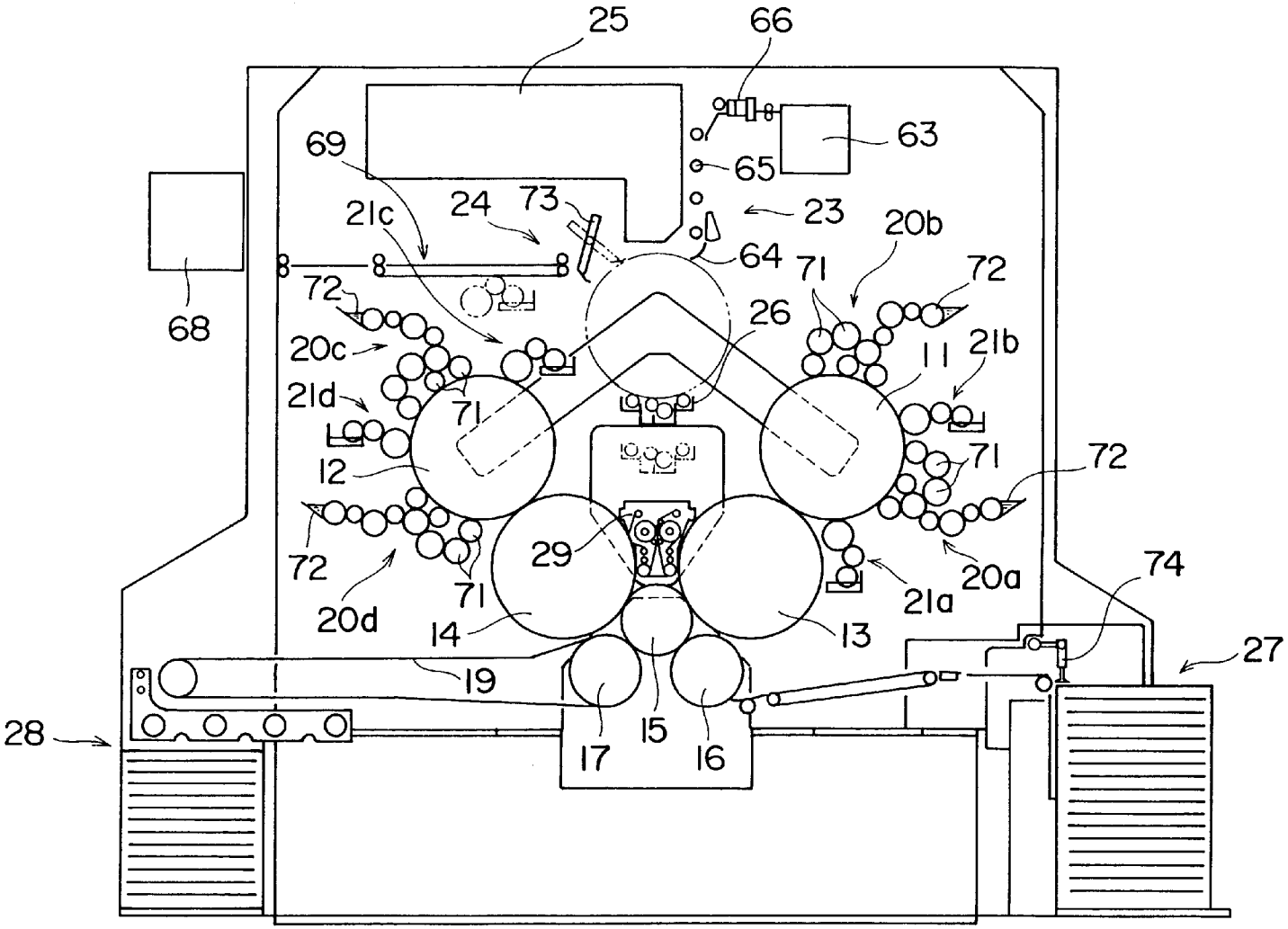
FIG. 1 is a schematic side view of a printing apparatus according to the present invention.

Embodiments of the present invention will be described hereinafter with reference to the drawings. FIG. 1 is a schematic side view of a printing apparatus according to the present invention.

This printing apparatus records images on blank plates mounted on first and second plate cylinders 11 and 12, feeds inks to the plates having the images recorded thereon, and transfers the inks from the plates through first and second blanket cylinders 13 and 14 to printing paper held on an impression cylinder 15, thereby printing the images on the printing paper.

The first plate cylinder 11 is movable between a first printing position shown in a solid line and an image recording position shown in a two-dot chain line in FIG. 1. The second plate cylinder 12 is movable between a second printing position shown in a solid line in FIG. 1 and the same image recording position.

Around the first plate cylinder 11 in the first printing position are, as described in detail hereinafter, an ink feeder 20*a* for feeding an ink of black (K), for example, to the plate, an ink feeder 20*b* for feeding an ink of magenta (M), for example, to the plate, and dampening water feeders 21*a* and 21*b* for feeding dampening water to the plate. Around the second plate cylinder 12 in the second printing position are an ink feeder 20*c* for feeding an ink of cyan (C), for example, to the plate, an ink feeder 20*d* for feeding an ink of yellow (Y), for example, to the plate, and dampening water feeders 21*c* and 21*d* for feeding dampening water to the plate. Further, around the first or second plate cylinder 11 or 12 in the image recording position are a plate feeder 23, a plate remover 24, an image recorder 25 and a developing device 26.

The first blanket cylinder 13 is contactable with the first plate cylinder 11, while the second blanket cylinder 14 is contactable with the second plate cylinder 12. The impression cylinder 15 is contactable with the first and second blanket cylinders 13 and 14 in different positions. The apparatus further includes a paper feed cylinder 16 for transferring printing paper supplied from a paper storage 27 to the impression cylinder 15, a paper discharge cylinder 17 with chains 19 wound thereon for discharging printed paper from the impression cylinder 15 to a paper discharge station 28, and a blanket cleaning unit 29.

The first and second plate cylinders 11 and 12 are coupled respectively to first and second plate cylinder moving mechanisms 31 and 32 described hereinafter. Each of the plate cylinders 11 and 12 is driven by the moving mechanism 31 or 32 to reciprocate between the first or second printing position and the image recording position.

As described hereinafter, each of the first and second plate cylinders 11 and 12 has a gear 51 disposed laterally thereof and coaxially therewith. Each of the first and second blanket cylinders 13 and 14 has a gear 52 disposed laterally thereof and coaxially therewith. The gear 51 of the first plate cylinder 11 is meshed with the gear 52 of the first blanket cylinder 13 when the first plate cylinder 11 is in the first printing position. Similarly, the gear 51 of the second plate cylinder 12 is meshed with the gear 52 of the second blanket cylinder 14 when the second plate cylinder 14 is in the second printing position.

Thus, in the first printing position, the first plate cylinder 11 is rotatable synchronously with the first blanket cylinder 13. In the second printing position, the second plate cylinder 12 is rotatable synchronously with the second blanket cylinder 14.

Adjacent the image recording position is a traction type plate cylinder rotating mechanism 30, described hereinafter, for rotating the first or second plate cylinder 11 or 12 whichever is in the image recording position.

Figure 2:
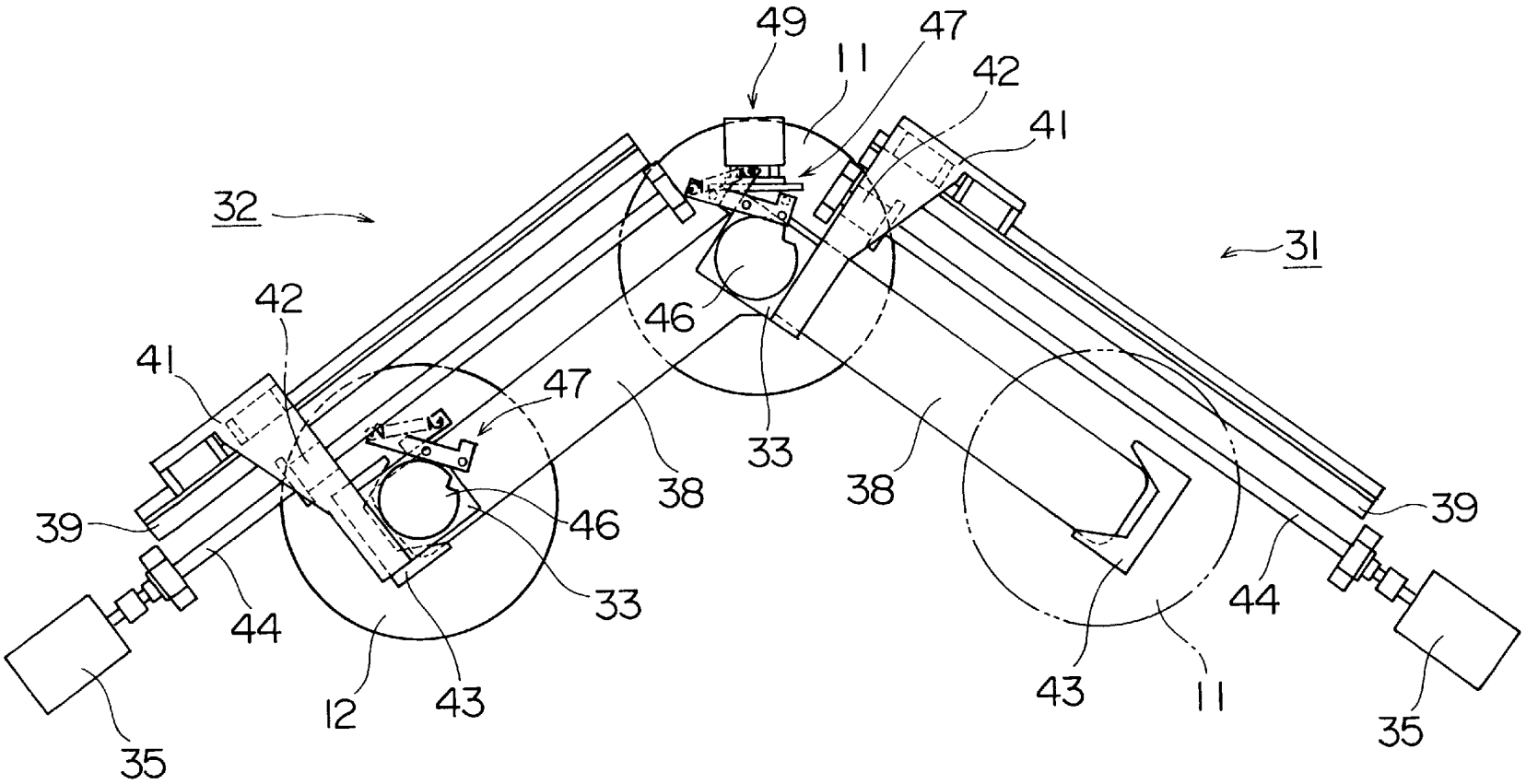
FIG. 2 is a front view of a first and a second plate cylinder moving mechanisms.
Figure 3:
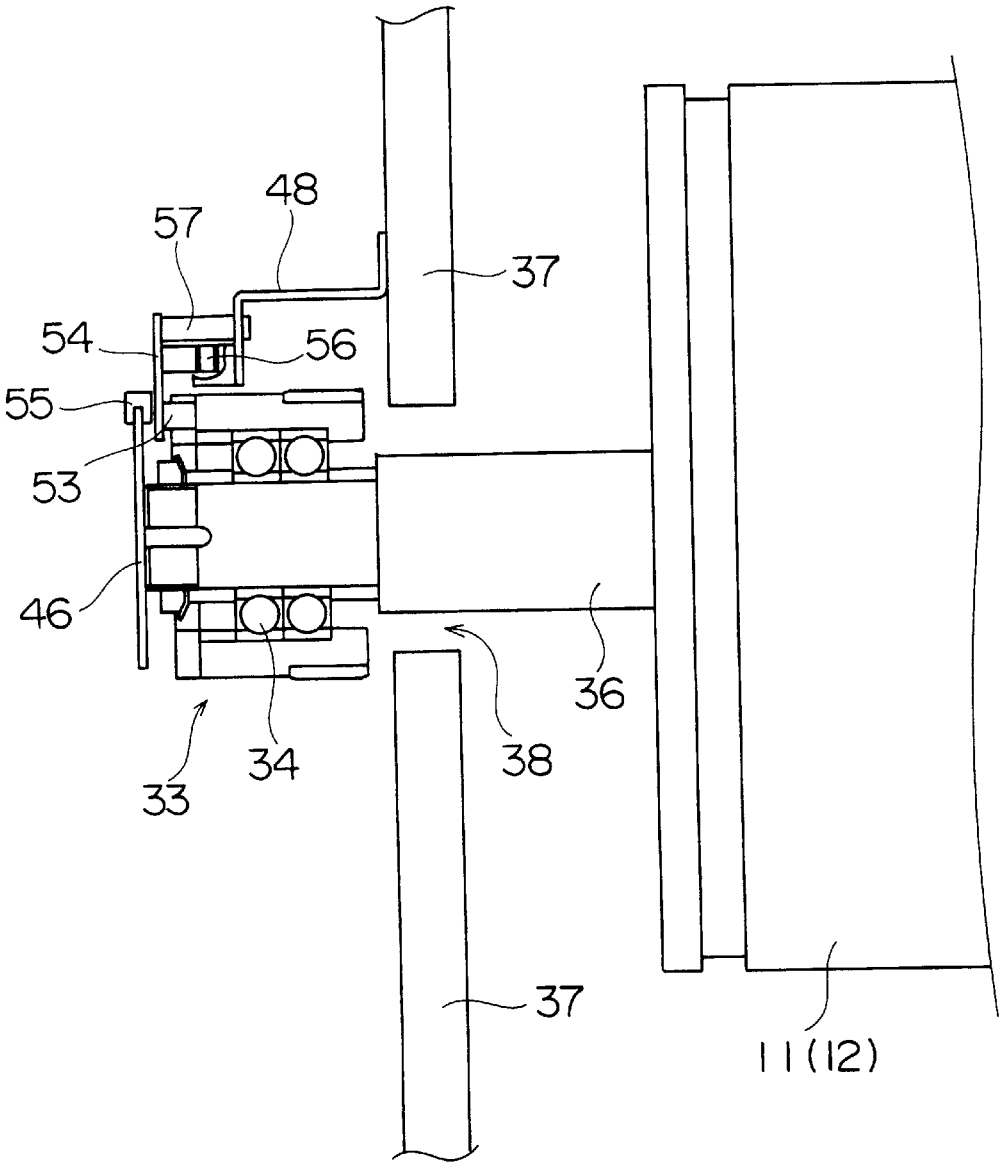
FIG. 3 is a sectional side view showing bearings and adjacent components of the first cylinder moving mechanism.

FIG. 2 is a front view of the first and second plate cylinder moving mechanisms 31 and 32. FIG. 3 is a sectional side view showing bearings and adjacent components of the first cylinder moving mechanism 31. The first and second plate cylinder moving mechanisms 31 and 32 have similar structures symmetrical to each other. Common components of the first and second plate cylinder moving mechanisms 31 and 32 are affixed with the same reference numerals.

Each of the first and second plate cylinder moving mechanisms 31 and 32 has groove slots 38 formed in side plates 37 (FIG. 2 shows only the groove slots 38, and omits the side plates 37), in order to move a bearing assembly 33 including a pair of bearings 34 supporting a shaft 36 of the first or second plate cylinder 11 or 12. The bearing assembly 33 is connected to a slide holder 41 movable along a guide 39. The slide holder 41 includes a nut 42. The nut 42 is meshed with a ball screw 44 coupled to a drive shaft of a motor 35.

Thus, the first plate cylinder 11 is driven by the motor 35 to move with the slide holder 41. The first plate cylinder 11 is movable along the guide 39 and ball screw 44 between the first printing position shown in the solid line in FIG. 1 and in a two-dot chain line in FIG. 2, and the image recording position shown in the two-dot chain line in FIG. 1 and in a solid line in FIG. 2. Similarly, the second plate cylinder 12 is movable along the guide 39 and ball screw 44 between the second printing position shown in solid lines in FIGS. 1 and 2, and the image recording position shown in the two-dot chain line in FIG. 1 and in the solid line in FIG. 2.

A fixing member 44 is attached to the side plate 37 adjacent the first or second printing position for fixing the bearing assembly 33. The first plate cylinder 11 is fixed to the first printing position by the fixing member 44, while the second plate cylinder 12 is fixed to the second printing position by the fixing member 44.

Each of the first and second plate cylinders 11 and 12 has an antirotation mechanism, described hereinafter, for preventing rotation of the plate cylinder 11 or 12 during movement by the first or second plate cylinder moving mechanism 31 or 32.

The first and second plate cylinders 11 and 12 are held against rotation by using the antirotation mechanisms for the following reason, A displacement in a relationship in rotational position between the first or second plate cylinder 11 or 12 and the first or second blanket cylinder 13 or 14 or other components would give rise to a problem of misregistration of printing positions or collision between components. It is therefore necessary to maintain a constant positional relationship between the cylinders 11 and 13 or 12 and 14. When the image recorder 25, described hereinafter, records images on a plate mounted on the first or second plate cylinder 11 or 12, a photocoupler 87, described hereinafter, or a rotary encoder monitors a rotational position of the plate cylinder 11 or 12. However, the first or second plate cylinder 11 or 12 could rotate inadvertently during the movement from the image recording position to the first or second printing position, resulting in a displacement in the relationship in rotational position between the first or second plate cylinder 11 or 12 and the first or second blanket cylinder 13 or 14. To avoid such an inconvenience, the antirotaion mechanism is used to prevent rotation of the first or second plate cylinder 11 or 12 during movement.

Each antirotation mechanism includes a rotatable disk 46 connected to the shaft 36 of the first or second plate cylinder 11 or 12 and having a cutout formed peripherally of the disk 46, a detent 47 engageable with the cutout to stop rotation of the rotatable disk 46, a release member 48 disposed adjacent the first or second printing position for disengaging the detent 47 from the cutout formed in the rotatable disk 46, and a release member 49 disposed adjacent the image recording position for disengaging the detent 47 from the cutout formed in the rotatable disk 46.

Figure 4:
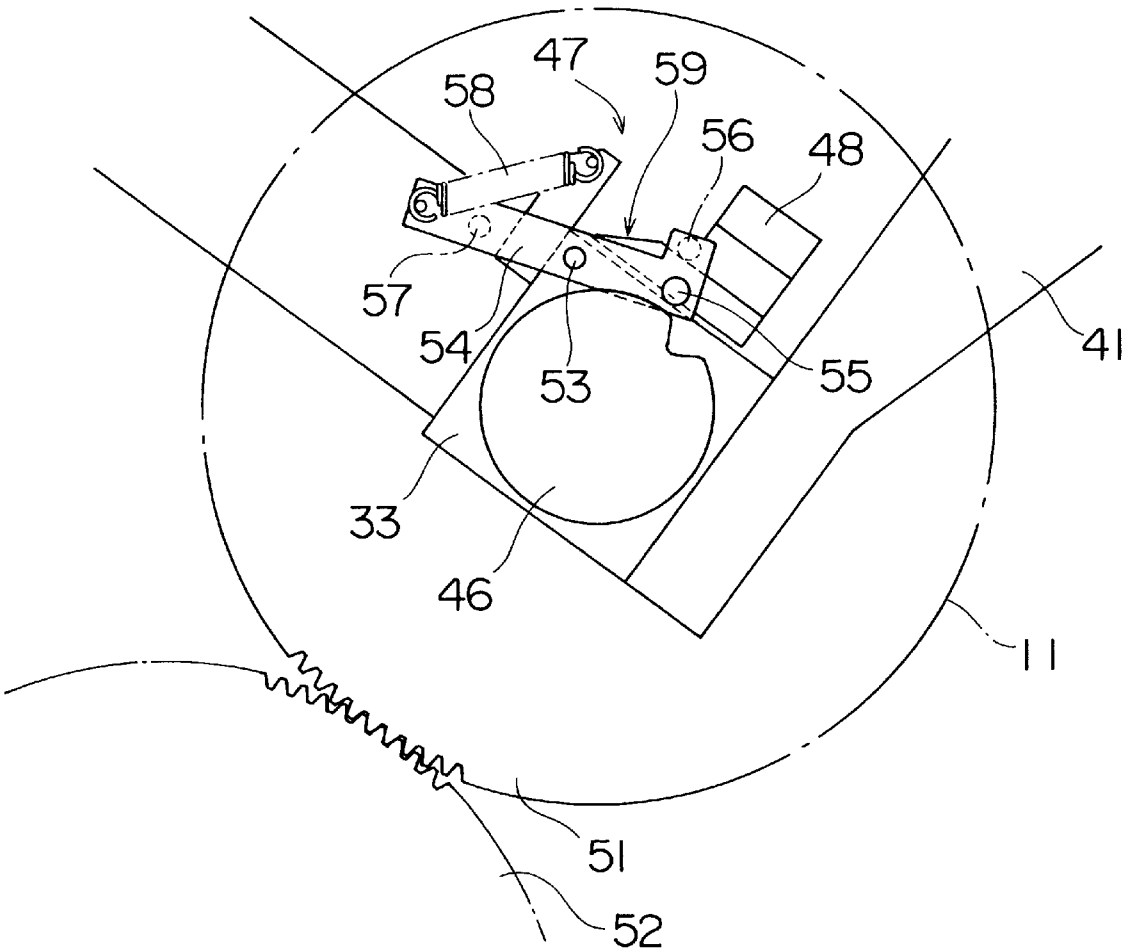
FIG. 4 is a schematic view showing a relationship between a detent attached to a first plate cylinder and a release member disposed in a first printing position.

FIG. 4 is a schematic view showing a relationship between the detent 47 attached to the first plate cylinder 11 and the release member 48 disposed in the first printing position. The detent 47 includes a lever 54 pivotable about an axis 53 attached to the bearing assembly 33, an engaging pin 55 projecting from a front surface of the lever 54, a guide pin 56 projecting from a rear surface of the lever 54 opposite from the engaging pin 55, a press pin 57 opposed to the guide pin 56 across the axis 53, and a spring 58 for biasing the lever 54 in a direction to move the engaging pin 55 toward the rotatable disk 46. The release member 48 is in the form of a cam defining a ramp 59 for guiding the guide pin 56.

The detent 47 of the second plate cylinder 12 has a construction similar to the above, and so does the release member 48 disposed in the second printing position.

Figure 7:
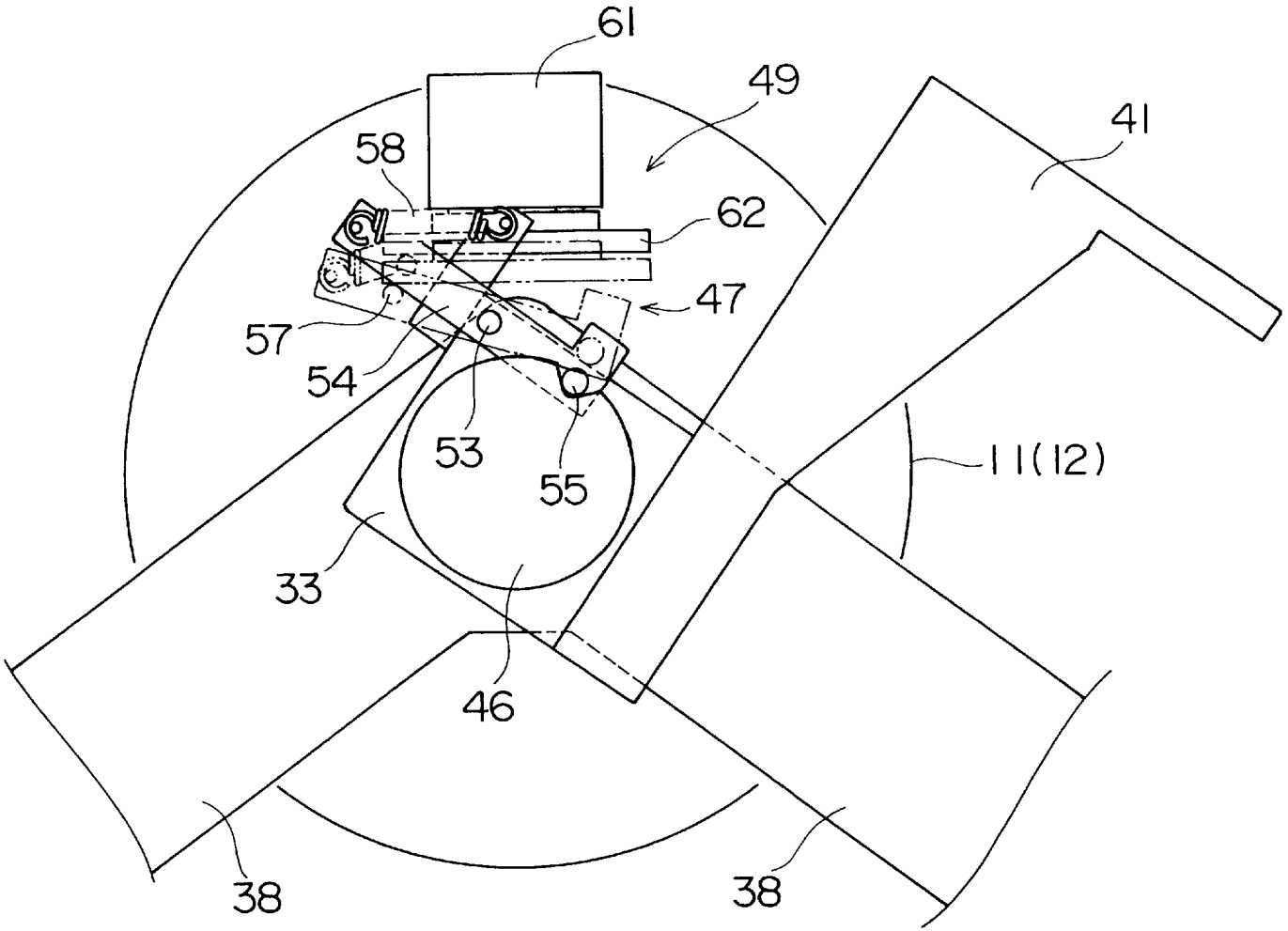
FIG. 7 is a schematic view showing a relationship between the detent attached to the first plate cylinder and a release member disposed in an image recording position.

FIG. 7 is a schematic view showing a relationship between the detent 47 and the release member 49 disposed in the image recording position. The release member 49 includes a presser plate 62 reciprocable by an air cylinder 61 for depressing the press pin 57 of the detent 47 of the first plate cylinder 11 having moved to the image recording position.

When the second plate cylinder 12 is in the image recording position, the press pin 57 of the detent 47 attached to the second plate cylinder 12 is depressed by the presser plate 62 of the release member 49.

Figure 8:
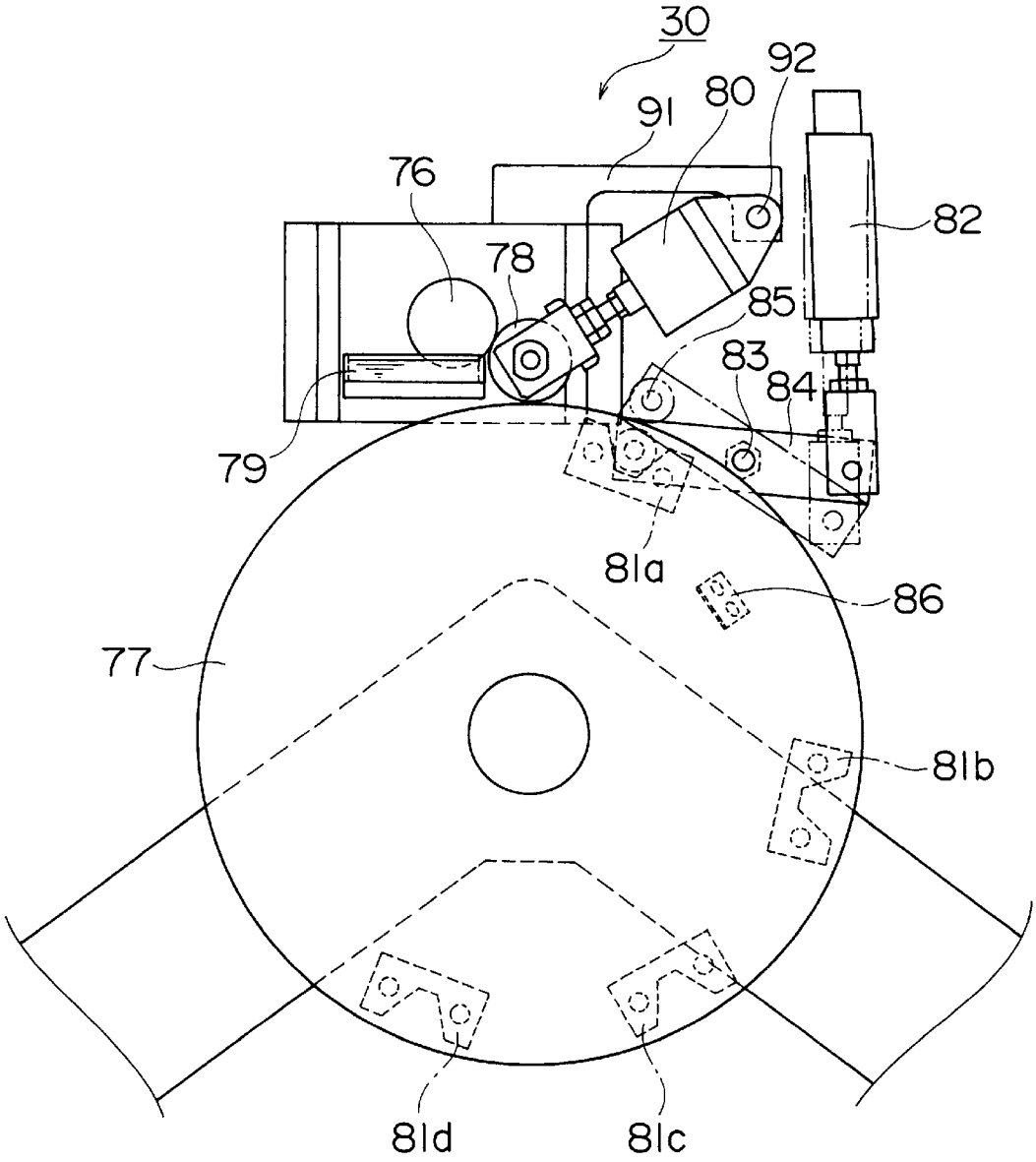
FIG. 8 is a front view of a plate cylinder rotating mechanism and adjacent components.
Figure 9:
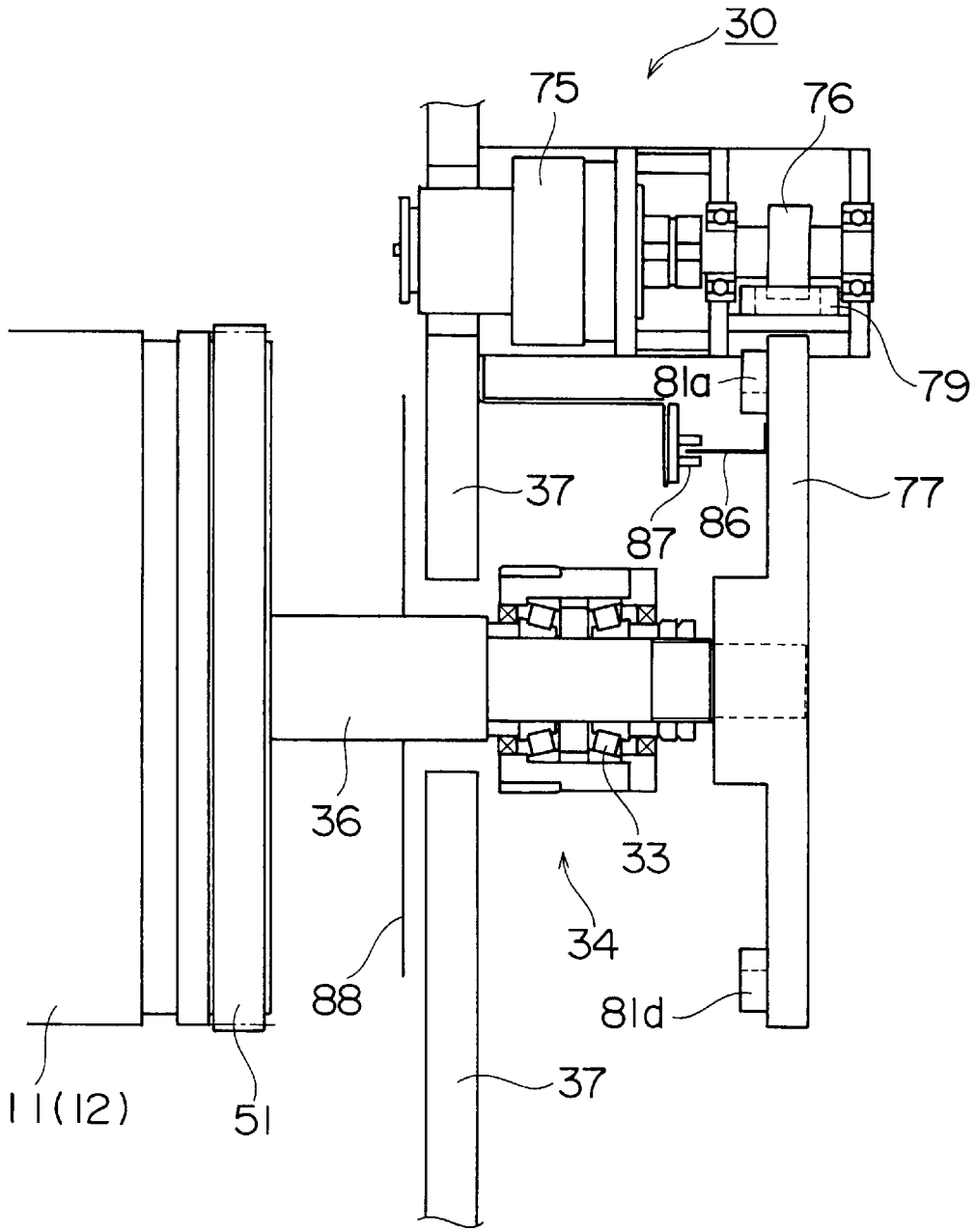
FIG. 9 is a sectional side view showing a principal portion of FIG. 8.

FIG. 8 is a front view of the above plate cylinder rotating mechanism 30 and adjacent components. FIG. 9 is a sectional side view of a principal portion thereof. The plate cylinder rotating mechanism 30 is operable to rotate the first or second plate cylinder 11 or 12 in the image recording position. The plate cylinder rotating mechanism 30 is opposed to the antirotation mechanism across the first or second plate cylinder 11 or 12. It is to be noted that a transmission rotor 78 and its moving mechanism are omitted from FIG. 9.

The plate cylinder rotating mechanism 30 includes a drive roller 76 rotatable by a drive motor 75, first and second driven rollers 77 connected to the shafts 36 of the first plate cylinder 11 and second plate cylinder 12 to be coaxial with the plate cylinders 11 and 12, respectively, and the transmission roller 78 for transmitting drive from the drive roller 76 to one of the driven rollers 77 mounted coaxially with the first plate cylinder 11 and second plate cylinder 12.

The drive roller 76 has a lower portion thereof immersed in oil stored in an oil pan 79. As noted above, each driven roller 77 is mounted coaxially with the first or second plate cylinder 11 or 12 through the shaft 36 of the plate cylinder 11 or 12, to be rotatable synchronously therewith. Further, the transmission roller 78 is rotatably supported at the distal end of a cylinder rod of the air cylinder 80 having a proximal end thereof oscillatably coupled to a support member 91 through an axis 92. The transmission roller 78 is movable by the air cylinder 80 between a drive transmitting position in pressure contact with both of the drive roller 76 and driven roller 77 and a retracted position away from the drive roller 76 and driven roller 77.

When, with the transmission roller 78 moved to the drive transmitting position, the drive motor 75 rotates the drive roller 76 at a fixed speed, the rotation of the drive roller 76 is transmitted to the driven roller 77 through the transmission roller 78, whereby the first or second plate cylinder 11 or 12 rotates at a fixed speed. At this time, the drive of the motor 75 is transmitted to the first or second plate cylinder 11 or 12. the traction type drive transmission mechanism utilizing friction among the drive roller 76, driven roller 77 and transmission roller 78. Thus, the first or second plate cylinder 11 or 12 is rotated accurately without any irregularities.

Particularly, in the foregoing embodiment, the transmission roller 78 is movable between the drive transmitting position in pressure contact with both of the drive roller 76 and driven roller 77 and the retracted position away from the drive and driven rollers 76 and 77. After the first or second plate cylinder 11 or 12 is moved to the image recording position, the transmission roller 78 is placed in pressure contact with the drive roller 76 and driven roller 77. Thus, the first or second plate cylinder 11 or 12 is rotated accurately with no slippage among the transmission roller 78, drive roller 76 and driven roller 77.

Consequently, even where, as in the printing apparatus in this embodiment, the driven rollers 77 move in different directions as the first and second plate cylinders 11 and 12 move between the image recording position and the first and second printing positions, the transmission roller 78 may be pressed not only on the drive roller 76 but on one of the driven rollers 77 having moved to the image recording position. This is achieved by moving the transmission roller 78 to the drive transmitting position in pressure contact with both of the drive roller 76 and driven roller 77 after the first or second plate cylinder 11 or 12 has moved to the image recording position. Thus, the first or second plate cylinder 11 or 12 is rotated accurately with no slippage among the transmission roller 78, drive roller 76 and driven roller 77.

Each driven roller 77 has four positioning members 81*a*, 81*b*, 81*c* and 81*d* in the form of V-blocks for positioning and fixing the first or second plate cylinder 11 or 12 to a predetermined angular position. The positioning members 81*a*, 81*b*, 81*c* and 81*d* are engageable with an engaging pin 85 disposed at a distal end of a lever 84 pivotable about an axis 83 by an air cylinder 82. In this way, the positioning members 81*a*, 81*b*, 81*c* and 81*d* are used to position and fix the first or second plate cylinder 11 or 12 to a predetermined angular position.

Each driven roller 77 further includes a detection plate 86 erected thereon for use in detecting an angular position of the driven roller 77. Each side plate 37 has a photocoupler 87 for detecting the detection plate 86. The angular position of the driven roller 77, i.e. that of the first or second plate cylinder 11 or 12, is monitored based of a detection signal of the photocoupler 87 detecting the detection plate 86, and a pulse signal generated, in response to rotation of the first or second plate cylinder 11 or 12, by a rotary encoder, not shown, connected to the shaft 36 of the first or second plate cylinder 11 or 12.

Further, a light-shielding plate 88 is mounted on the shaft 36 of each of the first and second plate cylinders 11 and 12.

An operation of the above antirotation mechanism for preventing rotation of the first or second plate cylinder 11 or 12, and an operation of the traction type plate cylinder rotating mechanism 30 for rotating the first or second plate cylinder 11 or 12, will be described next. In the following description, a rotation preventing operation and a rotating operation are effected for the first plate cylinder 11. It will be appreciated that similar steps are taken in a rotation preventing operation and a rotating operation for the second plate cylinder 12.

When the first plate cylinder 11 is in the first printing position as shown in FIG. 4, the gear 51 disposed coaxially with the first plate cylinder 11 is engaged with the gear 52 disposed coaxially with the first blanket cylinder 13.

Figure 5:
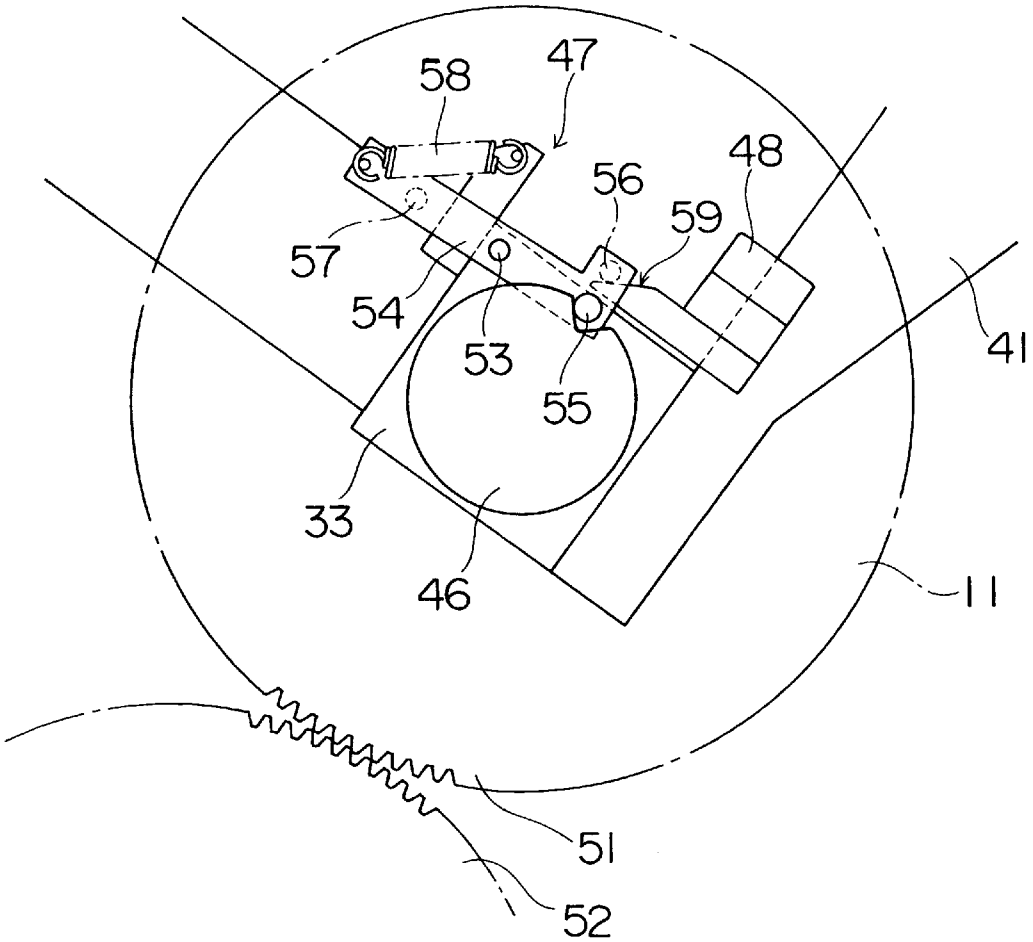
FIG. 5 is another schematic view showing the relationship between the detent and release member.

When the first plate cylinder moving mechanism 31 starts moving the first plate cylinder 11 from the first printing position to the image recording position as shown in FIG. 5, the gear 51 disposed coaxially with the first plate cylinder 11 gradually moves out of engagement with the gear 52 disposed coaxially with the first blanket cylinder 13. At this time, the guide pin 56 of the detent 47 slides along the ramp 59 of the release member 48, causing the lever 54 to pivot about the axis 53. As a result, the engaging pin 55 starts moving into the cutout of the rotatable disk 46.

At this time, the gear 51 disposed coaxially with the first plate cylinder 11 is not completely out of engagement with the gear 52 disposed coaxially with the first blanket cylinder 13. The rotation of the first plate cylinder 11 is not yet prevented by the detent 47. Thus, in the state shown in FIG. 5, the first plate cylinder 11 moves toward the image recording position while rotating counterclockwise. Consequently, the gears 51 and 52 are prevented from damage due to a collision with each other.

Figure 6:
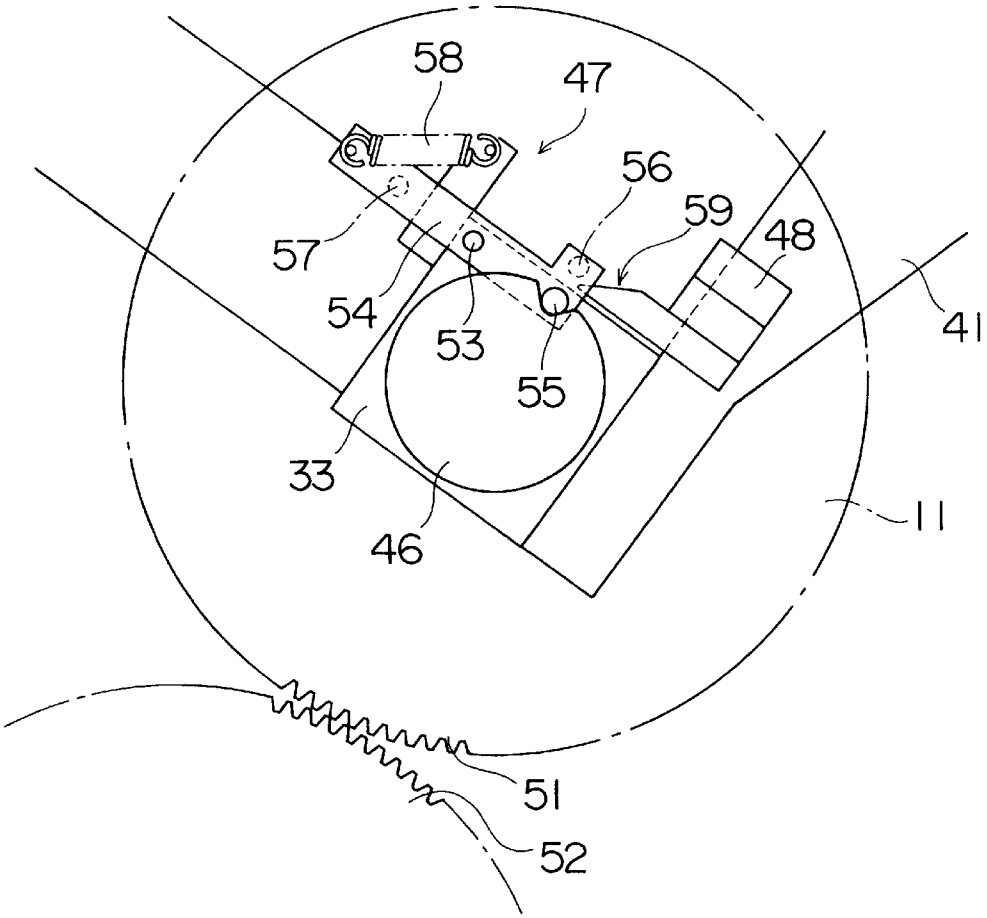
FIG. 6 is yet another schematic view showing the relationship between the detent and release member.

As the first plate cylinder 11 moves further toward the image recording position, the gear 51 disposed coaxially with the first plate cylinder 11 becomes disengaged from the gear 52 disposed coaxially with the first blanket cylinder 13 as shown in FIG. 6. In the state, the guide pin 56 of the detent 47 is completely disengaged from the ramp 59 of the release member 48, and the engaging pin 55 is completely fitted in the cutout of the rotatable disk 46. Consequently, the first plate cylinder 11 is locked against rotation.

In this state, the first plate cylinder moving mechanism 31 moves the first plate cylinder 11 to the image recording position as shown in FIG. 7. Then, as shown in FIG. 8, the air cylinder 80 moves the transmission roller 78 of the plate cylinder rotating mechanism 30 to the drive transmitting position in pressure contact with both of the drive roller 76 and driven roller 77. Subsequently, the air cylinder 61 moves the presser plate 62 of the release member 49 from a position shown in a solid line to a position shown in a two-dot chain line in FIG. 7. As a result, the press pin 57 of the detent 47 is depressed to cause the lever 54 to pivot about the axis 53, thereby moving the engaging pin 55 out of the cutout in the rotatable disk 46. The first plate cylinder 11 has now become rotatable.

In this state, the traction type plate cylinder rotating mechanism 30 rotates the first plate cylinder 11 at low speed. After a plate is placed on the first plate cylinder 11, the image recorder 25 records images on the plate. After the images are recorded on the plate, the images are developed by the developing device 26. After the image recording and developing processes for the plate, the first plate cylinder 11 is returned to home position by using detection values provided by the detection plate 86 and photocoupler 87. The air cylinder 80 moves the transmission roller 78 of the plate cylinder rotating mechanism 30 to the retracted position. The air cylinder 82 shown in FIG. 8 is operated to engage the engaging pin 85 with the positioning member 81*a*. As a result, the first plate cylinder 11 is fixed to a predetermined angular position through the driven roller 77.

Subsequently, the air cylinder 61 moves the presser plate 62 of the release member 49 from the position shown in the two-dot chain line to the position shown in the solid line in FIG. 7. Thus, the press pin 57 of the detent 47 moves upward to cause the lever 54 to pivot about the axis 53, thereby moving the engaging pin 55 of the detent 47 into engagement with the cutout in the rotatable disk 46. As a result, the first plate cylinder 11 is locked against rotation.

Then, the first plate cylinder moving mechanism 31 moves the first plate cylinder 11 from the image recording position to the first printing position. With this movement of the first plate cylinder 11, the engaging pin 55 of the detent 47 becomes disengaged from the rotatable disk 46 in an operation reversed from the operation occurring with the movement the first plate cylinder 11 from the first printing position to the image recording position shown in FIGS. 4 through 6.

That is, as the first plate cylinder 11 moves from the position shown in FIG. 6 to the position shown in FIG. 5, the guide pin 56 of the detent 47 slides along the ramp 59 of the release member 48 to cause the lever 54 to pivot about the axis 53. As a result, the engaging pin 55 moves out of the cutout of the rotatable disk 46. At the same time, the gear 51 disposed coaxially with the first plate cylinder 11 begins to engage the gear 52 disposed coaxially with the first blanket cylinder 13.

As the gear 51 disposed coaxially with the first plate cylinder 11 begins to engage the gear 52 disposed coaxially with the first blanket cylinder 13, the detent 47 releases the first plate cylinder 11. Then, the first plate cylinder 11, in the state shown in FIG. 5, moves toward the first printing position while rotating clockwise. Consequently, the gears 51 and 52 are prevented from damage due to a collision with each other.

When the first plate cylinder 11 returns to the first printing position as shown in FIG. 4, the gear 51 disposed coaxially with the first plate cylinder 11 is fully engaged with the gear 52 disposed coaxially with the first blanket cylinder 13.

Referring again to FIG. 1, the plate feeder 23 and plate remover 24 are arranged around the first or second plate cylinder 11 or 12 in the image recording position.

The plate feeder 23 includes a supply cassette 63 storing a roll of elongate blank plate in light-shielded state, a guide member 64 and guide rollers 65 for guiding a forward end of the plate drawn from the cassette 63 to the surface of the first or second plate cylinder 11 or 12, and a cutter 66 for cutting the elongate plate into sheet plates. Each of the first and second plate cylinders 11 and 12 has a pair of grippers, not shown, for gripping the forward and rear ends of the plate fed from the plate feeder 23.

The plate remover 24 has a pawl mechanism 73 for separating a plate from the first or second plate cylinder 11 or 12 after a printing operation, and a conveyor mechanism 69 for transporting the plate separated by the pawl mechanism 73 to a discharge cassette 68.

The forward end of the plate drawn from the feeder cassette 63 is guided by the guide rollers 65 and guide member 64, and gripped by one of the grippers on the first or second plate cylinder 11 or 12. Then, the first or second plate cylinder 11 or 12 is rotated by the plate cylinder rotating mechanism 30, whereby the plate is wrapped around the first or second plate cylinder 11 or 12. The rear end of the plate cut by the cutter 66 is gripped by the other gripper. While, in this state, the first or second plate cylinder 11 or 12 is rotated at low speed by the rotating mechanism 30 as described above, the image recorder 25 irradiates the surface of the plate mounted peripherally of the first or second plate cylinder 11 or 12 with a modulated laser beam for recording images thereon.

Figure 10A:
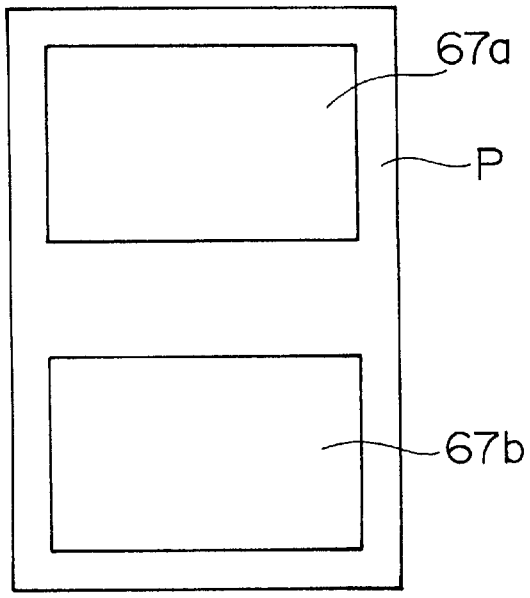
FIGS. 10A and 10B are explanatory views each showing an arrangement of image areas on a plate.
Figure 10B:
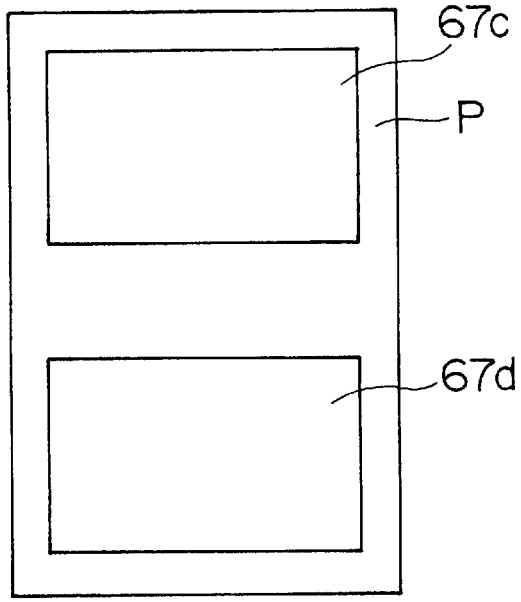

On the plate P mounted peripherally of the first plate cylinder 11, the image recorder 25, as shown in FIG. 10A, records an image area 67*a* to be printed with black ink, and an image area 67*b* to be printed with magenta ink. On the plate P mounted peripherally of the second plate cylinder 12, the image recorder 25, as shown in FIG. 10B, records an image area 67*c* to be printed with cyan ink, and an image area 67*d* to be printed with yellow ink. The image areas 67*a* and 67*b* are recorded in evenly separated positions, i.e. in positions separated from each other by 180 degrees, on the plate P mounted peripherally of the first plate cylinder 11. Similarly, the image areas 67*c* and 67*d* are recorded in evenly separated positions, i.e. in positions separated from each other by 180 degrees, on the plate P mounted peripherally of the second plate cylinder 12.

Figure 11:
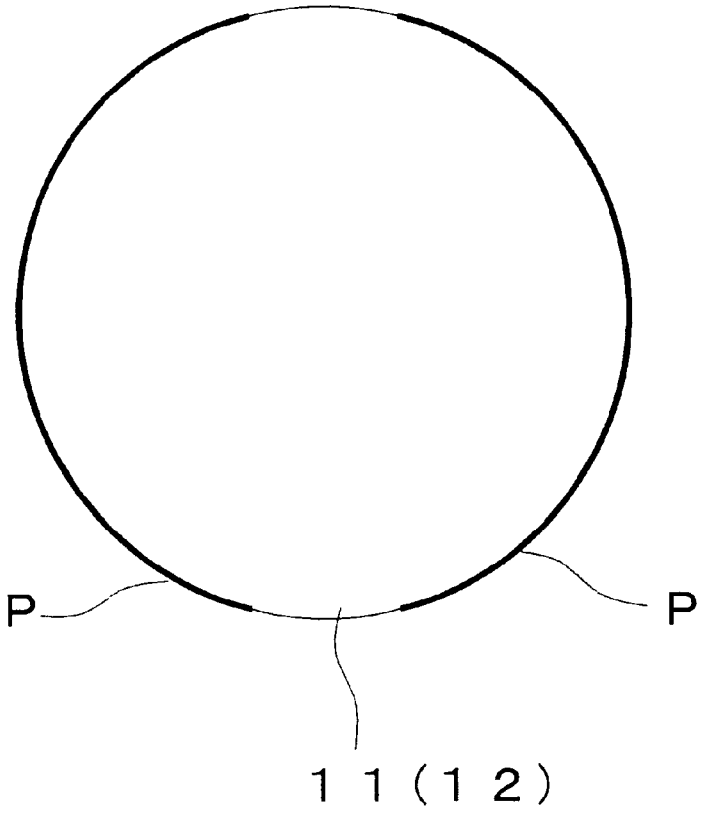
FIG. 11 is a schematic view showing two plates, each having a single image area, mounted peripherally of a plate cylinder.

In the foregoing embodiment, two image areas 67*a* and 67*b* or 67*c* and 67*d* are provided on the single plate P mounted peripherally of the first or second plate cylinder 11 or 12, in order to simplify the structure of the first or second plate cylinder 11 or 12. Alternatively, the first or second plate cylinder 11 or 12 may include two sets of grippers, each set for holding the forward and rear ends of one plate P. Then, as shown in FIG. 11, each of the first and second plate cylinders 11 and 12 may support two plates P each having a single image area. In this case also, the two plates P should be held as evenly separated on the first or second plate cylinder 11 or 12, so that the image areas recorded on the respective plates are in evenly separated positions, i.e. in positions separated from each other by 180 degrees.

Referring again to FIG. 1, the ink feeders 20*a* and 20*b* are arranged around the first plate cylinder 11 in the first printing position, while the ink feeders 20*c* and 20*d* are arranged around the second plate cylinder 12 in the second printing position, as described hereinbefore. Each of these ink feeders 20*a*, 20*b*, 20*c* and 20*d* (which may be referred to collectively as "ink feeders 20") includes a plurality of ink rollers 71 and an inkwell 72.

Further, the dampening water feeders 21*a* and 21*b* are arranged around the first plate cylinder 11 in the first printing position, while the dampening water feeders 21*c* and 21*d* are arranged around the second plate cylinder 12 in the second printing position. These dampening water feeders 21*a*, 21*b*, 21*c* and 21*d* (which may be referred to collectively as "dampening water feeders 21") feed dampening water to the plates P before the ink feeders 20 feed the inks thereto.

The ink rollers 71 of the ink feeders 20*a* and 20*b* are swingable by action of cams 241 and other components described hereinafter. With the swinging movement, the ink rollers 71 of the ink feeder 20*a* or 20*b* come into contact with one of the two image areas 67*a* and 67*b* formed on the plate P mounted peripherally of the first plate cylinder 11. Similarly, the ink rollers 71 of the ink feeders 20*c* and 20*d* are swingable by action of the cams 241 and other components described hereinafter. With the swinging movement, the ink rollers 71 of the ink feeder 20*c* or 20*d* come into contact with one of the two image areas 67*c* and 67*d* formed on the plate P mounted peripherally of the second plate cylinder 12.

Of the dampening water feeders 21, the water feeder 21*a* feeds dampening water to the image area 67*a* on the plate P, the water feeder 21*b* feeds dampening water to the image area 67*b* on the plate P, the water feeder 21*c* feeds dampening water to the image area 67*c* on the plate P, and the water feeder 21*d* feeds dampening water to the image area 67*d* on the plate P.

Figure 12:
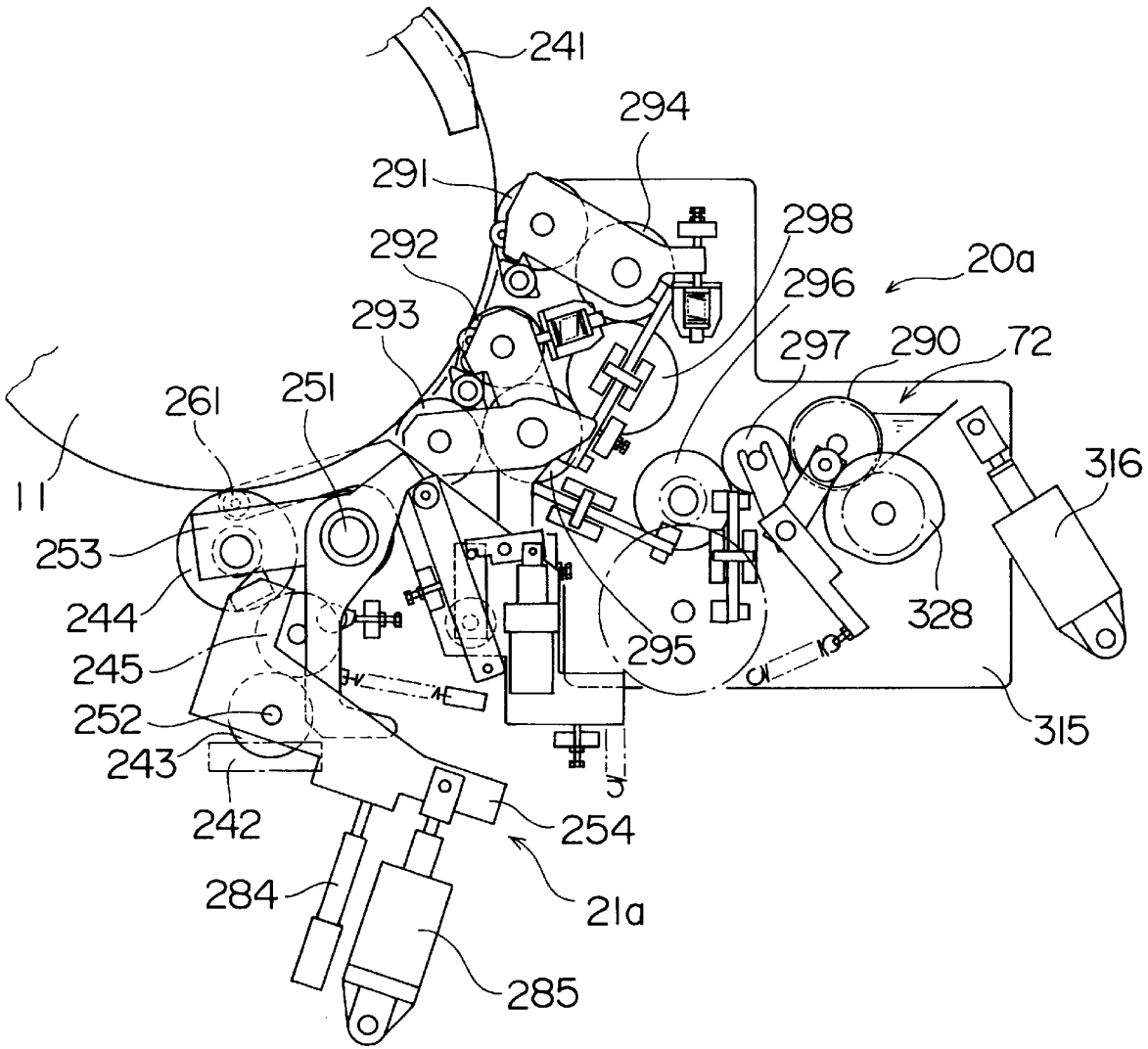
FIG. 12 is a schematic front view of an ink feeder and a dampening water feeder.
Figure 13:
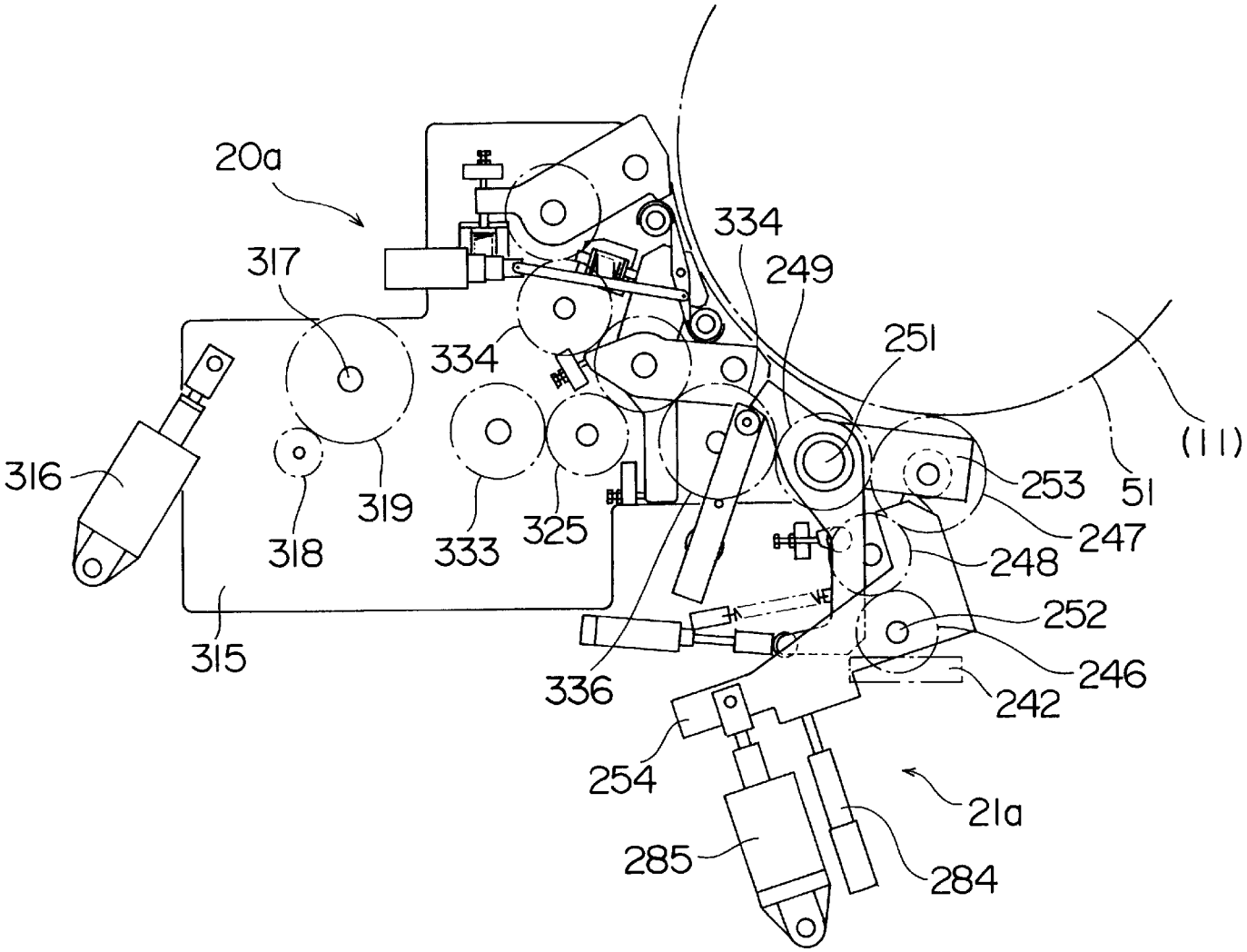
FIG. 13 is a schematic rear view of the ink feeder and dampening water feeder.

FIG. 12 is a schematic front view showing only the ink feeder 20*a* and water feeder 21*a* among the ink feeders 20*a*, 20*b*, 20*c* and 20*d* and water feeders 21*a*, 21*b*, 21*c* and 21*d*. FIG. 13 is a schematic rear view of the ink feeder 20*a* and water feeder 21*a*. The other ink feeders 20*b*, 20*c* and 20*d* and water feeders 21*b*, 21*c* and 21*d* have the same constructions as these ink feeder 20*a* and water feeder 21*a*, respectively.

As described hereinafter, the water feeder 21*a* has a gear 247 attached to a water applying roller 244 engageable with the gear 51 of the first plate cylinder 11 acting as a drive gear. Through this engagement, a water fountain roller 243, the water applying roller 244 and an intermediate roller 245 of the water feeder 21*a* are rotatable by the first plate cylinder 11. The drive of the first plate cylinder 11 is transmitted to gears 331, 332, 333, 334, 335 and 336 for rotating ink kneading rollers 294, 295 and 296 of the ink feeder 20*a*. This drive transmission is made through a gear 249 acting as a drive transmitting gear mounted coaxially with a shaft 251 supporting a pair of first, right and left arms 253 of the water feeder 21*a* and a pair of right and left side plates 315 of the ink feeder 20*a*.

Figure 14:
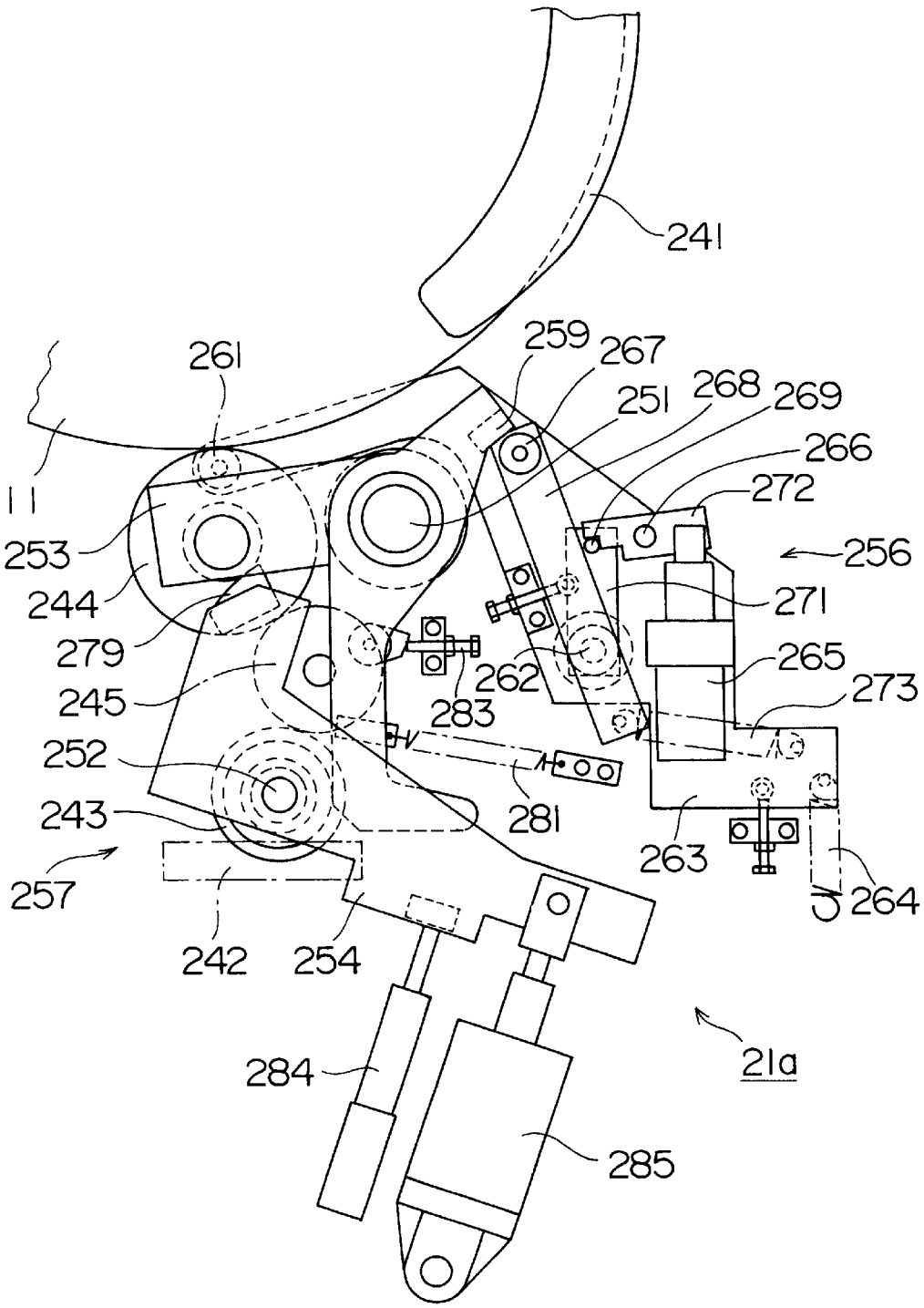
FIG. 14 is a schematic front view of the dampening water feeder.
Figure 15:
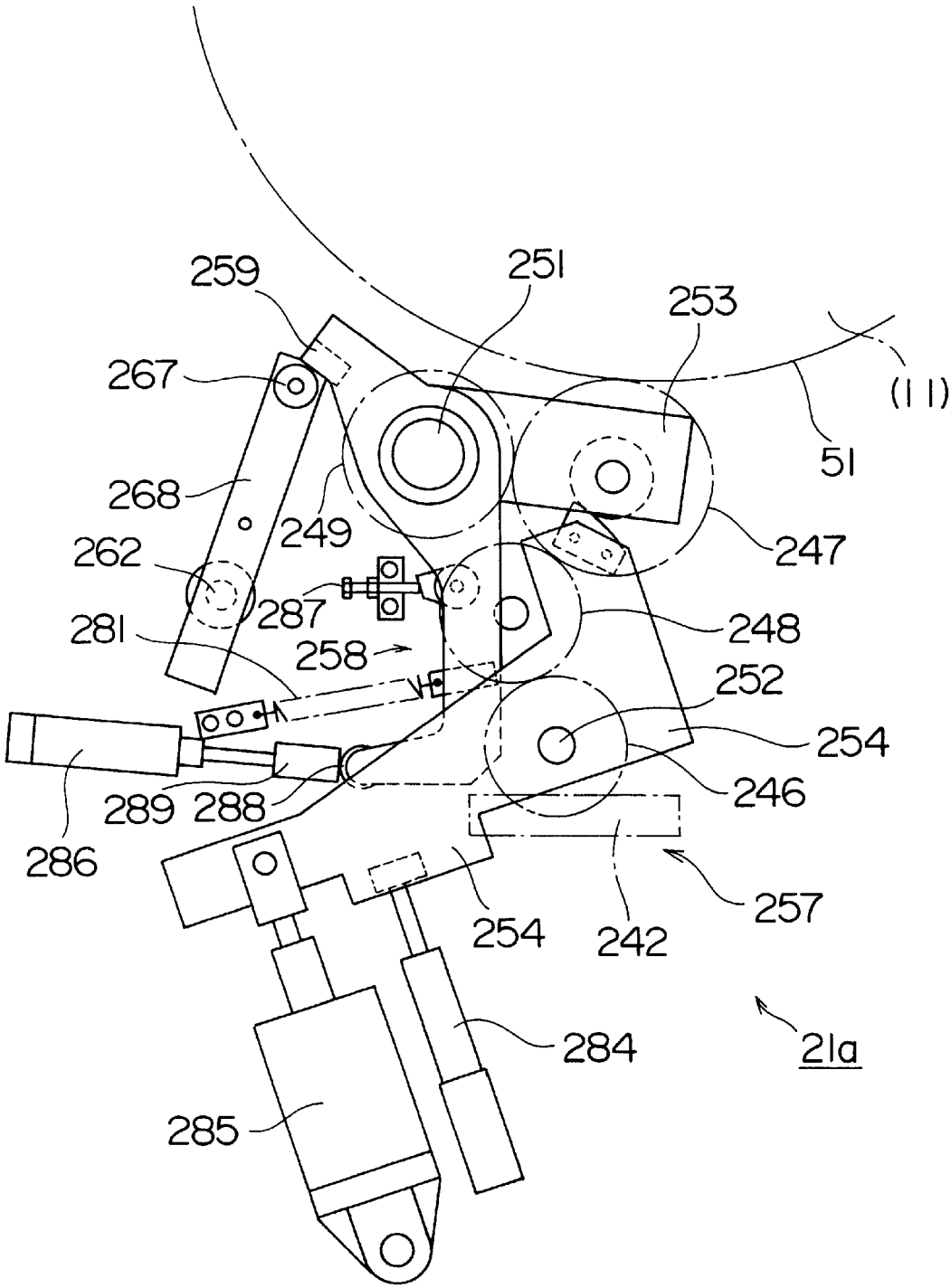
FIG. 15 is a schematic rear view of the dampening water feeder.

The construction of dampening water feeder 21 will be described first. FIG. 14 is a schematic front view of the water feeder 21*a*. FIG. 15 is a schematic rear view of the water feeder 21*a*. While only the water feeder 21*a* will be described hereinafter, the other water feeders 21*b*, 21*c* and 21*d* have the same construction as the water feeder 21*a*.

As shown in FIG. 14, the dampening water feeder 21*a* includes a water vessel 242 for storing dampening water, the fountain roller 243 for dipping in and picking up the dampening water in the water vessel 242, the water applying roller 244 for contacting the surface of plate P to apply the dampening water to the image area 67*a*, and the intermediate roller 245 disposed between the fountain roller 243 and water applying roller 244. The water applying roller 244, fountain roller 243 and intermediate roller 245 act as dampening rollers for feeding the dampening water to the plate P.

Figure 16:
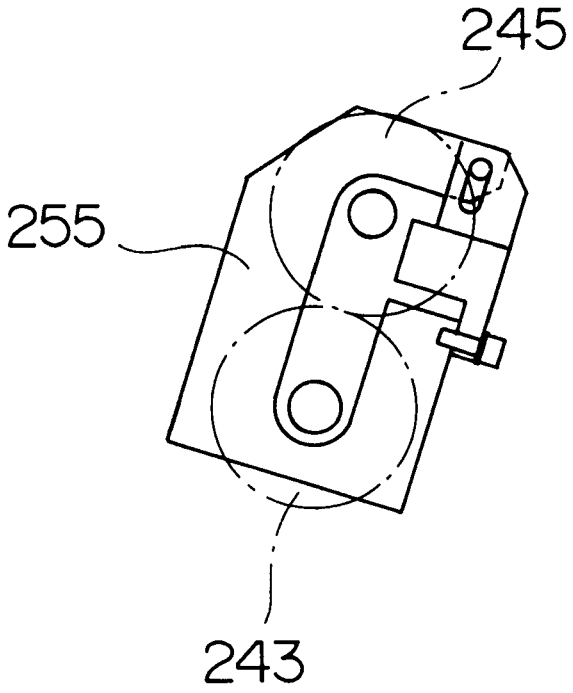
FIG. 16 is an explanatory view of a connection between an intermediate roller and a water fountain roller.

As shown in FIGS. 14 and 15, the water applying roller 244 is supported by the pair of first, right and left arms 253 pivotable about the shaft 251. The fountain roller 243 is supported by a pair of second, right and left arms 254 pivotable about a shaft 252. As shown in FIG. 16, the intermediate roller 245 is coupled to the fountain roller 243 through a pair of right and left support plates 255. The intermediate roller 245 is supported by the second arms 254 through the support plates 255.

As shown in FIG. 15, a gear 246 is attached to the fountain roller 243, the gear 247 to the water applying roller 244, and a gear 248 to the intermediate roller 245. The gear 246 and gear 248 are connected to each other, and driven by a driving device not shown. The gear 247 attached to the water applying roller 244 is engageable, in a drive transmitting position shown in FIG. 15, with the gear 51 of the first plate cylinder 11. Thus, the water applying roller 244 is rotatable by drive transmitted from the first plate cylinder 11. The fountain roller 243 and intermediate roller 245 are rotatable independently of the water applying roller 244.

The gear 247 attached to the water applying roller 244 is meshed also with the gear 249 disposed coaxially with the shaft 251 acting as a support shaft of the first arms 253. The gear 249 acs as a drive transmission gear for transmitting drive between the water feeder 21*a* and ink feeder 20*a*.

With rotation of the fountain roller 243, water applying roller 244 and intermediate roller 245, the dampening water stored in the water vessel 242 is transferred from the fountain roller 243 through the intermediate roller 245 to the water applying roller 244 to be fed to the plate P on the first plate cylinder 11.

The dampening water feeder 21*a* further includes a water applying roller moving mechanism 256 for moving the water applying roller 244 into contact with only a necessary region of the plate P, a contact pressure adjusting mechanism 257 for maintaining a fixed contact pressure between the water applying roller 244 and intermediate roller 245 when the water applying roller 244 is moved by the water applying roller moving mechanism 256, and a gear retracting mechanism 258 for moving the gear 247 attached to the water applying roller 244 from the drive transmitting position to a retracted position when the first plate cylinder 11 is moved to the first printing position.

Figure 17:
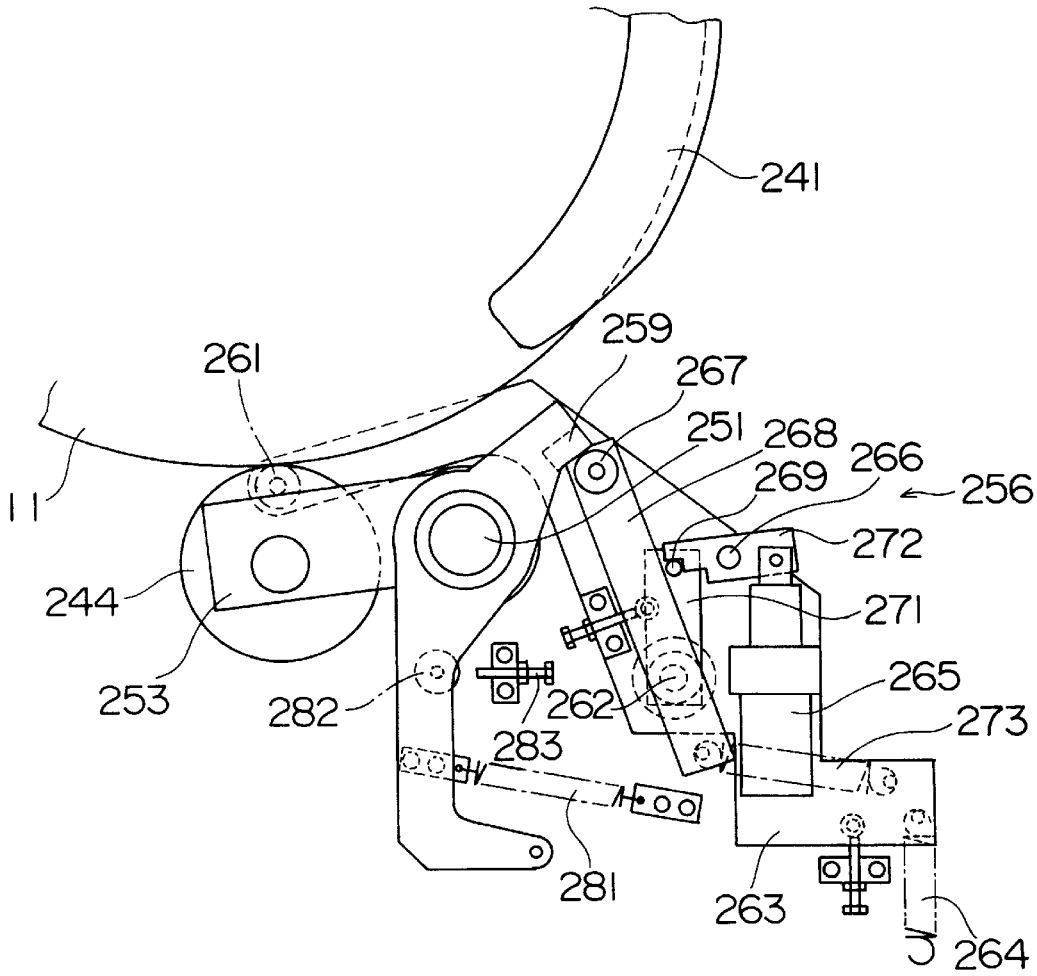
FIG. 17 is a schematic view of a water applying roller moving mechanism.
Figure 18:
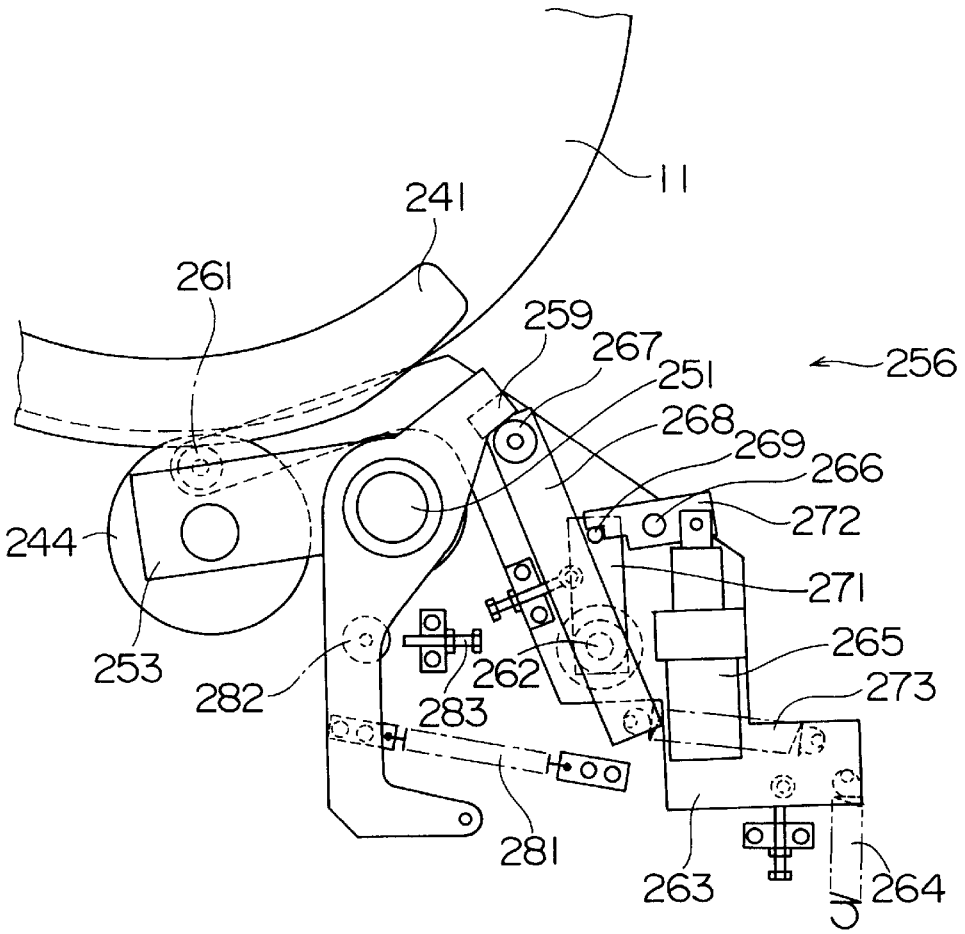
FIG. 18 is another schematic view of the water applying roller moving mechanism.
Figure 19:
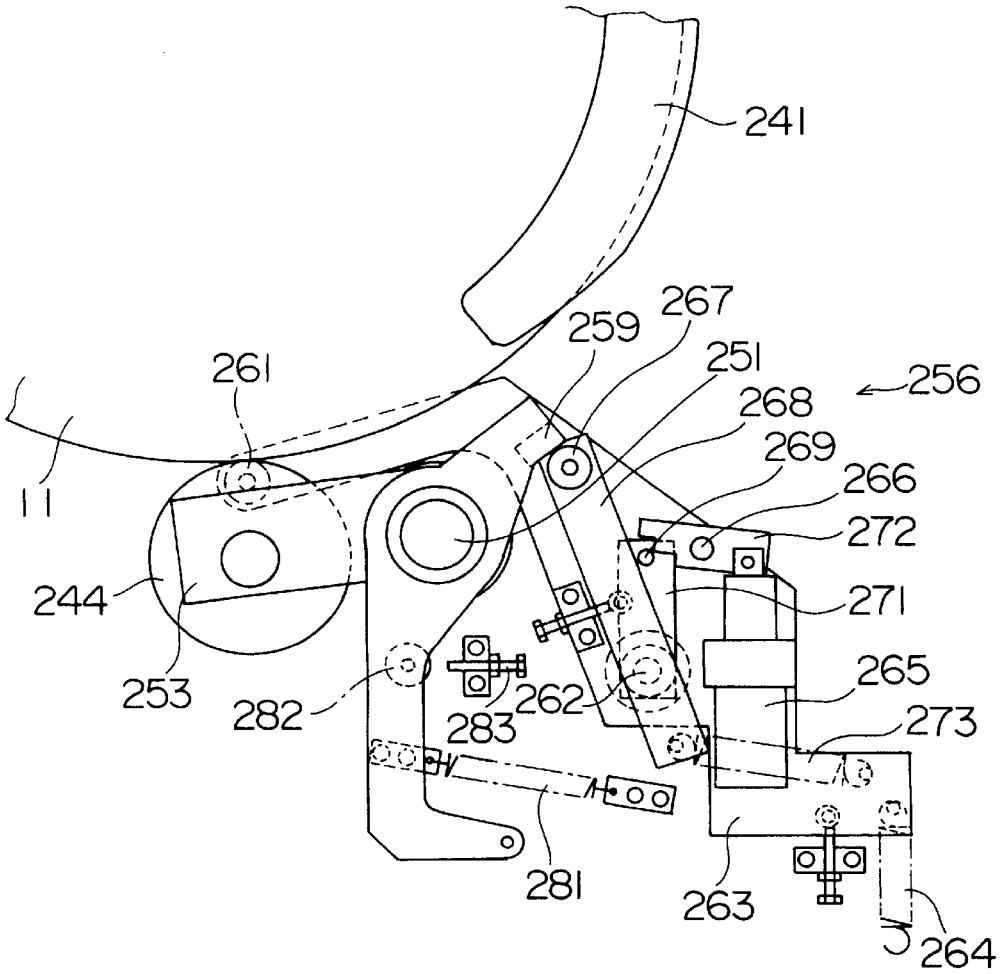
FIG. 19 is a further schematic view of the water applying roller moving mechanism.

The construction of the water applying roller moving mechanism 256 will be described first. FIGS. 17 through 19 are schematic views showing the water applying roller moving mechanism 256 as extracted from the dampening water feeder 21*a* shown in FIG. 14.

The water applying roller moving mechanism 256 moves the water applying roller 244 through the first arms 253. This mechanism 256 includes levers 263 pivotable about a shaft 262 and each having a cam follower 261 attached to a distal end thereof for contacting one of the cams 241 attached to the first plate cylinder 11. Each lever 263 is biased by a spring 264 in a direction (clockwise) for placing the cam follower 261 in contact with the cam 241. Each lever 263 has a solenoid 265 and an axis 266 attached thereto. The first arms 253 are biased, by the contact pressure adjusting mechanism 257 described hereinafter, in a direction (clockwise) for placing the water applying roller 244 in contact with the surface of plate P mounted peripherally of the first plate cylinder 11.

Levers 268 and 271 are fixed to the shaft 262 acting as the center of pivotal movement of the levers 263. The lever 268 has a contact piece 267 formed at a distal end thereof for contacting a contact member 259 on one of the first arms 253. The lever 271 has a contact pin 269 attached to a distal end thereof. The lever 268 is biased counterclockwise by a spring 273. The shaft 262 extends from a front position seen in FIGS. 14 and 17 to a rear position seen in FIG. 15. Also in the rear side shown in FIG. 15, a lever 268 is fixed to the shaft 262, which lever 268 has a contact piece 267 for contacting a contact member 259 on one of the first arms 253. Further, a lever 272 is attached to the axis 266 on the lever 263. This lever 272 has one end thereof coupled to the solenoid 265, and the other end contactable with the contact pin 269.

Figure 20:
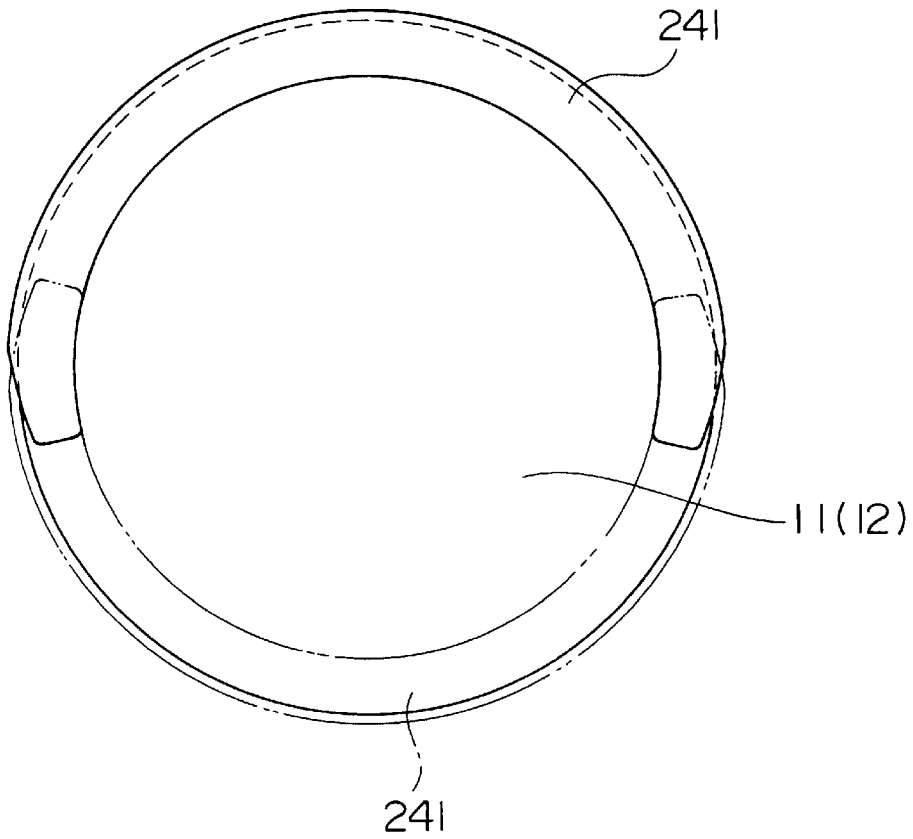
FIG. 20 is a side view showing cams attached to the first plate cylinder.

FIG. 20 is a side view showing the cams 241 attached to the first plate cylinder 11. The cam 241 shown in a solid line in FIG. 20 is attached to a front surface of the first plate cylinder 11, in an angular position corresponding to the image area 67*b* to be printed with the magenta ink, which is opposite to an angular position corresponding to the image area 67*a* to be printed with the black ink shown in FIG. 10A. The cam 241 shown in the solid line rotates with the first plate cylinder 11 to contact the cam follower 261 of the water applying roller moving mechanism 256 in the dampening water feeder 21*a*. As a result, the lever 263 is swung about the shaft 262.

The cam 241 shown in a phantom line in FIG. 20 is used when moving a water applying roller 244 of the dampening water feeder 21*b*. This cam 241 is attached to the first plate cylinder 11, in an angular position corresponding to the image area 67*a* to be printed with the black ink, which is opposite to the angular position corresponding to the image area 67*b* to be printed with the magent ink shown in FIG. 10A. The second plate cylinder 12 also has a pair of cams 241 similar to the above.

The water applying roller moving mechanism 256 is operable as follows for moving the water applying roller 244 of the dampening water feeder 21*a*.

FIG. 17 shows the water applying roller 244 opposed to the image area 67*a* to be printed with the black ink, and the first plate cylinder 11 in an angular position in which the cam 241 attached to the first plate cylinder 11 is out of contact with the cam follower 261 disposed at the distal end of one of the levers 263. In this state, the first arms 253 have pivoted, under the biasing force of the contact pressure adjusting mechanism 257 described hereinafter, to place the water applying roller 244 in a damping water feeding position in contact with the surface of plate P mounted peripherally of the first plate cylinder 11. Thus, the water applying roller 244 is in contact with the image area 67*a* to be printed with the black ink shown in FIG. 10A.

As the first plate cylinder 11 rotates in this state, the water applying roller 244 is rotated by the drive imparted from the first plate cylinder 11. The fountain roller 243 and intermediate roller 245 are rotated by the driving device not shown. The dampening water stored in the water vessel 242 is transferred from the fountain roller 243 to the applying roller 244 through the intermediate roller 245. Consequently, the water is fed to the entire surface of the image area 67*a* on the plate P mounted on the first plate cylinder 11.

In FIG. 18, the first plate cylinder 11 has rotated to an angular position where the water applying roller 244 is opposed to the image area 67*b* to be printed with the magenta ink, and the cam 241 attached to the first plate cylinder 11 is opposed to the cam follower 261 disposed at the distal end of one of the levers 263. The cam follower 261 now mounts the cam 241, causing the lever 263 to pivot counterclockwise about the shaft 262. With the counterclockwise pivoting of the lever 263, the solenoid 265 and lever 272 disposed on the lever 263 move to press the contact pin 269 disposed at the distal end of the lever 271. The pressing force applied to the contact pin 269 turns the lever 271 with the shaft 262. As a result, the lever 268 pivots counterclockwise about the shaft 262.

With the pivotal movement of the lever 268, the contact piece 267 disposed at the distal end of the lever 268 presses the contact member 259 disposed on the first arms 253. Then, each first arm 253 pivots counterclockwise against the biasing force of the contact pressure adjusting mechanism 257 described hereinafter. Consequently, as shown in FIG. 18, the water applying roller 244 moves to the retracted position spaced from the surface of plate P mounted peripherally of the first plate cylinder 11. Thus, the water applying roller 244 of the dampening water feeder 21*a* does not contact the image area 67*b* to be printed with the magenta ink shown in FIG. 10A.

An amount of movement of the water applying roller 244 to the retracted position spaced from the surface of plate P mounted peripherally of the first plate cylinder 11 is smaller than a sum of an addendum of the gear 247 attached to the water applying roller 244 shown in FIG. 15 and an addendum of the gear 51 attached to the first plate cylinder 11. Thus, even when the water applying roller 244 has moved to the retracted position, as shown in FIG. 18, the gear 247 attached to the applying roller 244 remains meshed with the gear 51 attached to the first plate cylinder 11. The applying roller 244, even after moving to the retracted position, continues to be rotated by the drive from the first plate cylinder 11.

The dampening water feeder 21*b* includes a water applying roller moving mechanism 256 similar to the above. However, each cam follower 261 of the water applying roller moving mechanism 256 in the dampening water feeder 21*b* is contactable with the cam 241 shown in the phantom line in FIG. 20. As a result, the water applying roller 244 of the dampening water feeder 21*b* contacts the image area 67*b* to be printed with the magenta ink shown in FIG. 10A.

Figure 21:
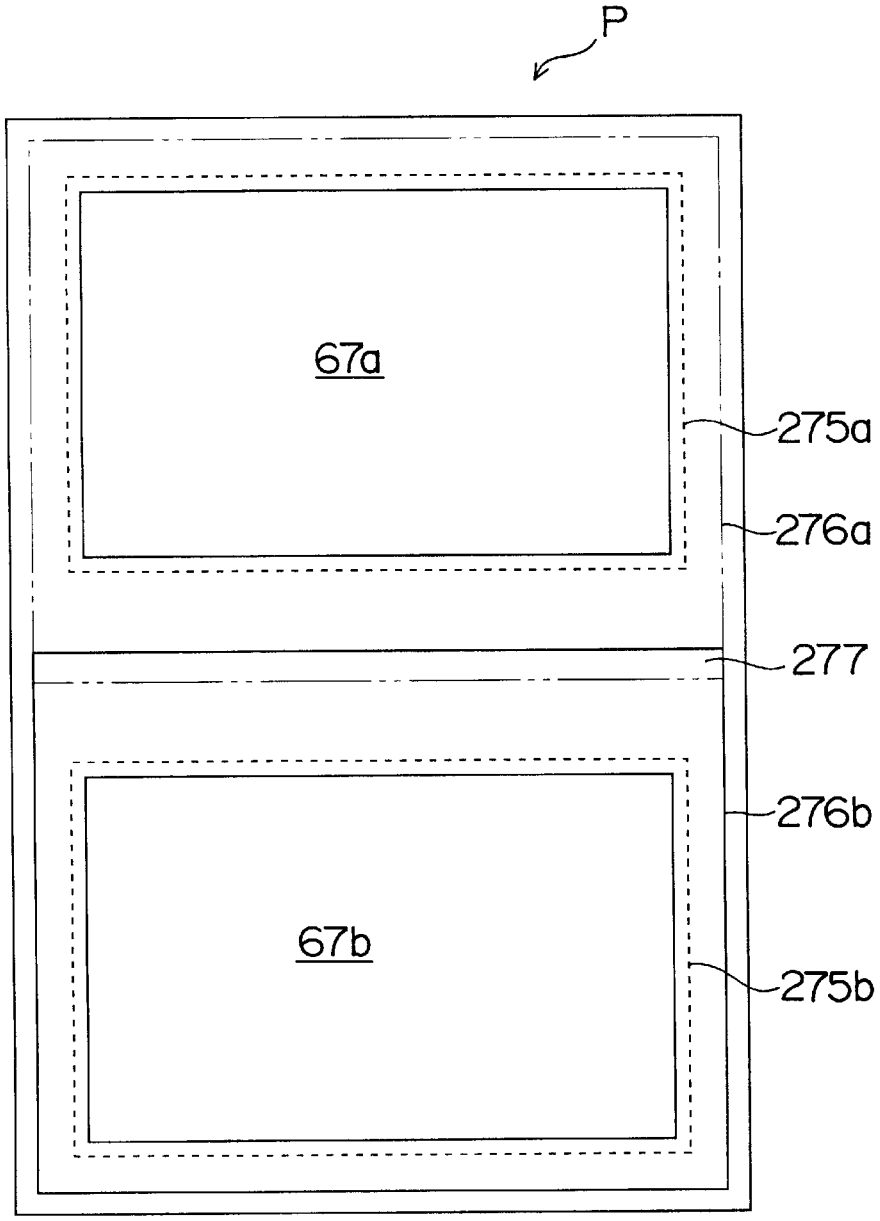
FIG. 21 is an explanatory view showing a relationship among image areas, ink feed areas and water feed areas.

FIG. 21 is an explanatory view showing a relationship among the image areas 67*a* and 67*b*, ink feed areas 275*a* and 275*b*. and dampening water feed areas 276*a* and 276*b* on the plate P. As noted above, the image area 67*a* is to be printed with the black ink, and the image area 67*b* with the magenta ink. In this figure, the ink feed area 275*a* shown in a broken line is where the black ink is fed by the ink feeder 20*a*. The ink feed area 275*b* also shown in a broken line is where the magenta ink is fed by the ink feeder 20*b*. The dampening water feed area 276*a* shown in a solid line is where dampening water is fed by the dampening water feeder 21*a*. The dampening water feed area 276*b* shown in a two-dot chain line is where dampening water is fed by the dampening water feeder 21*b*.

As seen, each ink feed area 275*a* or 275*b* is slightly larger than each image area 67*a* or 67*b*. On the other hand, the water feed area 276*a* shown in the solid line for the image area 67*a*, and the water feed area 276*b* shown in the two-dot chain line for the image area 67*b* are still larger than the corresponding ink feed areas 275*a* and 275*b*, and overlap each other in an area 277.

Consequently, the dampening water is reliably fed to all areas of the plate P including the image area 67*a* to be fed with the black ink, the image area 67*b* to be fed with the magenta ink, and the area between the two image areas. Even in the event of ink trailing occurring when the ink is fed to the plate P by the ink feeder 20*a* or 20*b*, no ink smudge is left in the area between the image areas 67*a* and 67*b*.

The above dampening water feed areas 276*a* and 276*b* may be set to desired positions, and the overlap area 277 may be formed as desired, by appropriately selecting or adjusting the shape of the cams 241 and positions of the dampening water feeders 21*a* and 21*b*.

In the water applying roller moving mechanism 257, as shown in FIG. 19, the lever 272 is pivotable clockwise about the axis 266 by the action of solenoid 265 disposed on the lever 263. With this pivotal movement, the lever 272 becomes disengaged from the contact pin 269 disposed at the distal end of lever 271. Then the cam follower 261 disposed at the distal end of each lever 263 mounts the cam 241 attached to the first plate cylinder 11. As a result, even when the lever 263 pivots counterclockwise about the shaft 262, the contact pin 269 is not pressed as in the case shown in FIG. 18. Since the first arms 253 do not pivot either, the water applying roller 244 stops in the feeding position in contact with the surface of plate P on the first plate cylinder 11, regardless of a rotating position of the first plate cylinder 11.

Consequently, in time of monochromatic printing as described hereinafter, for example, in which the water feeder 21*a* feeds dampening water to both the image areas 67*a* and 67*b* on the plate P, as shown in FIG. 19, the water applying roller 244 is stopped in the feeding position by the action of solenoid 265. Thus, the water feeder 21*a* can feed the dampening water to both the image areas 67*a* and 67*b* on the plate P.

Figure 22:
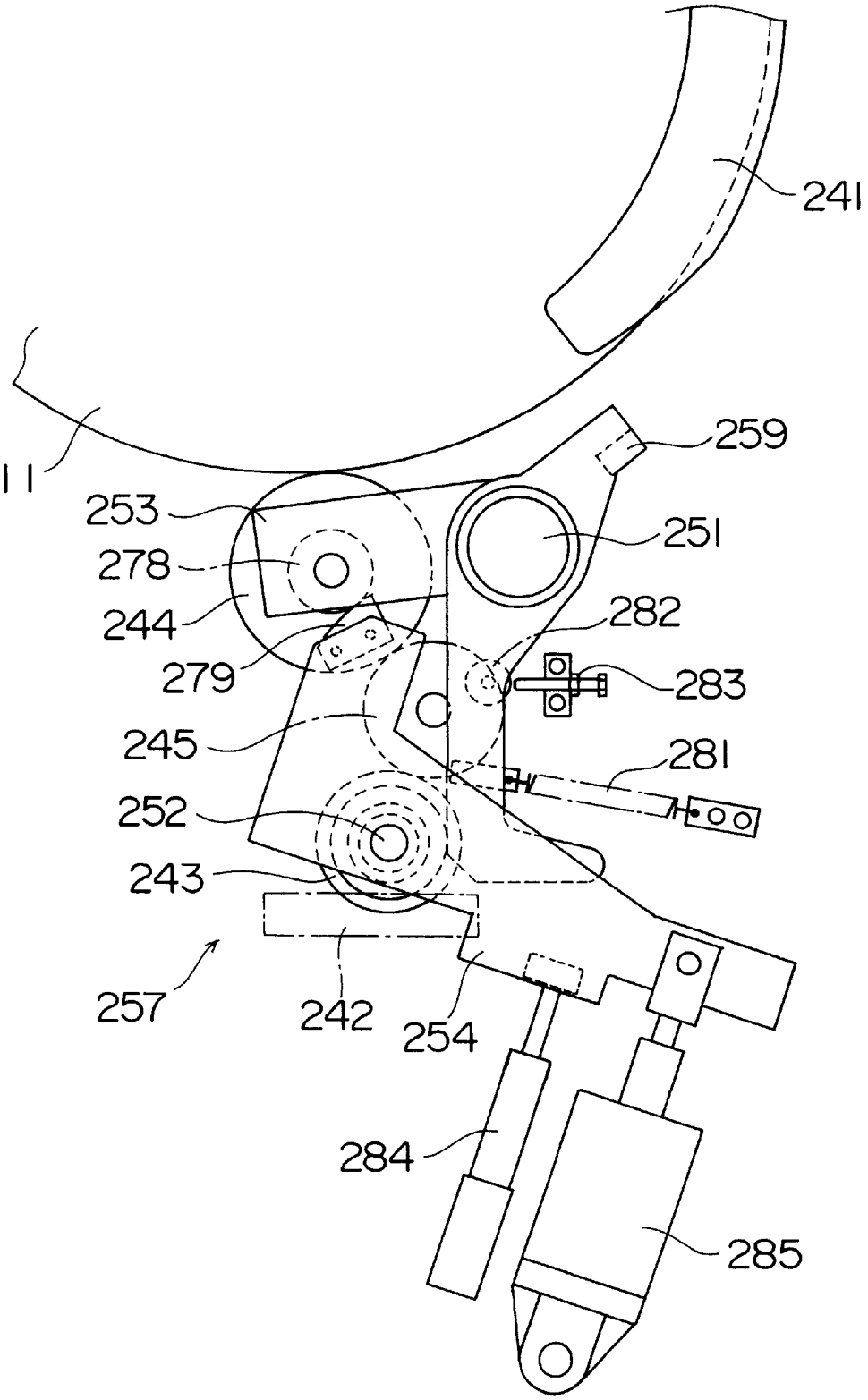
FIG. 22 is a schematic view of a contact pressure adjusting mechanism.
Figure 23:
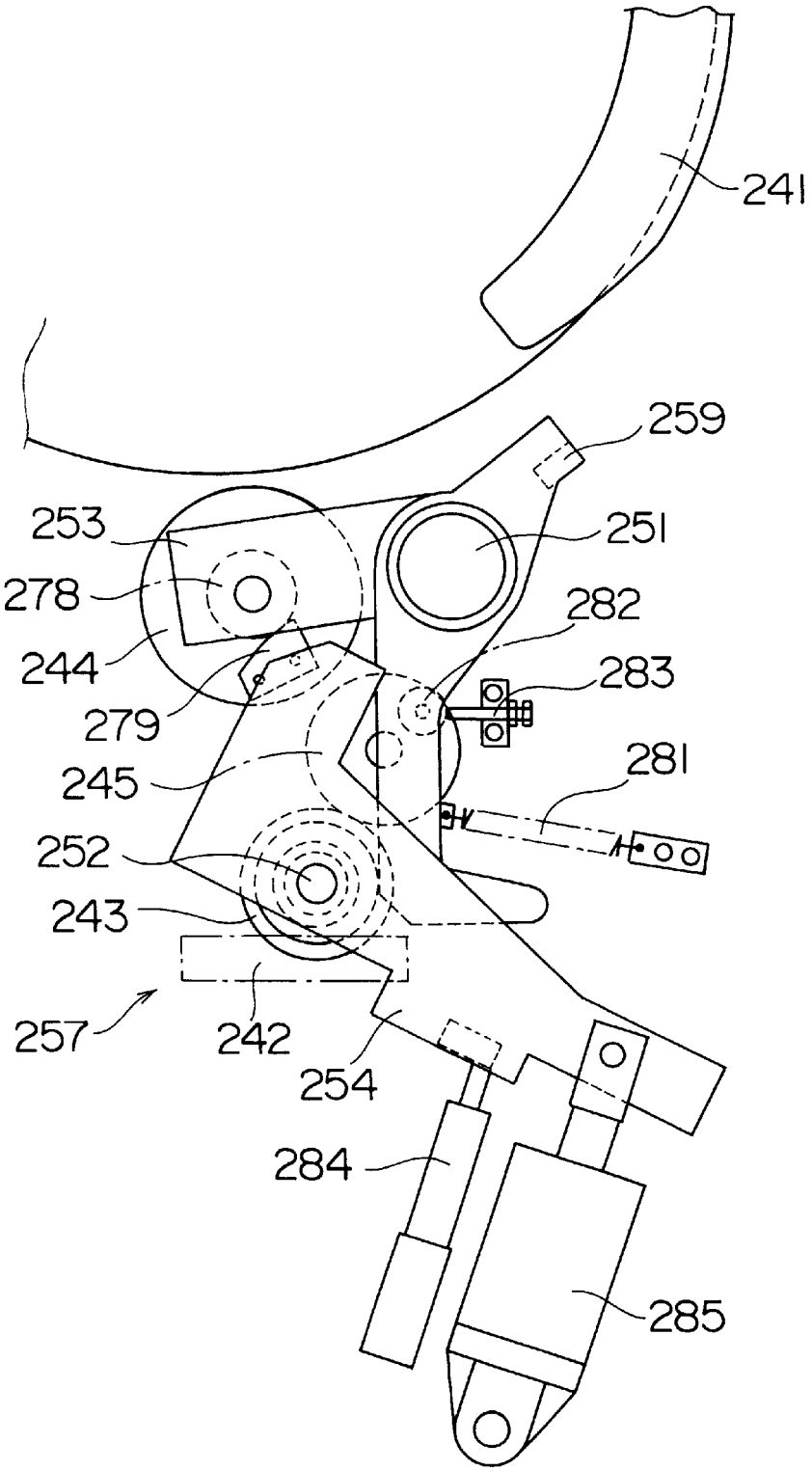
FIG. 23 is another schematic view of the contact pressure adjusting mechanism.

The construction of the contact pressure adjusting mechanism 257 will be described next. FIGS. 22 and 23 are schematic views showing the contact pressure adjusting mechanism 257 as extracted from the dampening water feeder 21*a* shown in FIG. 14.

The contact pressure adjusting mechanism 257 maintains a fixed contact pressure between the water applying roller 244 and intermediate roller 245 when the water applying roller 244 is moved by the water applying roller moving mechanism 256, This adjusting mechanism 257 includes first contact elements 278 and second contact elements 279 for maintaining a fixed distance between the axes of the water applying roller 244 and intermediate roller 245.

The first contact elements 278 are disposed on the first arms 253. The first contact elements 278 have a circular shape concentric with the water applying roller 244. The first arms 253 are biased by springs 281 counterclockwise about the shaft 251. The first arms 253 further include contact elements 282 attached thereto for contacting stoppers 283 to determine an amount of counterclockwise pivotal movement thereof.

The second contact elements 279 are disposed at distal ends of the second arms 254. Each second contact element 279 defines an arcuate surface concentric with the intermediate roller 245. The second arms 254 are biased by presser spring units 284 counterclockwise about the shaft 252. The presser spring units 284 apply a biasing force to the second arms 254 greater than the biasing force applied by the springs 281 to the first arms 253. Each second arm 254 is coupled to an air cylinder 285.

In this contact pressure adjusting mechanism 257, the biasing force of presser spring units 284 applied to the second arms 254 is greater than the biasing force of springs 281 applied to the first arms 253. Consequently, as noted hereinbefore, the first arms 253 are biased by the contact pressure adjusting mechanism 257 in the direction (clockwise) to place the water applying roller 244 in contact with the surface of plate P mounted peripherally of the first plate cylinder 11. Thus, when the cam followers 261 disposed at the distal ends of levers 263 are out of contact with the cams 241 attached to the first plate cylinder 11, as shown in FIG. 17, the water applying roller 244 moves to the water feeding position in contact with the surface of plate P mounted on the first plate cylinder 11.

When the cam followers 261 disposed at the distal ends of levers 263 mount the cams 241 attached to the first plate cylinder 11, as shown in FIG. 18, the water applying roller 244 moves to the retracted position spaced from the surface of plate P mounted peripherally of the first plate cylinder 11. With the movement of the water applying roller 244, the first contact elements 278 move in a direction to press the second contact elements 279. The first contact elements 278 have a circular shape concentric with the water applying roller 244, and the second contact elements 279 have arcuate surfaces concentric with the intermediate roller 245. Thus, even after the movement of the water applying roller 244, the distance between the axes of water applying roller 244 and intermediate roller 245 remains invariable to maintain the fixed pressure between the water applying roller 244 and intermediate roller 245.

The fountain roller 243 for dipping in and picking up the dampening water in the water vessel 242 is coupled to the intermediate roller 245 through the pair of right and left support plates 255. Thus, the pressure of contact therebetween is fixed. The pressure of contact between the water applying roller 244 and intermediate roller 245 is maintained fixed by the contact pressure adjusting mechanism 257 as described above. Thus, the dampening water in the water vessel 242 may be fed to the plate P accurately.

In the contact pressure adjusting mechanism 257, the air cylinder 285 is operable to draw the second arms 254 against the biasing force of the presser spring units 284. When the second arms 254 start pivoting clockwise in this way, the first contact elements 278 move along the arcuate surfaces of the second contact elements 279. With the movement of the first contact elements 278, the first arms 253 move counterclockwise by the action of springs 281. As shown in FIG. 23, the water applying roller 244 moves to the retracted position spaced from the surface of plate P mounted peripherally of the first plate cylinder 11.

The pivotal movement of the front, first arm 253 shown in FIG. 23 stops when the contact element 282 disposed on the first arm 253 contacts the stopper 283. The rear, first arm 253 shown in FIGS. 15 and 24 has a contact portion 288 formed at an end thereof. The pivotal movement of the rear, first arm 253 stops when the contact portion 288 contacts an extended cylinder rod of an air cylinder 286. In this state, as in the case described above, an amount of movement of the gear 247 determined by a pressing portion 289 of the air cylinder 286 when the water applying roller 244 moves to the retracted position is smaller than the sum of the addendum of the gear 247 attached to the water applying roller 244 and the addendum of the gear 51 attached to the first plate cylinder 11. Thus, the gear 247 attached to the applying roller 244 remains meshed with the gear 51 attached to the first plate cylinder 11.

When the air cylinders 285 draw the second arms 254 further to cause a further clockwise pivotal movement, the intermediate roller 245 moves further with the second arms 254. At this time, the water applying roller 244 stands still with the first arms 253 by the action of the stopper 283. Thus, as shown in FIG. 23, the water applying roller 244 and intermediate roller 245 move away from each other.

When it is not desired to feed the dampening water to the water applying roller 244 before printing, for example, the air cylinders 285 are operated to pivot the second arms 254 to the position shown in FIG. 23, to prevent the dampening water from being transferred from the intermediate roller 245 to the water applying roller 245. In this way, the feeding of the dampening water to the water applying roller 244 may be stopped. By separating the water applying roller 244 and intermediate roller 245 as above, it is possible to avoid a step-out occurring when starting the driving device, not shown, for driving the intermediate roller 245 and components interlocked thereto.

Figure 24:
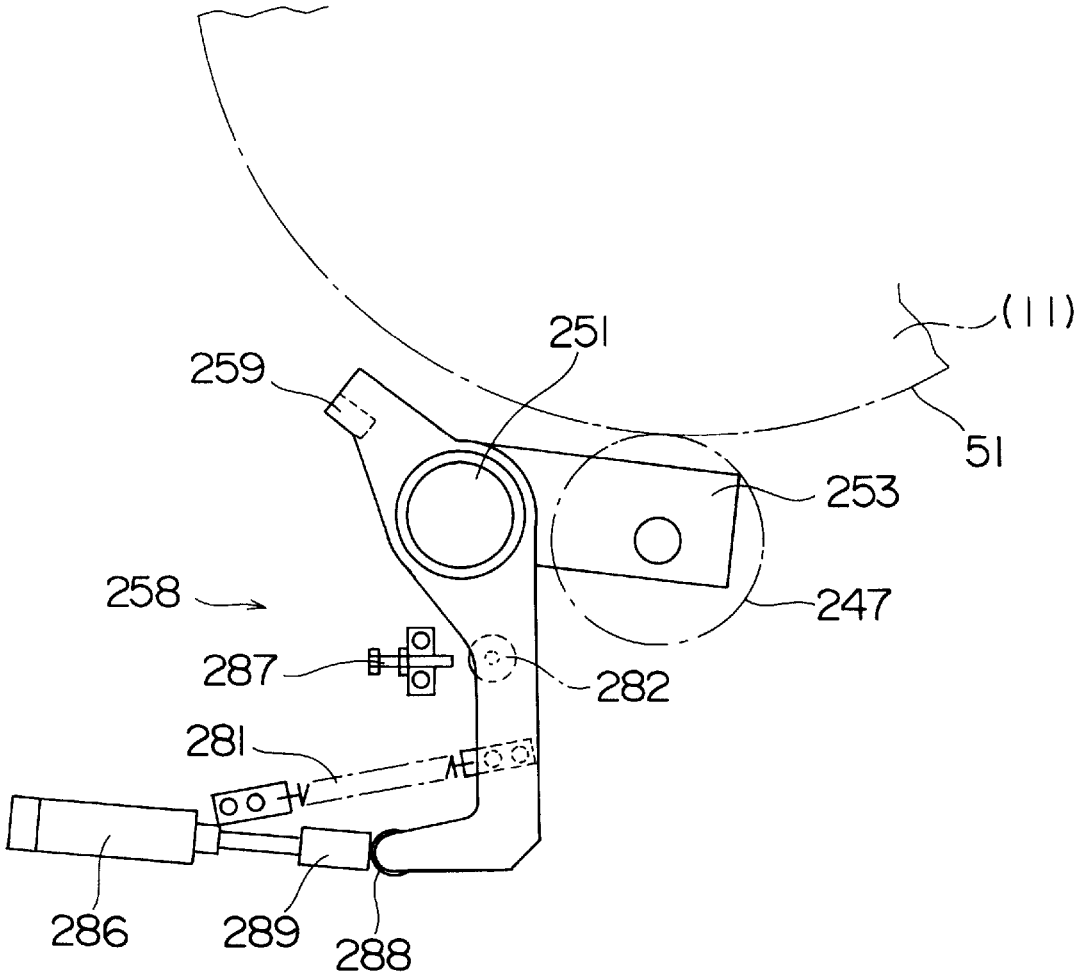
FIG. 24 is a schematic view of a gear retracting mechanism.
Figure 25:
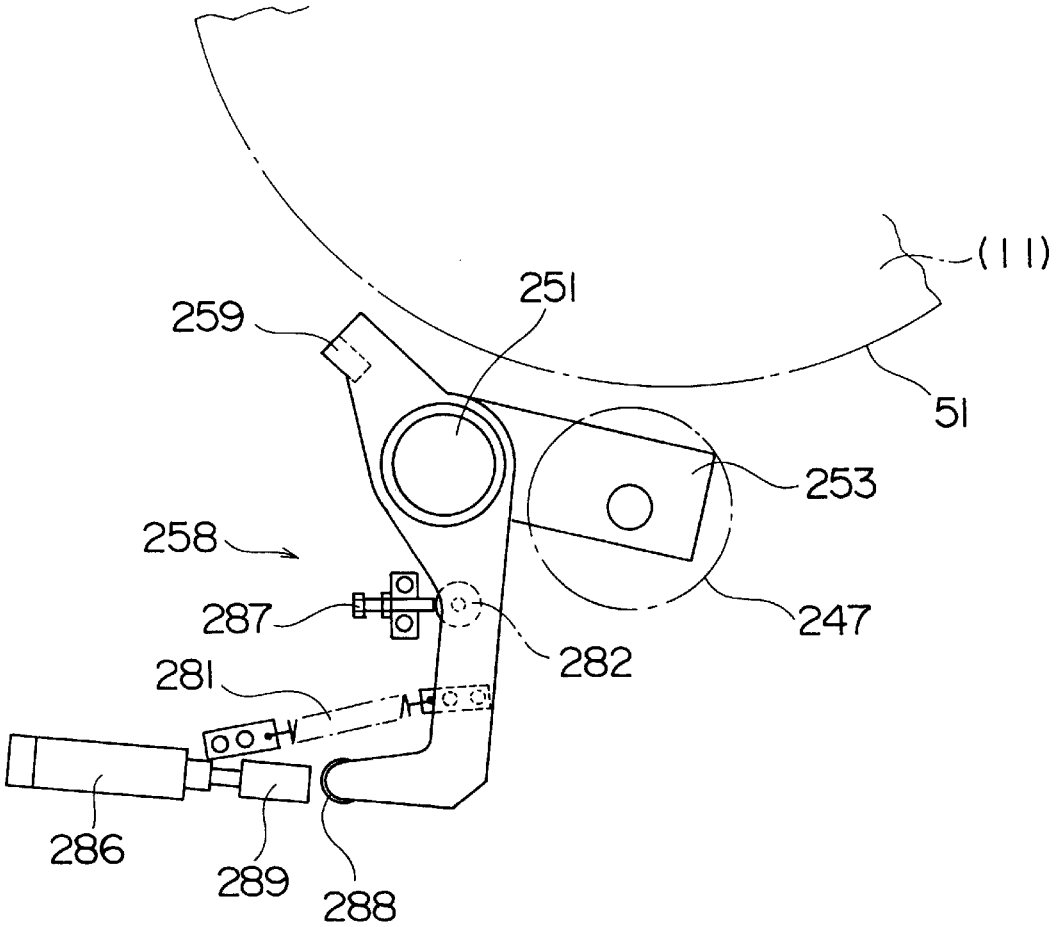
FIG. 25 is another schematic view of the gear retracting mechanism.

The construction of the gear retracting mechanism 258 will be described next. FIGS. 24 and 25 are schematic views showing the gear retracting mechanism 258 as extracted from the dampening water feeder 21*a* shown in FIG. 15.

When the first plate cylinder 11 is moved to the first printing position, the gear retracting mechanism 258 is operable to move the gear 247 attached to the water applying roller 244 from the drive transmitting position to the retracted position. The retracting mechanism 258 includes the air cylinder 286 having the pressing portion 289 for contacting the contact portion 288 of the rear, first arm 253 of the pair of the first arms 253.

This gear retracting mechanism 258 operates as follows in response to the operation of the first plate cylinder moving mechanism 31 to move the first plate cylinder 11.

When, with the first plate cylinder 11 in the first printing position, the water applying roller 244 is moved to the retracted position by the above contact pressure adjusting mechanism 257, as shown in FIG. 24, the gear 247 attached to the water applying roller 244 is meshed with the gear 51 attached to the first plate cylinder 11. Specifically, as described above, the amount of movement of the gear 247 determined by the pressing portion 289 of the air cylinder 286 when the water applying roller 244 moves to the retracted position is smaller than the sum of the addendum of the gear 247 attached to the water applying roller 244 and the addendum of the gear 51 attached to the first plate cylinder 11. Thus, the gear 247 attached to the applying roller 244 remains meshed with the gear 51 attached to the first plate cylinder 11.

When, in this state, the first plate cylinder 11 begins to move from the first printing position to the image recording position, as described with reference to FIGS. 4 through 6, the first plate cylinder 11 is rotated by the action of gear 52 attached to the first blanket cylinder 52. Thus, the gear 51 attached to the first plate cylinder 11 is disengaged from the gear 247 attached to the water applying roller 244, while the two gears 51 and 247 rotate relative to each other.

When the first plate cylinder 11 moves from the image recording position to the first printing position, as shown in FIG. 25, the air cylinder 286 is operated to move the pressing portion 289 away from the contact portion 288 of the first arm 253. As a result, the first arm 253 further pivots clockwise and stops in the position in which the contact element 282 contacts a stopper 287. In this state, the water applying roller 244 has moved away from the first plate cylinder 11 beyond the retracted position. Consequently, as shown in FIG. 25, the gear 247 attached to the water applying roller 244 is kept away from the gear 51 attached to the first plate cylinder 11 when the first plate cylinder 11 reaches the first printing position.

In this state, the first plate cylinder 11 is moved from the image recording position to the first printing position. When the gear 51 attached to the first plate cylinder 11 begins to engage the gear 52 attached to the first blanket cylinder 13 as shown in FIG. 5, the air cylinder 286 is operated to cause the pressing portion 289 to press the contact portion 288 of the rear, first arm 253, thereby to move the gear 247 attached to the water applying roller 244.

At this time, as described with reference to FIGS. 4 through 6, the first plate cylinder 11 moves toward the first printing position while being rotated by the action of gear 52 attached to the first blanket cylinder 52. The gears 51 and 247 begin to engage each other while rotating relative to each other, and become fully engaged when the first plate cylinder 11 is set to the first printing position. Consequently, the teeth of gears 51 and 247 are protected from damage due to a collision therebetween.

The construction of the ink feeder 20*a* will be described next. As shown in FIGS. 12 and 13, the ink feeder 20*a* is disposed above the dampening water feeder 21*a*.

Figure 26:
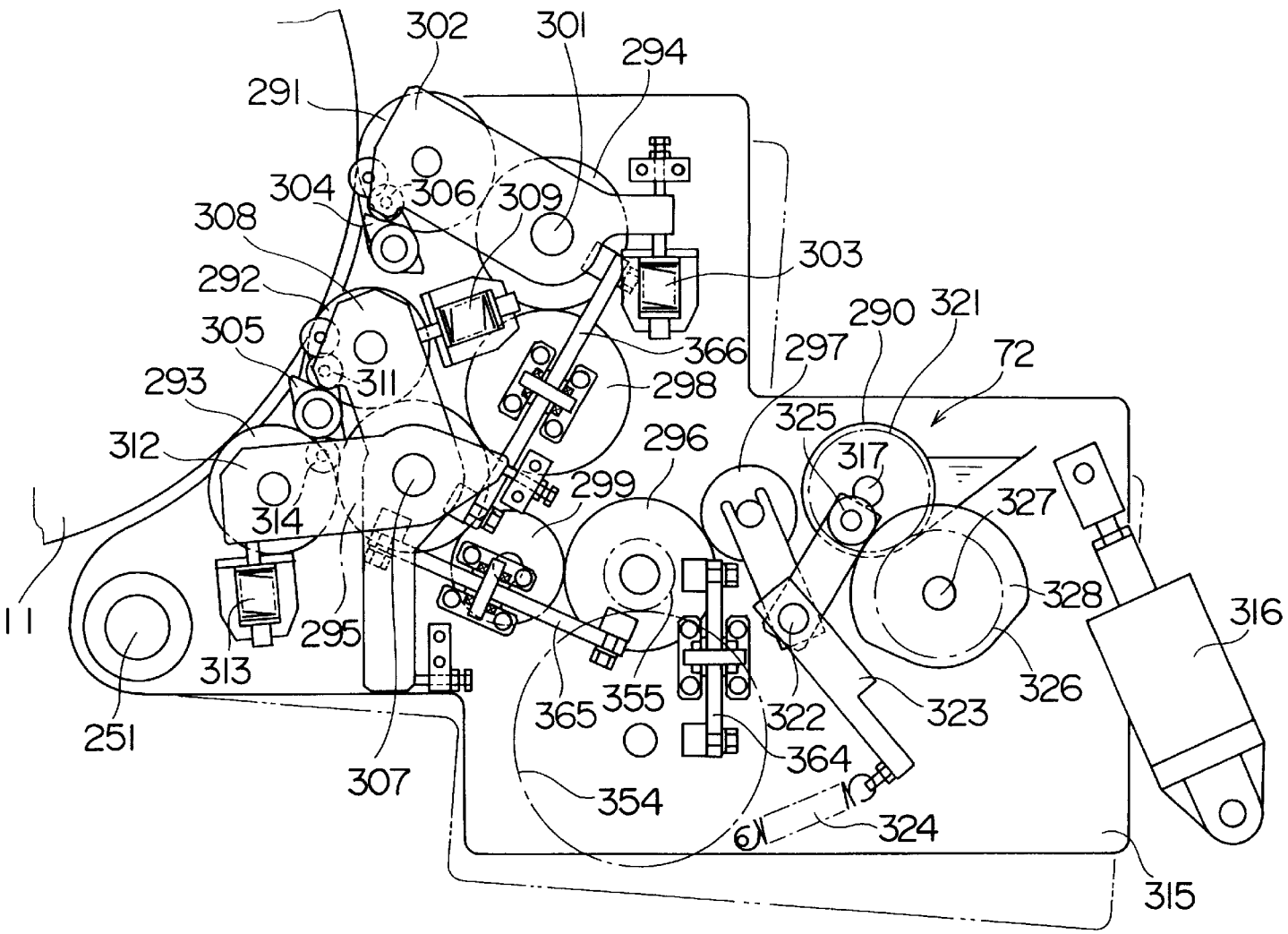
FIG. 26 is a schematic front view of the ink feeder.
Figure 27:
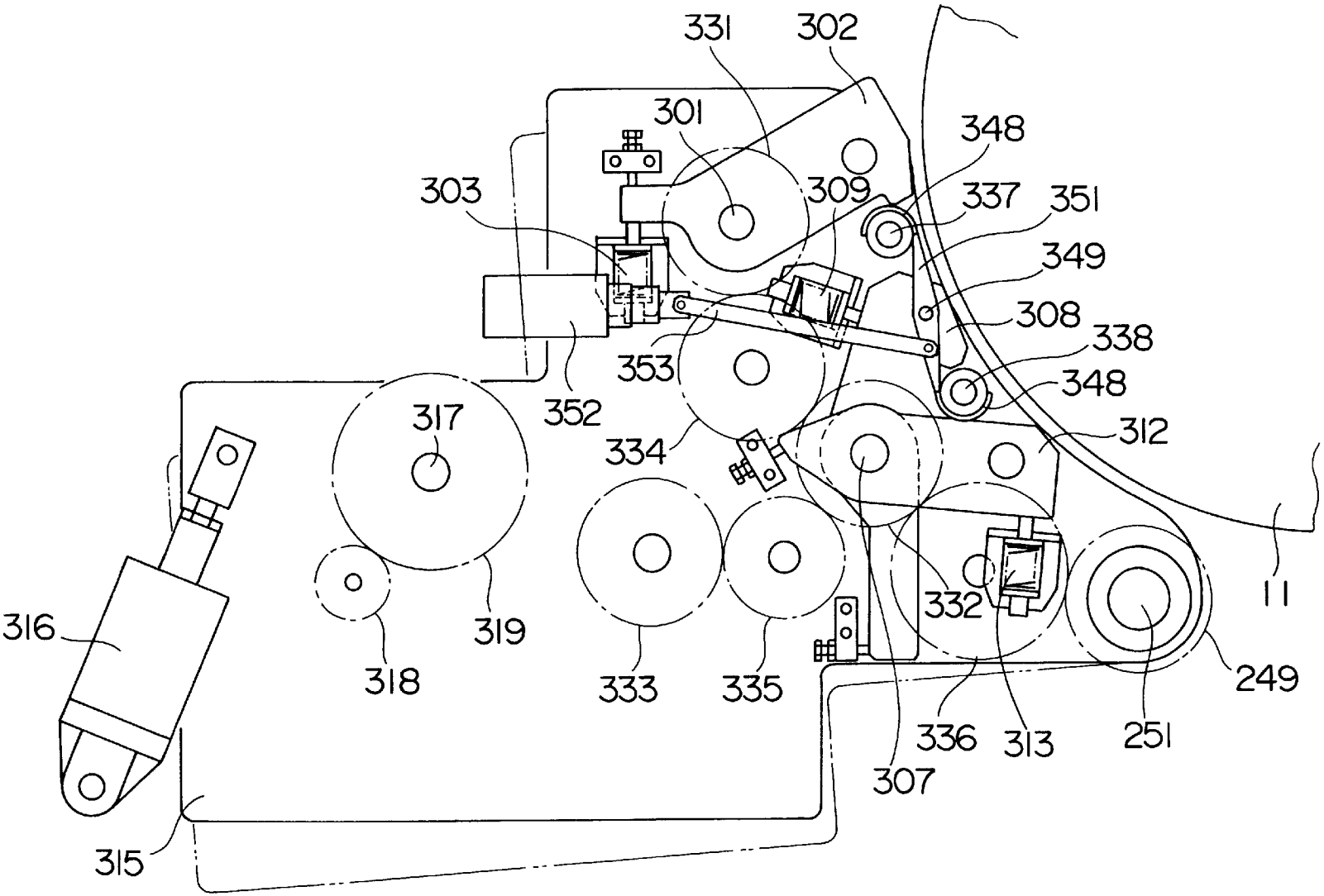
FIG. 27 is a schematic rear view of the ink feeder.

FIG. 26 is an enlarged view of a principal portion of FIG. 12, and schematically shows the ink feeder 20*a* as seen from the front. FIG. 27 is an enlarged view of the principal portion, and schematically shows the ink feeder 20*a* as seen from the rear. The ink rollers 71 are omitted from FIG. 27.

The ink feeder 20*a* includes an ink fountain roller 290 acting as part of the inkwell 72, three ink applying rollers 291, 292 and 293 for contacting the plate P mounted on the first plate cylinder 11 to apply ink to the plate P, three ink kneading rollers 294, 295 and 296 axially oscillatable back and forth to knead the ink, an ink draw roller 297 for transferring the ink from the ink fountain roller 290 to the ink kneading roller 296, and two ink transfer rollers 298 and 299. In this specification and FIG. 1, these rollers 290–299 are referred to collectively as "ink rollers 71".

The ink feeder 20*a* including the ink rollers 71 and inkwell 72 is supported directly or indirectly by a pair of right and left side plates 315. The side plates 315 are pivotable by a pair of right and left air cylinders 316 about the shaft 251 between a position shown in solid lines and a position shown in two-dot chain lines in FIGS. 26 and 27. Thus, the entire ink feeder 20*a* is pivotable by the right and left air cylinders 316.

Among the ink rollers 71, the ink applying roller 291 is supported by a pair of right and left arms 302 pivotable about an axis 301. The arms 302 are biased by a pair of right and left springs 303 in a direction (counterclockwise in FIG. 26) to move the ink applying roller 291 into contact with the first plate cylinder 11. The arms 302 have a pair of right and left contact elements 306 attached thereto for contacting release cams 304 of an arm swing mechanism described hereinafter.

The ink applying roller 292 is supported by a pair of right and left arms 308 pivotable about an axis 307. The arms 308 are biased by a pair of right and left springs 309 in a direction (counterclockwise in FIG. 26) to move the ink applying roller 292 into contact with the first plate cylinder 11. The arms 308 have a pair of right and left contact elements 311 attached thereto for contacting release cams 305 of the arm swing mechanism described hereinafter.

Further, the ink applying roller 293 is supported by a pair of right and left arms 312 pivotable about the axis 307. The arms 312 are biased by a pair of right and left springs 313 in a direction (clockwise in FIG. 26) to move the ink applying roller 293 into contact with the first plate cylinder 11. The arms 312 have a pair of right and left contact elements 314 attached thereto for contacting the release cams 305 of the arm swing mechanism described hereinafter.

As shown in FIG. 27, the ink fountain roller 290 has a gear 319 mounted on an axis 317 at the rear side thereof meshed with a gear 318 connected to a motor. Thus, the ink fountain roller 290 is rotatable by drive of the motor. Further, a gear 321 is mounted on the axis 317 of ink fountain roller 290 at the front side thereof.

The ink draw roller 297 is supported by approximately Y-shaped arms 323 pivotable about an axis 322. Each arm 323 has a cam follower 325 attached thereto. Cams 328 are mounted on an axis 327 of a gear 326 meshed with the gear 321 attached to the ink fountain roller 290 to be rotatable synchronously with the ink fountain roller 290. The arms 323 are biased by springs 324 in a direction (clockwise in FIG. 26) to move the cam followers 325 into contact with the cams 328. Consequently, with rotation of the ink fountain roller 290, the ink draw roller 297 is reciprocable between a position for contacting the ink fountain roller 290 and a position for contacting the ink kneading roller 296.

As shown in FIG. 27, gears 331, 332 and 333 are arranged at the rear sides of the ink kneading rollers 294, 295 and 296, respectively. The gears 331, 332 and 333 are connected through drive transmitting gears 334, 335 and 336 to the gear 249 coaxial with the shaft 251. As noted hereinbefore, the gear 249 acts as a drive transmitting gear for transmitting drive between the dampening water feeder 21*a* and ink feeder 20*a*. Consequently, the ink kneading rollers 294, 295 and 296 are rotatable by the gears 331—336 and 249 synchronously with the first plate cylinder 11.

In this ink feeder 20*a*, the ink stored in the inkwell 72 is transferred by the ink draw roller 297 from the ink fountain roller 290 to the ink kneading roller 296. After being kneaded by the ink kneading rollers 294, 295 and 296 and ink transfer rollers 298 and 299, the ink is fed through the ink applying rollers 291, 292 and 293 to the plate P mounted on the first plate cylinder 11.

Figure 28:
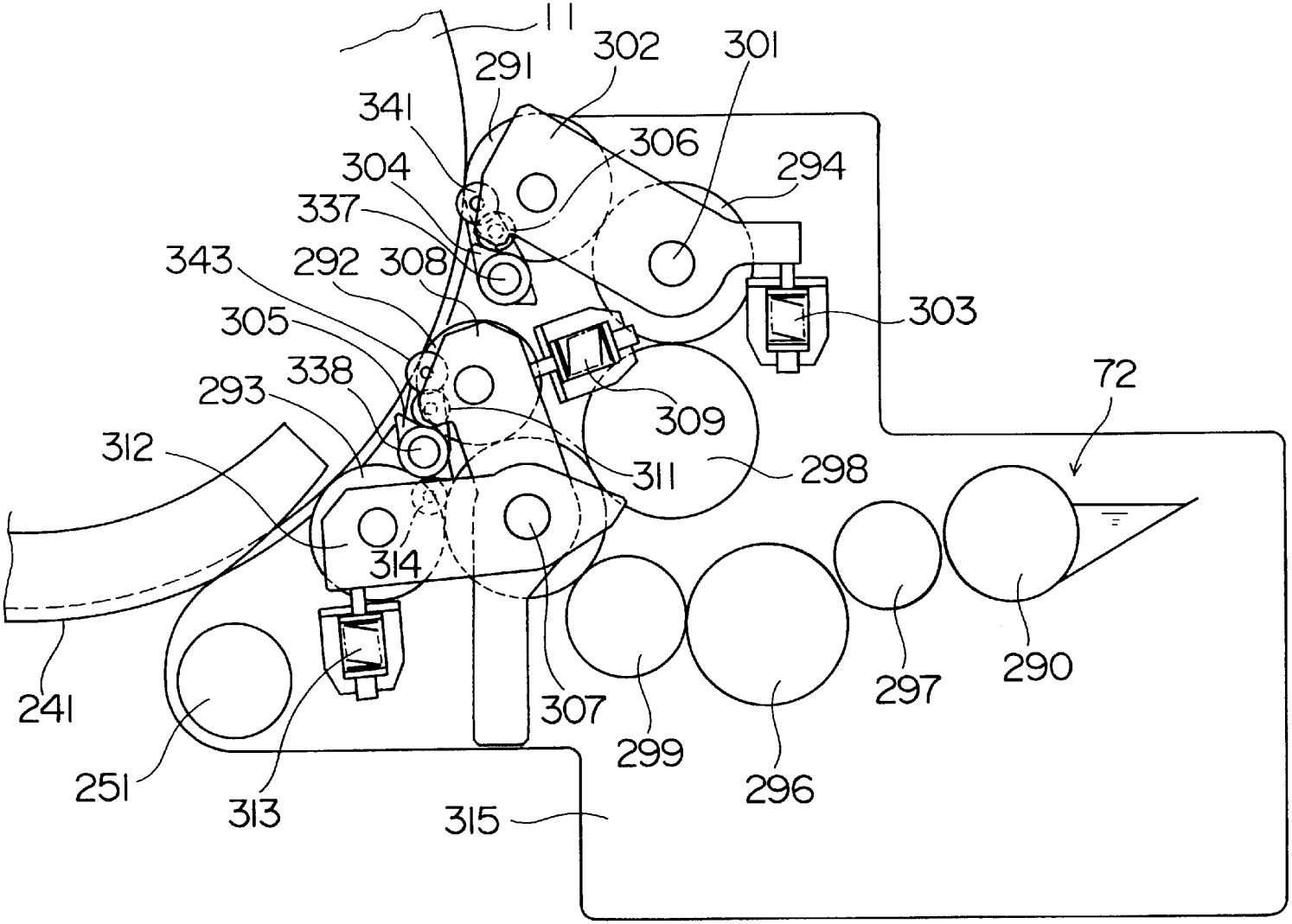
FIG. 28 is an explanatory showing operation of an arm swing mechanism.
Figure 29:
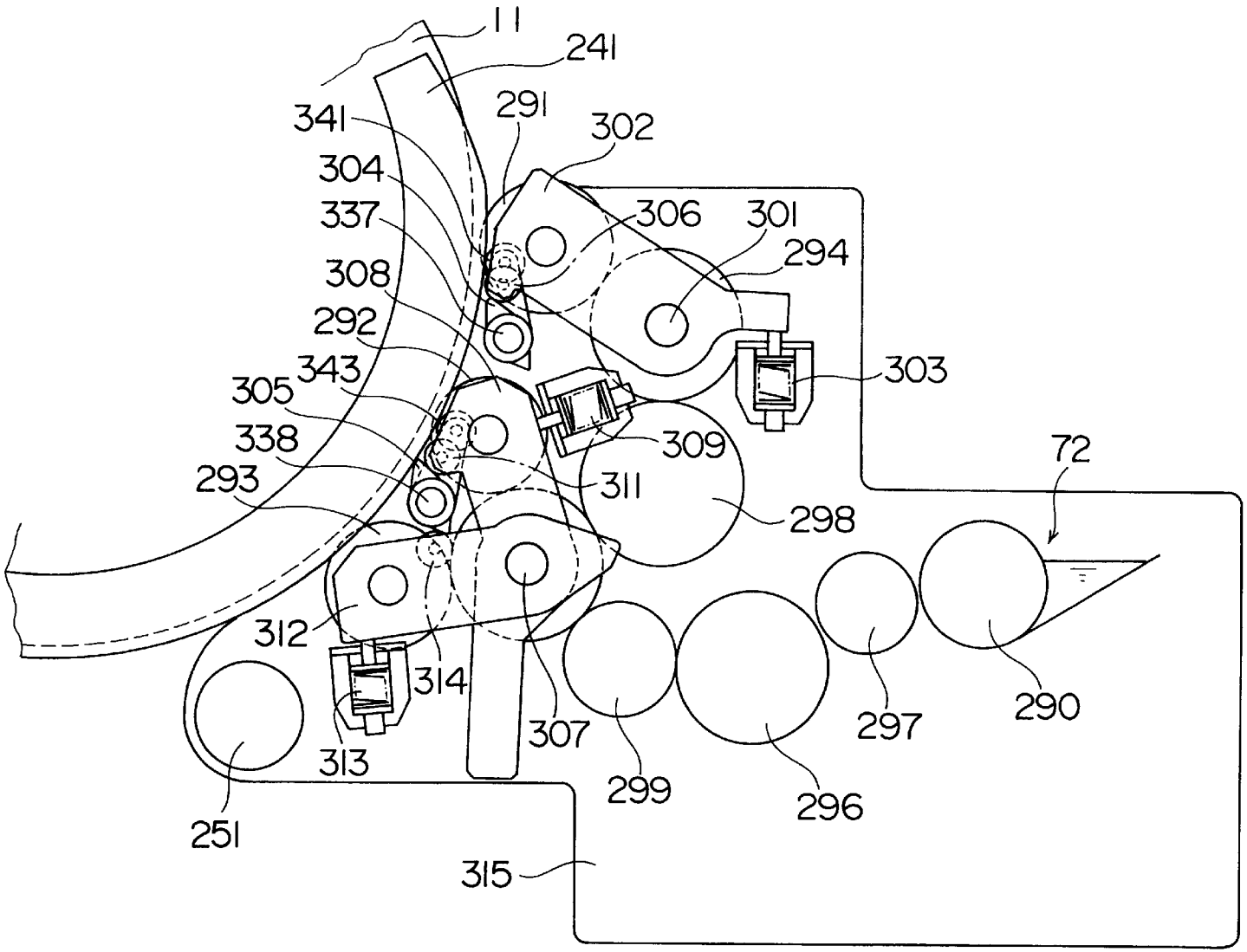
FIG. 29 is another explanatory showing operation of the arm swing mechanism.
Figure 30:
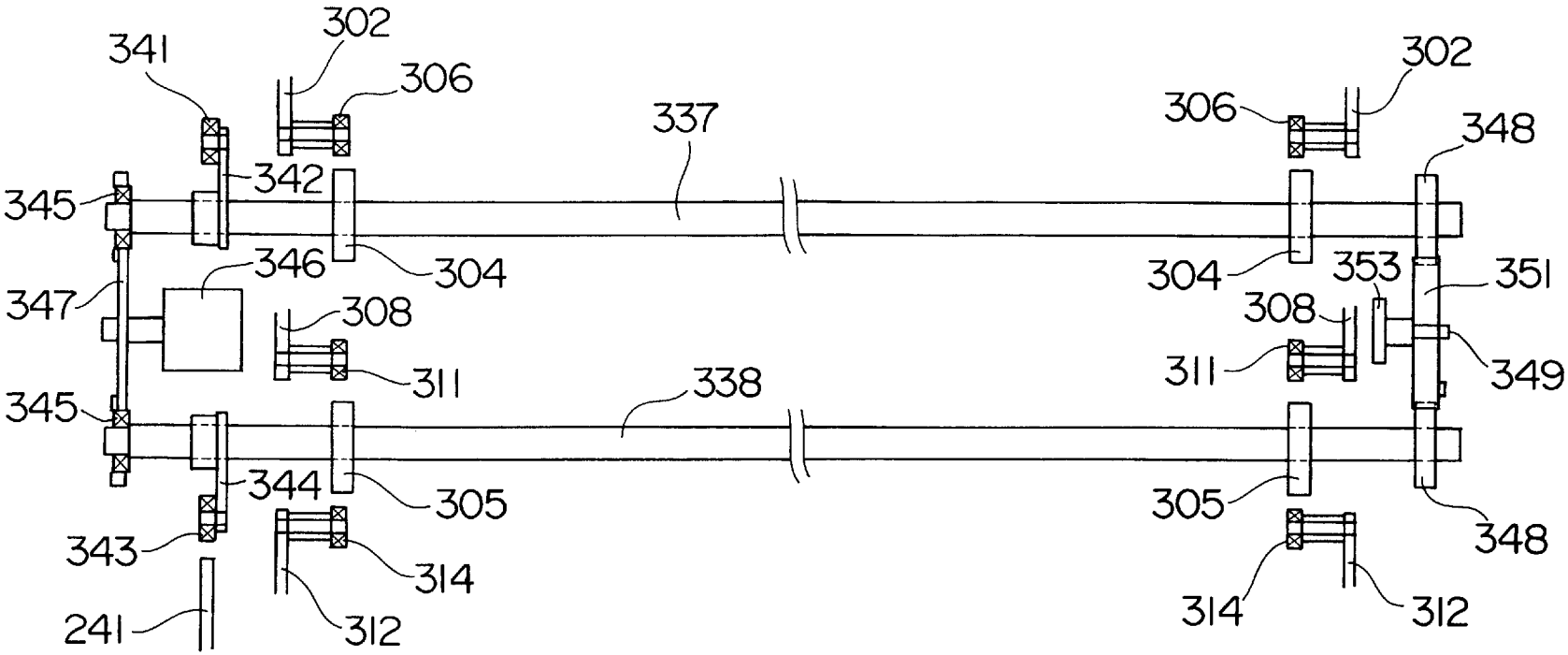
FIG. 30 is a plan view of a principal portion of the arm swing mechanism.
Figure 31:
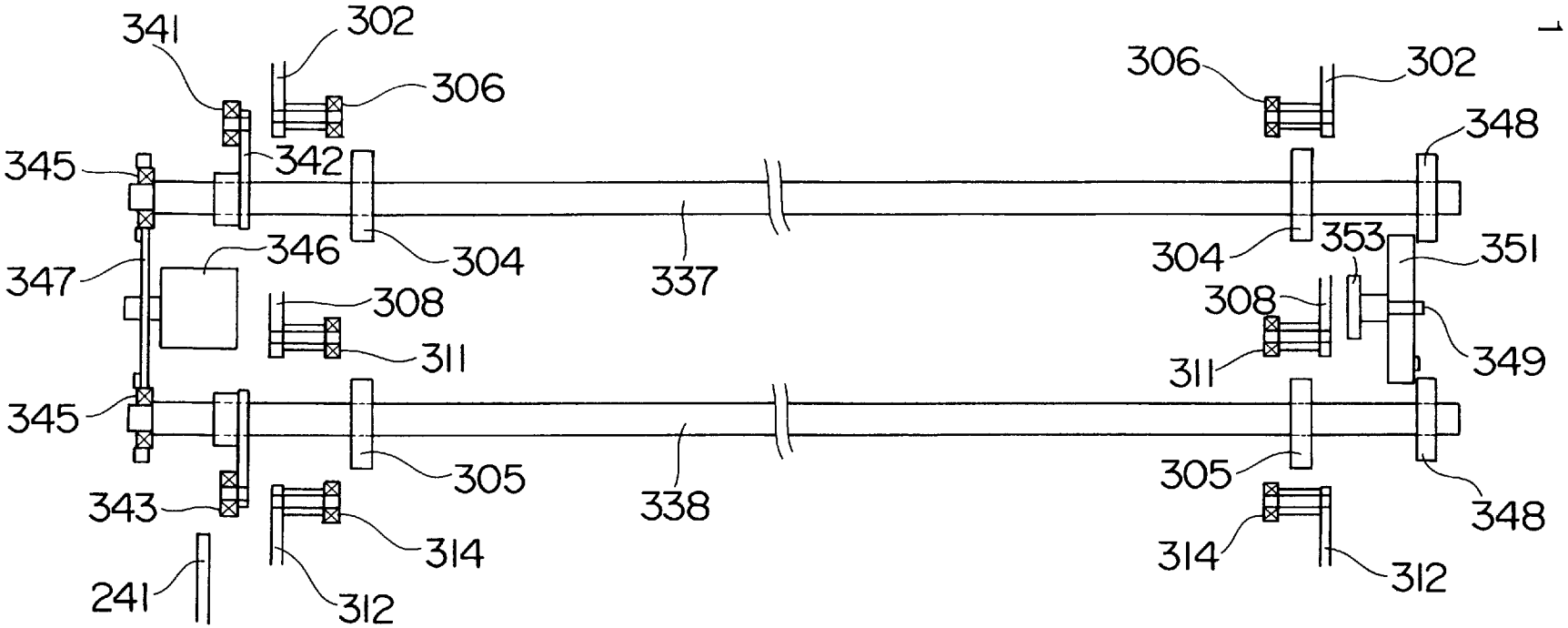
FIG. 31 is another plan view of the principal portion of the arm swing mechanism.

The arm swing mechanism of the ink feeder 20*a* will be described next. FIGS. 28 and 29 are explanatory views showing operation of the arm swing mechanism for swinging the arms 302, 308 and 312. FIGS. 30 and 31 are plan views of a principal portion the arm swing mechanism.

As shown, the release cams 304 for contacting the contact elements 306 noted above are fixed to a shaft 337, while the release cams 305 for contacting the contact elements 311 and 314 are fixed to a shaft 338. These shafts 337 and 338 are rotatably supported by the right and left side plates 315 shown in FIGS. 28 and 29. The shaft 337 has, fixed thereto, arms 342 each having a cam follower 341 attached to a distal end thereof for contacting one of the above-mentioned cams 241. The shaft 338 has, fixed thereto, arms 344 each having a cam follower 343 attached to a distal end thereof for contacting the cam 241. For expediency of illustration, FIGS. 30 and 31 depict the cam 241 laterally of the cam follower 343, which cam 241 should actually be located behind the cam followers 341 and 343.

Each of the shafts 337 and 338 has a bearing 345 disposed at one end thereof. The bearings 345 are interconnected by a coupling 347 connected to an air cylinder 346. Thus, the shafts 337 and 338 are driven by the air cylinder 346 to reciprocate axially and synchronously with each other between a contact position for placing the cam followers 341 and 343 in contact with the cam 241 as shown in FIG. 30, and a retracted position for placing the cam followers 341 and 343 out of contact with the cam 241 as shown in FIG. 31.

The shafts 337 and 338 have a pair of stoppers 348 disposed at the other ends thereof for engaging opposite ends of a lever 351. As shown in FIG. 27, the lever 351 is connected to a solenoid 352 through a coupling 353 to be pivotable by drive of the solenoid 352 about an axis 349.

When the cam followers 341 and 343 are out of contact with the cam 241 attached to the first plate cylinder 11 as shown in FIG. 28, the arms 302, 308 and 312 biased by the springs 303, 309 and 313 are placed in an ink feeding position with the ink applying rollers 291, 292 and 293 contacting the plate P mounted peripherally of the first plate cylinder 11.

When the first plate cylinder 11 rotates from this position to move the cams 241 attached thereto into contact with the cam followers 341, the arms 342 fixed to the shaft 337 swing to rotate the shaft 337. With the rotation of the shaft 337, the release cams 304 fixed to the shaft 337 also rotate about the shaft 337 clockwise in FIG. 28. With the rotation of release cams 304, the contact elements 306 attached to the arms 302 are pressed by the release cams 304. Consequently, the arms 302 move from the ink feeding position with the ink applying roller 291 contacting the surface of plate P to the retracted position with the ink applying roller 291 separated from the surface of plate P as shown in FIG. 29.

As the first plate cylinder 11 rotates further from this state to move the cams 241 attached thereto into contact with the cam followers 343, the arms 348 fixed to the shaft 338 swing to rotate the shaft 338. With the rotation of the shaft 338, the release cams 305 fixed to the shaft 338 also rotate about the shaft 338 clockwise in FIG. 28. With the rotation of release cams 305, the contact elements 311 and 314 attached to the arms 308 and 312 are successively pressed by the release cams 304. Consequently, the arms 308 and 312 move from the ink feeding position with the ink applying rollers 292 and 293 contacting the surface of plate P to the retracted position with the ink applying rollers 292 and 293 separated from the surface of plate P as shown in FIG. 29.

With a further rotation of the first plate cylinder 11, the cams 241 attached to the first plate cylinder 11 move out of contact with the cam followers 341 and 343 successively. Then, in a sequence reversed from the above, the arms 302, 308 and 312 successively move to the ink feeding position with the ink applying rollers 291, 292 and 293 contacting the surface of plate P.

As noted above, these cams 241 are attached to the first plate cylinder 11, in the angular position corresponding to the image area 67*b* to be printed with the magenta ink, which is opposite to the angular position corresponding to the image area 67*a* to be printed with the black ink shown in FIG. 10A. Thus, with the arms 302, 308 and 312 swung by the arm swing mechanism, the ink applying rollers 291, 292 and 293 fall on the surface of plate P adjacent the starting end of the image area 67*a* to be printed with the black ink, and rise from the surface of plate P adjacent the finishing end of the image area 67*a*.

Since the three ink applying rollers 291, 292 and 293 successively contact the surface of plate P to feed the ink thereto, the ink may be fed uniformly and sufficiently over the image area 67*a* on the plate P. It is also possible to avoid a deterioration in printing precision due to vibrations caused by the movement of the rollers and the like.

When this printing apparatus is used in monochromatic printing with only the black ink, as described hereinafter, the above ink feeder 20*a* is required to feed the black ink to both image areas 67*a* and 67*b* shown in FIG. 10A. In this case, the air cylinder 346 is operated beforehand to move the shafts 337 and 338 from the contact position for allowing the cam followers 341 and 343 to contact the cam 241 as shown in FIG. 30 to the retracted position for keeping the cam followers 341 and 343 out of contact with the cam 241 as shown in FIG. 31.

When the shafts 337 and 338 are set to the position shown in FIG. 31, the cam followers 341 and 343 are out of phase with the cam 241 as shown in FIG. 31. Thus, the cam followers 341 and 343 remain out of contact with the cam 241 regardless of rotation of the cam 241 on the first plate cylinder 11. Consequently, the arms 302, 308 and 312 are fixed to the ink feeding position with the ink applying rollers 291, 292 and 293 contacting the surface of plate P. The ink applying rollers 291, 292 and 293 of the ink feeder 20*a* can now feed the black ink to both image areas 67*a* and 67*b*.

Conversely, when this printing apparatus is used in monochromatic printing with only the magenta ink, the ink feeder 20*b* is operated to feed the magenta ink to both image areas 67*a* and 67*b* shown in FIG. 10A. In this case, the ink applying rollers 291, 292 and 293 of the ink feeder 20*a* must be kept away from the surface of plate P regardless of rotation of the cam 241 on the first plate cylinder 11. This is achieved by using the stoppers 348 fixed to the shafts 337 and 338.

Figure 32:
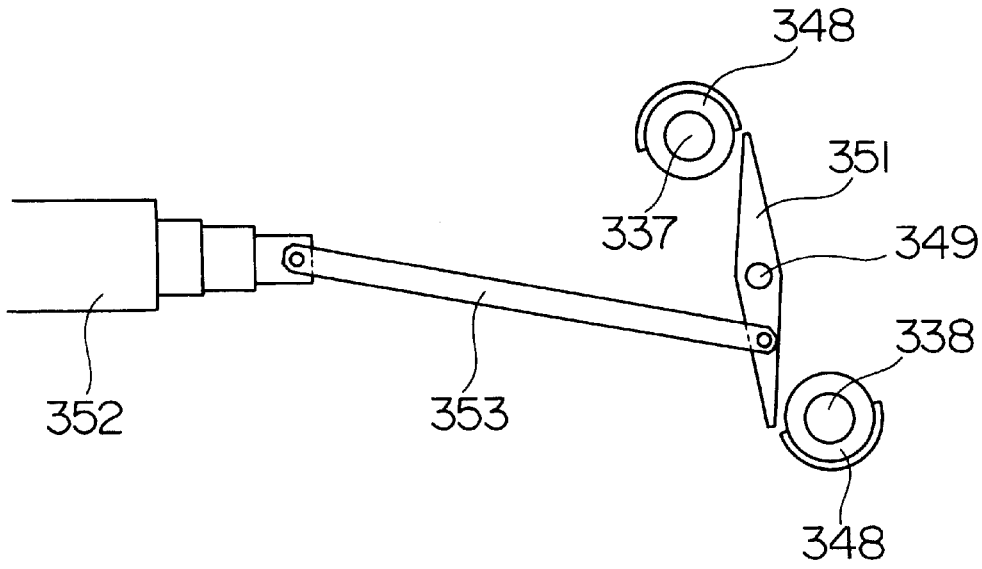
FIG. 32 is an explanatory view showing operation of a lever and stoppers.
Figure 33:
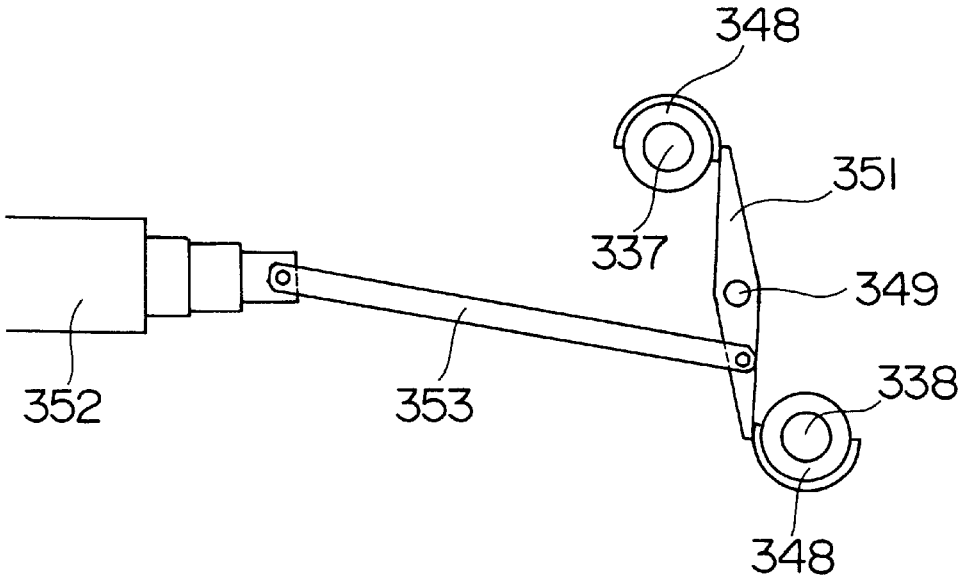
FIG. 33 is another explanatory view showing operation of the lever and stoppers.
Figure 34:
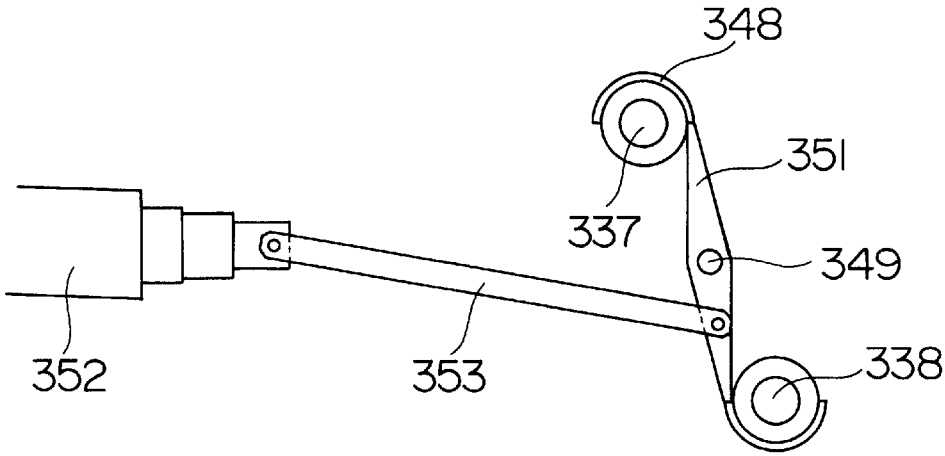
FIG. 34 is a further explanatory view showing operation of the lever and stoppers.

FIGS. 32 through 34 are explanatory views showing operation of the lever 351 and stoppers 348 shown in FIG. 27.

When the cam followers 341 and 343 contact the cam 241 to rotate the shafts 337 and 338, the ink applying rollers 291, 292 and 293 are separated from the surface of plate P. With the rotation of the shafts 337 and 338, the stoppers 348 also rotate. FIG. 32 shows a positional relationship between the pair of stoppers 348 and the lever 351 in such a state.

When the cam followers 341 and 343 become disengaged from the cam 241, the shafts 337 and 338 return to original angular positions to place the ink applying rollers 291, 292 and 293 in contact with the surface of plate P. With the return of the shafts 337 and 338, the stoppers 348 rotate to original angular positions. FIG. 33 shows a positional relationship between the pair of stoppers 348 and the lever 351 in such a state.

In order to keep the ink applying rollers 291, 292 and 293 of the ink feeder 20*a* out of contact with the surface of plate P regardless of rotation of the cam 241 on the first plate cylinder 11, the solenoid 352 is operated to cause the lever 351 through the coupling 353 to pivot clockwise in FIG. 32, when the cam followers 341 and 343 are in contact with the cam 241 and the pair of stoppers 348 are in the angular positions shown in FIG. 32. Then, as shown in FIG. 34, the opposite ends of the lever 351 engage projections of the stoppers 348, whereby the stoppers 348 are locked by the lever 351.

When, in this state, the cam followers 341 and 343 are disengaged from the cam 241 as a result of rotation of the first plate cylinder 11, the shafts 337 and 338 are urged to return to the original angular positions. However, the pair of stoppers 348 fixed to these shafts 337 and 338 are locked by the lever 351, thereby to prevent rotation of the shafts 337 and 338. Thus, as noted above, the arms 302, 308 and 312 remain locked to the retracted position. Regardless of rotation of the cam 241 on the first plate cylinder 11, the ink applying rollers 291, 292 and 293 are separated from the surface of plate P.

In this way, the ink applying rollers 291, 292 and 293 of the ink feeder 20*a* are prevented from contacting the image areas 67*a* and 67*b* shown in FIG. 10A when, for example, monochromatic printing is carried out with only the magenta ink. Only the magenta ink may be fed from the ink feeder 20*b* to both image areas 67*a* and 67*b*.

The above operation of the solenoid 352 for driving the lever 351 and stoppers 348 are carried out under control of a control unit 140 described hereinafter.

The above lever 351 and the stoppers 348 fixed to the shafts 337 and 338 act as a stopper mechanism of the present invention for stopping the ink applying rollers 291, 292 and 293 in the retracted position when the entire ink feeder 20*a* is moved by the air cylinders 316, thereby preventing the ink applying roller 291, 292 and 293 from contacting the plate P mounted on the first plate cylinder 11.

That is, the ink feeder 20*a* including the ink rollers 71 and inkwell 72 is pivotable with the pair of right and left side plates 315 about the shaft 251 between the position opposed to the first plate cylinder 11 shown in solid lines in FIGS. 18 and 19 and the position separated from the first plate cylinder 11 shown in two-dot chain lines in FIGS. 18 and 19. With this construction, the ink rollers 71 and inkwell 72 of the ink feeder 20*a* may be changed or cleaned in the separated position with facility.

In the above construction, when the entire ink feeder 20*a* is moved to the opposed position, the ink applying rollers 291, 292 and 293 could directly contact a central portion of the image area 67*a* on the plate P mounted on the first plate cylinder 11. Then, the ink could be fed unevenly to the central portion of the image area 67*a*. To avoid such an inconvenience, this printing apparatus performs the following operation for successively placing the ink applying rollers 291, 292 and 293 in contact with the plate P mounted on the first plate cylinder 11.

After changing or cleaning the ink rollers 71 and/or inkwell 72 of the ink feeder 20*a* in the separated position and before moving the ink feeder 20*a* to the opposed position, the solenoid 352 is operated to pivot the lever 351 to engage the opposite ends of the lever 351 with the projections of stoppers 348, thereby locking the stoppers 348, as shown in FIG. 27. Then, the ink feeder 20*a* is moved from the separated position to the opposed position.

In this state, as noted above, the shafts 337 and 338 are locked against rotation, whereby the arms 302, 308 and 312 remain fixed to the retracted position. Regardless of rotation of the cam 241 on the first plate cylinder 11, the ink applying rollers 291, 292 and 293 are kept away from the surface of plate P. Consequently, when the ink feeder 20*a* is moved, the ink applying rollers 291, 292 and 293 are prevented from directly contacting the plate P mounted on the first plate cylinder 11.

When the cam 241 moves to an angular position opposed to the cam followers 341 and 343 fixed to the shafts 337 and 338 as shown in FIG. 22, for example, the solenoid 352 is operated to pivot the lever 351 to disengage the opposite ends of the lever 351 from the projections of stoppers 348 as shown in FIG. 25. When, in this state, the cam 241 rotates with the first plate cylinder 11, the cam 241 disengages successively from the cam followers 341 and 343. As shown in FIG. 26, the shafts 337 and 338 rotate with the stoppers 348. The ink applying rollers 291, 292 and 293 successively come into contact with predetermined positions on the plate P mounted on the first plate cylinder 11, thereby preventing an uneven feeding of the ink to the plate P.

The above function of the stopper mechanism of the invention performed by the lever 351 and stoppers 348 may be applied to the ink feeder 20*c* for feeding the cyan ink to the plate P mounted on the second plate cylinder 12. This example will be described hereinafter. FIGS. 35 through 38 are explanatory views showing movement of the ink feeder 20*c* from a separated position to an opposed position. In the following descriptions of the ink feeder 20*c*, like references will be affixed to like components in the ink feeder 20*a*.

As shown in FIG. 1, the ink feeder 20*c* is disposed on the moving path of the second plate cylinder 12 driven by the second plate cylinder moving mechanism 32. To avoid an interference between the second plate cylinder 12 in movement and the ink feeder 20*c*, the ink feeder 20*c* must be moved to the separated position from the position opposed to the second plate cylinder 12 when the second plate cylinder 12 is moved by the second plate cylinder moving mechanism 32.

Figure 35:
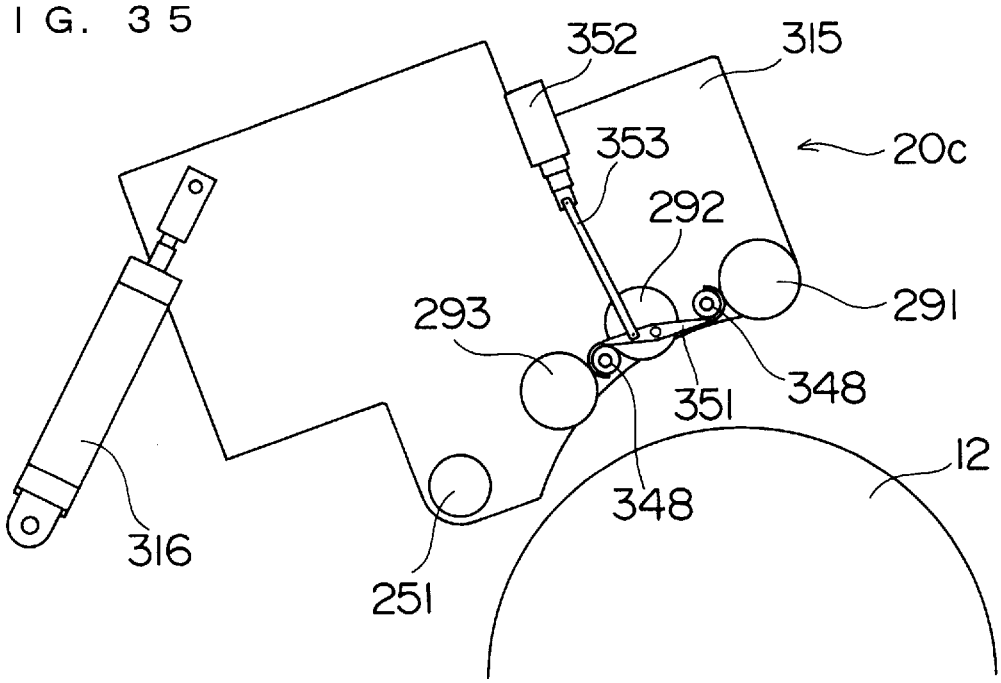
FIG. 35 is an explanatory view showing movement of the ink feeder.

FIG. 35 shows the ink feeder 20*c* in the separated position. In this state, as shown in FIG. 34, the opposite ends of the lever 351 are engaged with the projections of the stoppers 348 to lock the stoppers 348 with the lever 351. As shown in the front view in FIG. 36 and in the rear view in FIG. 37, the air cylinders 316 are driven to move the ink feeder 20*c* to the opposed position.

Figure 36:
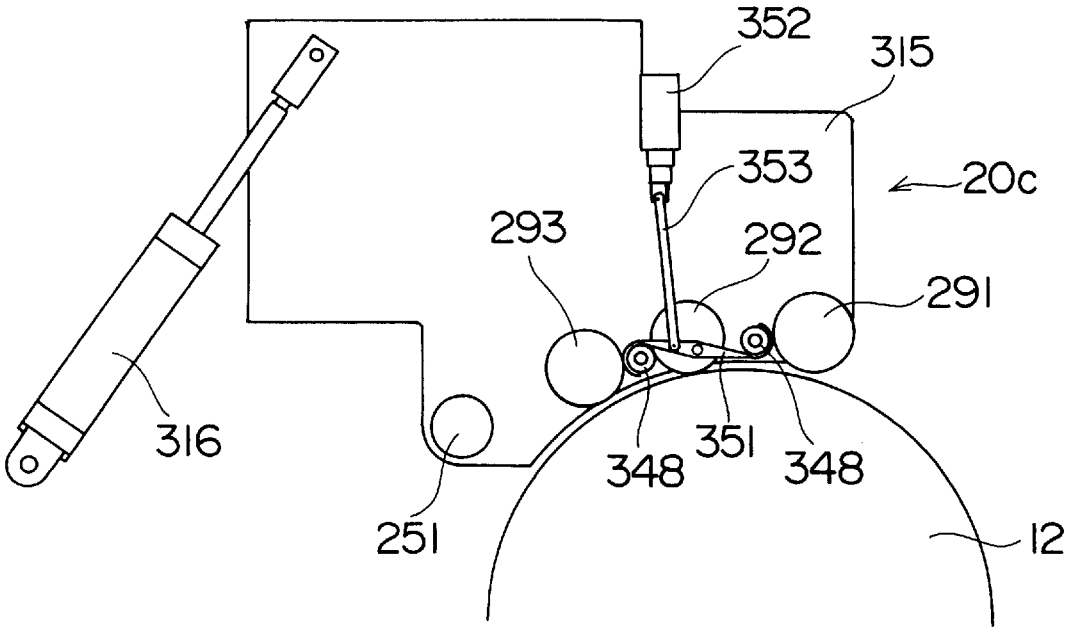
FIG. 36 is another explanatory view showing movement of the ink feeder.
Figure 37:
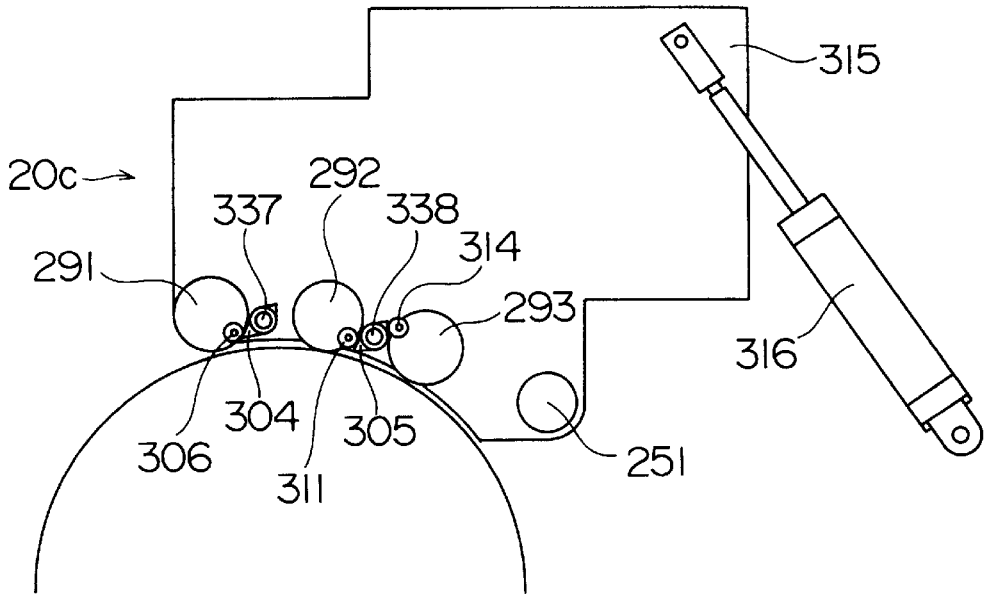
FIG. 37 is a further explanatory view showing movement of the ink feeder.
Figure 38:
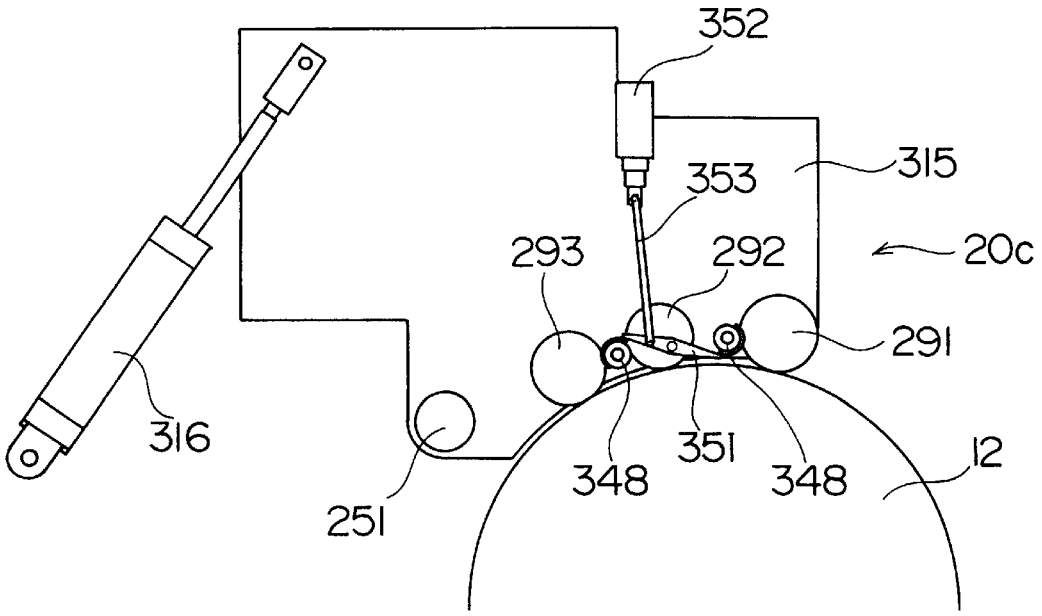
FIG. 38 is a still further explanatory view showing movement of the ink feeder.

In this state, the pair of stoppers 348 are locked by the lever 351. Therefore, as shown in FIG. 37, and as in the case of the ink feeder 20*a*, the release cams 304 rotate about the shaft 337 to press the contact elements 306, while the release cams 305 rotate about the shaft 338 to press the contact elements 311 and 314. When the ink feeder 20*c* is in the opposed position, as shown in FIGS. 36 and 37, the ink applying rollers 291, 292 and 293 remain out of contact with the plate P mounted on the second plate cylinder 12.

Referring again to FIG. 1, the developing device 26 is disposed under the first or second plate cylinder 11 or 12 in the image recording position. This developing device 26 includes a developing unit, a fixing unit and a squeezing unit, which are vertically movable between a standby position shown in two-dot chain lines and a developing position shown in solid lines in FIG. 1.

In developing the images recorded on the plate P by the image recorder 25, the developing unit, fixing unit and squeezing unit are successively brought into contact with the plate P rotated with the first or second plate cylinder 11 or 12 by the cylinder rotating mechanism 30.

The first and second blanket cylinders 13 and 14 movable into contact with the first and second plate cylinders 11 and 12 have the same diameter as the first and second plate cylinders 11 and 12, and have ink transfer blankets mounted peripherally thereof. Each of the first and second blanket cylinders 13 and 14 is movable into and out of contact with the first or second plate cylinder 11 or 12 and the impression cylinder 15 by a contact mechanism described hereinafter.

Figure 39:
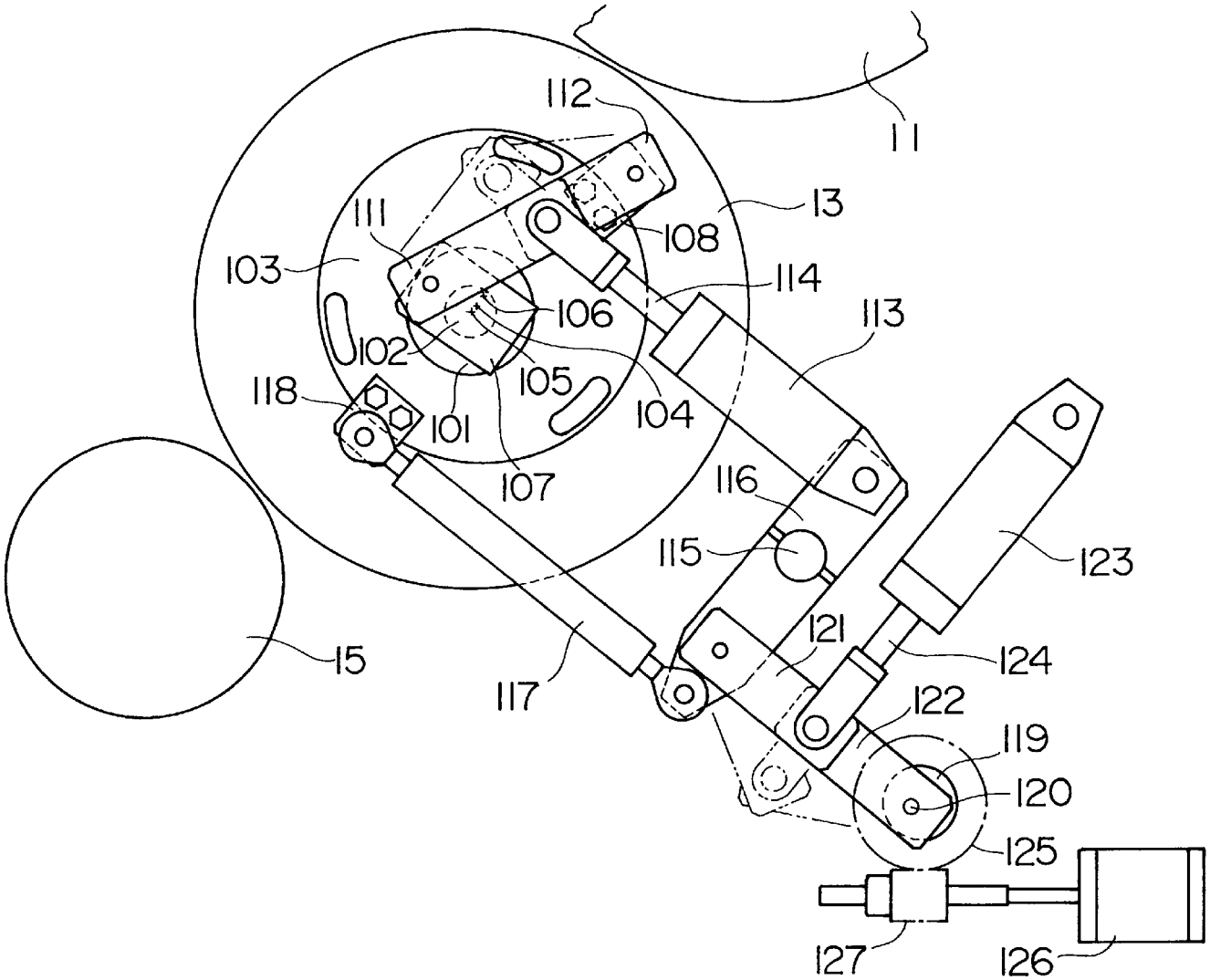
FIG. 39 is a schematic view of a contact mechanism for acting on the first blanket cylinder.

FIG. 39 is a schematic view of the contact mechanism for acting on the first blanket cylinder 13. The contact mechanism for the second blanket cylinder 14 is similar in structure to the contact mechanism shown in FIG. 39.

The first blanket cylinder 13 is rotatably supported by a shaft 101. An eccentric shaft 102 decentered from the shaft 101 is formed on a side thereof. The eccentric shaft 102 is surrounded by an eccentric bearing 103 decentered from the shafts 101 and 102. Thus, as shown in FIG. 39, the axis 104 of the shaft 101, i.e. the axis of the first blanket cylinder 13, the axis 105 of the eccentric shaft 102 and the axis 106 of the eccentric bearing 103 are offset from one another.

The eccentric shaft 102 has a plate 107 fixed thereto, while the eccentric bearing 103 has a plate 108 fixed thereto. The two fixed plates 107 and 108 are interconnected by two coupling plates 111 and 112 forming a link mechanism. The forward end of a cylinder rod 114 of an air cylinder 113 is connected to a connection between the two coupling plates 111 and 112. The air cylinder 113 has a cylinder body coupled to an end of a rotary plate 116 rotatable about a shaft 115. The other end of the rotary plate 116 is coupled through a rod 117 to a plate 118 fixed to the eccentric bearing 103.

The rotary plate 116 is coupled to a shaft 120 of an eccentric member 119 through two coupling plates 121 and 122 forming a link mechanism. The forward end of a cylinder rod 124 of an air cylinder 123 fixed to a main body of the apparatus is connected to a connection between the two coupling plates 121 and 122. The eccentric member 119 has a worm wheel 125 connected thereto and meshed with a worm gear 127 rotatable by a motor 126.

With the cylinder rods 114 and 124 of the air cylinders 113 and 123 extended as shown in FIG. 39, the surface of the first blanket cylinder 13 is spaced slightly from the surfaces of the first plate cylinder 11 and the impression cylinder 15.

When the air cylinder 113 is driven to retract the cylinder rod 114, the first blanket cylinder 13 is moved toward and into contact with the first plate cylinder 11 by action of the link mechanism formed of the two coupling plates 111 and 112.

When the air cylinder 123 is driven to retract the cylinder rod 124, the first blanket cylinder 13 is moved toward and into contact with the impression cylinder 15 by action of the link mechanism formed of the two coupling plates 121 and 122. At this time, the rotary plate 116 also rotates clockwise about the shaft 115, whereby the first blanket cylinder 13 moves not only toward the impression cylinder 15 but also toward the first plate cylinder 11. Consequently, the first blanket cylinder 13 is maintained in contact with the first plate cylinder 11.

Rotation of the eccentric member 119 results in a slight movement of its shaft 120. Thus, the contact pressure of the first blanket cylinder 13 for contacting the impression cylinder 15 and the first plate cylinder 11 may be adjusted by driving the motor 126 to rotate the worm wheel 125 connected to the eccentric member 119 thereby to move the shaft 120 slightly. This enables adjustment of a printing pressure in time of printing with the first blanket cylinder 13.

Referring again to FIG. 1, the blanket cleaning unit 29 disposed between the first and second blanket cylinders 13 and 14 cleans the surfaces of the first and second blanket cylinders 13 and 14 by feeding a cleaning solution to an elongate cleaning cloth extending from a delivery roll to a take-up roll through a plurality of pressure rollers, and sliding the cleaning cloth in contact with the first and second blanket cylinders 13 and 14. The cleaning cloth may further be brought into contact with the surface of the impression cylinder 15 for cleaning the same.

The impression cylinder 15 contactable by the first and second blanket cylinders 13 and 14 has half the diameter of the first and second plate cylinders 11 and 12 and the first and second blanket cylinders 13 and 14, as noted hereinbefore. Further, the impression cylinder 15 has a gripper, not shown, for holding and transporting the forward end of printing paper.

The paper feed cylinder 16 disposed adjacent the impression cylinder 15 has the same diameter as the impression cylinder 15. The paper feed cylinder 16 has a gripper, not shown, for holding and transporting the forward end of each sheet of printing paper fed from the paper storage 27 by a reciprocating suction board 74. When the printing paper is transferred from the feed cylinder 16 to the impression cylinder 15, the gripper of the impression cylinder 15 holds the forward end of the printing paper which has been held by the gripper of the feed cylinder 16.

The paper discharge cylinder 17 disposed adjacent the impression cylinder 15 has the same diameter as the impression cylinder 15. The discharge cylinder 17 has a pair of chains 19 wound around opposite ends thereof. The chains 19 are interconnected by coupling members, not shown, having a plurality of grippers arranged thereon, respectively. When the impression cylinder 15 transfers the printing paper to the discharge cylinder 17, one of the grippers of the discharge cylinder 17 holds the forward end of the printing paper having been held by the gripper of the impression cylinder 15. With movement of the chains 19, the printing paper is transported to the paper discharge station 28 to be discharged thereon.

The paper feed cylinder 16 is connected to a drive motor through a belt not shown. The paper feed cylinder 16, impression cylinder 15, paper discharge cylinder 17 and the first and second blanket cylinders 13 and 14 are coupled to one another by gears mounted on end portions thereof, respectively. Further, the first and second blanket cylinders 13 and 14 are coupled to the first and second plate cylinders 11 and 12 in the first and second printing positions, respectively, by the gears 51 and 52 mounted on end portions thereof as described hereinbefore. Thus, a motor, not shown, is operable to rotate the paper feed cylinder 16, impression cylinder 15, paper discharge cylinder 17, the first and second blanket cylinders 13 and 14 and the first and second plate cylinders 11 and 12 synchronously with one another.

Figure 40:
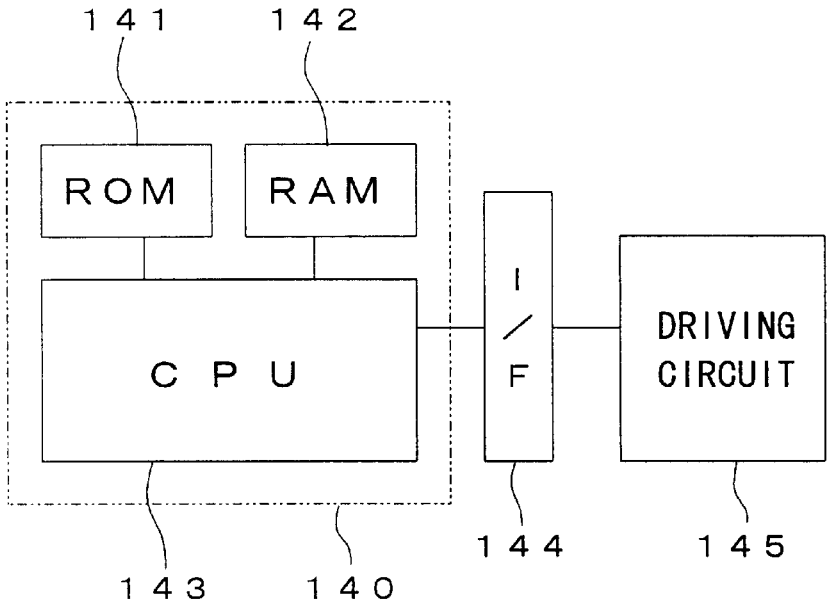
FIG. 40 is a block diagram showing a principal electrical structure of the printing apparatus.

FIG. 40 is a block diagram showing a principal electrical structure of the printing apparatus. This printing apparatus includes a control unit 140 having a ROM 141 for storing operating programs necessary for controlling the apparatus, a RAM 142 for temporarily storing data and the like during a control operation, and a CPU 143 for performing logic operations. The control unit 140 has a driving circuit 145 connected thereto through an interface 144, for generating driving signals for driving the ink feeders 20, image recorder 25, developing device 26, blanket cleaning unit 29, the moving mechanisms for moving the first and second plate cylinders 11 and 12, the contact mechanisms for the first and second blanket cylinders 13 and 14, and so on. The printing apparatus is controlled by the control unit 140 to execute prepress and printing operations as described hereinafter.

Figure 41:
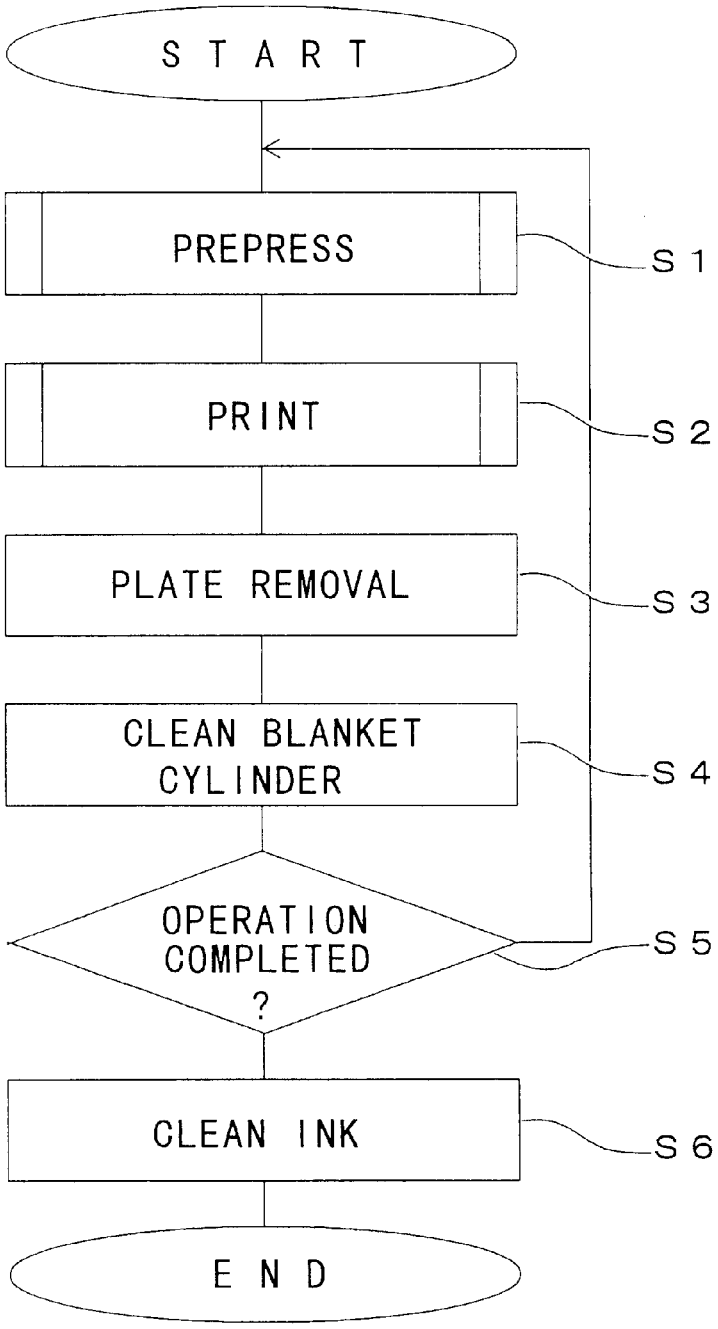
FIG. 41 is a flow chart showing an outline of prepress and printing operations of the printing apparatus.

Prepress and printing operations of the printing apparatus will be described next. FIG. 41 is a flow chart showing an outline of the prepress and printing operations of the printing apparatus. These prepress and printing operations are directed to multicolor printing of printing paper with the four color inks of yellow, magenta, cyan and black.

Figure 42:
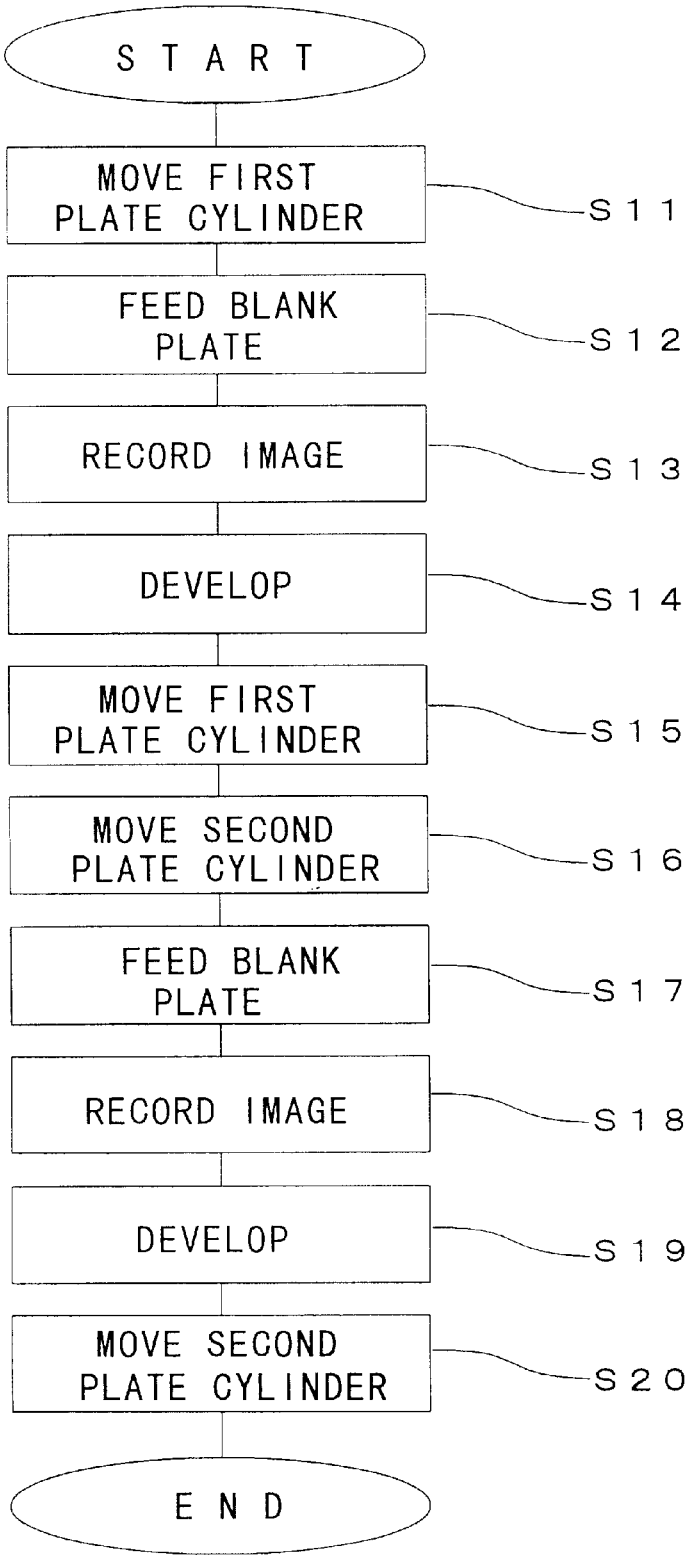
FIG. 42 is a flow chart of a prepress process.

First, the printing apparatus executes a prepress process for recording and developing images on the plates P mounted on the first and second plate cylinders 11 and 12 (step S1). This prepress process follows the steps constituting a subroutine as shown in the flow chart of FIG. 42.

The first plate cylinder 11 is first moved to the prepress recording position shown in the two-dot chain line in FIG. 1. (step S11). This movement of the first plate cylinder 11 is effected by operating the motor 35 of the first plate cylinder moving mechanism 31 shown in FIG. 2 to move the slide holder 41 along the guide 39.

Next, a plate P is fed to the outer periphery of the first plate cylinder 11 (step S12). To achieve the feeding of the plate P, the pair of grippers, not shown, grip the forward end of plate P drawn from the supply cassette 63, and the rear end of plate P cut by the cutter 66.

Then, an image is recorded on the plate P mounted peripherally of the first plate cylinder 11 (step S13). For recording the image, the image recorder 25 irradiates the plate P mounted peripherally of the first plate cylinder 11 with a modulated laser beam while the first plate cylinder 11 is rotated at low speed by the cylinder rotating mechanism 30.

Next, the image recorded on the plate P is developed (step S14). The developing step is executed by raising the developing device 26 from the standby position shown in two-dot chain lines to the developing position shown in solid lines in FIG. 1 and thereafter successively moving the developing unit, fixing unit and squeezing unit into contact with the plate P rotating with the first plate cylinder 11 driven by the cylinder rotating mechanism 30.

Upon completion of the developing step, the first plate cylinder 11 is moved to the first printing position shown in the solid line in FIG. 1 (step S15).

Subsequently, the printing apparatus carries out an operation similar to steps S11 to S15 by way of a prepress process for the plate P mounted peripherally of the second plate cylinder 12 (steps S16 to S20). Completion of the prepress steps for the plates P mounted peripherally of the first and second plate cylinders 11 and 12 brings the prepress process to an end.

Referring again to FIG. 41, the prepress process is followed by a printing process for printing the printing paper with the plates P mounted on the first and second plate cylinders 11 and 12 (step S2). The operation of the printing apparatus in this printing process will be described in detail hereinafter.

Upon completion of the printing process, the plates P used in the printing are removed (step S3). To remove the plates P, the first plate cylinder 11 is first moved to the prepress position shown in the two-dot chain line in FIG. 1. Then, while the first plate cylinder 11 is rotated counterclockwise by the cylinder rotating mechanism 30, the pawl mechanism 73 separates an end of the plate P from the first plate cylinder 11. The plate P separated is guided by the conveyor mechanism 69 into the discharge cassette 68. After returning the first plate cylinder 11 to the first printing position, the second plate cylinder 12 is moved from the second printing position to the prepress position to undergo an operation similar to the above, thereby having the plate P removed from the second plate cylinder 12 for discharge into the discharge cassette 68.

Upon completion of the plate removing step, the first and second blanket cylinders 13 and 14 are cleaned (step S4). For cleaning the first and second blanket cylinders 13 and 14, the contact mechanisms as shown in FIG. 39 separate the first and second blanket cylinders 13 and 14 from the first and second plate cylinders 11 and 12 and the impression cylinder 15. The first and second blanket cylinders 13 and 14 are thereafter rotated. In this state, the cleaning cloth of blanket cleaning unit 29 supplied with the cleaning solution is placed in contact with and slid on the surfaces of the first and second blanket cylinders 13 and 14, thereby cleaning the first and second blanket cylinders 13 and 14.

After completing the cleaning of the first and second blanket cylinders 13 and 14, the printing apparatus determines whether or not a further image is to be printed (step S5). If a further printing operation is required, the apparatus repeats steps S1 to S4.

If the printing operation is ended, the printing apparatus cleans the inks (step S6). For cleaning the inks, an ink cleaning device, not shown, provided for each ink feeder 20 removes the ink adhering to the ink rollers 71 and inkwell 72 of each ink feeder 20.

With completion of the ink cleaning step, the printing apparatus ends the entire process.

The operation of the printing apparatus in the above mentioned printing process will be described next. FIGS. 43 through 48 are explanatory views showing a printing operation of this printing apparatus. For expediency of illustration, these figures depict printing paper S having a length corresponding to the circumference of each of the impression cylinder 15, paper feed cylinder 16 and paper discharge cylinder 17. In practice, the length of printing paper S is greater than the circumference of each of the impression cylinder 15, paper feed cylinder 16 and paper discharge cylinder 17.

The operation described hereinafter is carried out in multicolor printing with the four color inks of yellow, magenta, cyan and black. Further, in FIGS. 43 through 48, for expediency of illustration again, reference K is affixed to regions of the first plate cylinder 11 and first blanket cylinder 13 used for printing with black ink, reference M to regions of the first plate cylinder 11 and first blanket cylinder 13 used for printing with magenta ink, reference C to regions of the second plate cylinder 12 and second blanket cylinder 14 used for printing with cyan ink, and reference Y to regions of the second plate cylinder 12 and second blanket cylinder 14 used for printing with yellow ink.

It is assumed that, in the prepress process preceding the printing process, as described hereinbefore, and as shown in FIG. 10A, the image areas 67*a* and 67*b* for printing with the black and magenta inks respectively are recorded on the plate P mounted peripherally of the first plate cylinder 11. Similarly, as shown in FIG. 10B, the image areas 67*c* and 67*d* for printing with the cyan and yellow inks respectively are assumed to be on the plate P mounted peripherally of the second plate cylinder 12.

As described hereinbefore, the ink feeders 20*a*, 20*b*, 20*c* and 20*d* are supplied with the black, magenta, cyan and yellow inks, respectively. Then, the ink feeders 20*a*, 20*b*, 20*c* and 20*d* are ready to feed the black, magenta, cyan and yellow inks to the image areas 67*a*, 67*b*, 67*c* and 67*d* on the plates P shown in FIGS. 10A and 10B, respectively.

First, each dampening water feeder 21 and each ink feeder 20 are placed in contact with only a corresponding one of the image areas on the plates P mounted on the first and second plate cylinders 11 and 12. Consequently, dampening water is fed to the image areas 67*a*, 67*b*, 67*c* and 67*d* from the corresponding dampening water feeders 21*a*, 21*b*, 21*c* and 21*c*, and so are the black, magenta, cyan and yellow inks from the ink feeders 20*a*, 20*b*, 20*c* and 20*d*, respectively. These inks are transferred to the corresponding regions of the first and second blanket cylinders 13 and 14, respectively.

By repeating this operation, the inks are fed to the plates P mounted on the first and second plate cylinders 11 and 12 and to the first and second blanket cylinders 13 and 14. This ink feeding operation is repeated until the printing process is completed.

Figure 43:
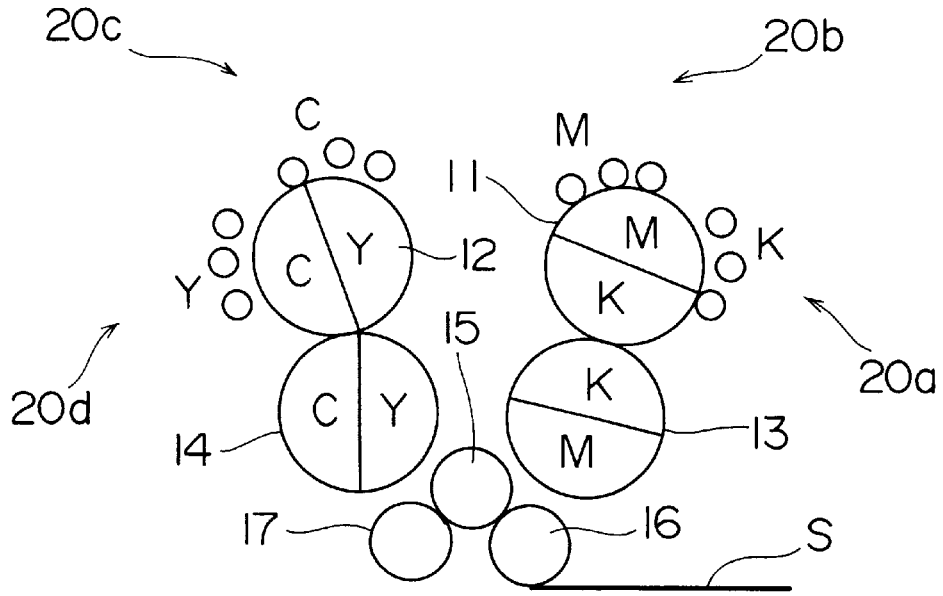
FIG. 43 is an explanatory view of the printing operation of the printing apparatus.

When the inks have been fed to the plates P mounted on the first and second plate cylinders 11 and 12 and to the first and second blanket cylinders 13 and 14, the printing paper S is fed to the paper feed cylinder 16 as shown in FIG. 43. The printing paper S is subsequently passed from the paper feed cylinder 16 to the impression cylinder 15.

Figure 44:
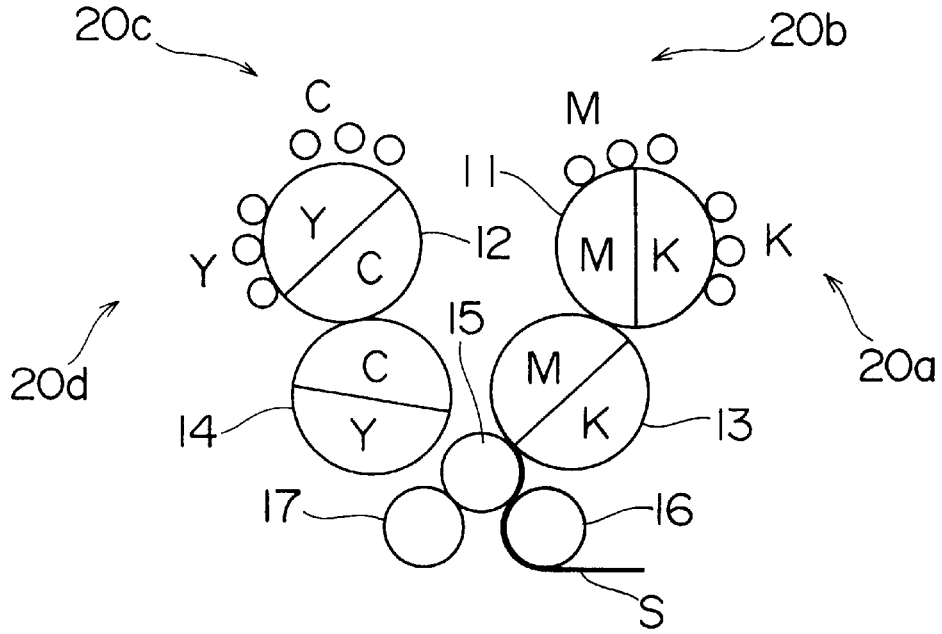
FIG. 44 is another explanatory view of the printing operation of the printing apparatus.

With a further rotation of the impression cylinder 15, the forward end of printing paper S mounted on the impression cylinder 15 reaches a position opposed to the first blanket cylinder 13. Then, the contact mechanism shown in FIG. 39 moves the first blanket cylinder 13 into contact with the impression cylinder 15. In this state, the forward end of printing paper S comes into contact with an end of the region of the first blanket cylinder 13 used for printing with the black ink, as shown in FIG. 44. The black ink has been transferred from the image area 67*a* of the plate P mounted on the first plate cylinder 11 to the region of the first blanket cylinder 13 used for printing with the black ink. Thus, the black ink is transferred to the printing paper S with a further rotation of the first blanket cylinder 13 and impression cylinder 15.

Figure 45:
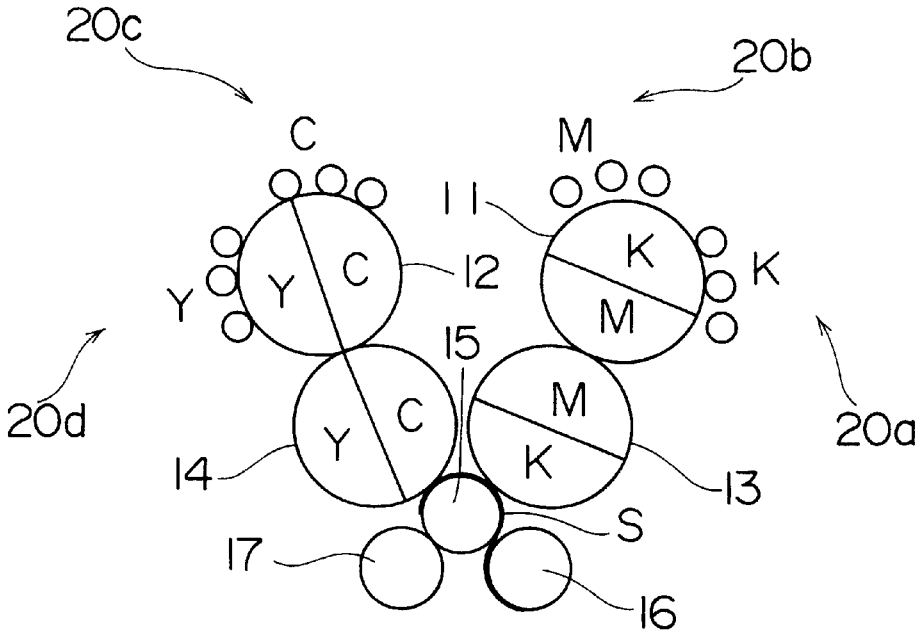
FIG. 45 is a further explanatory view of the printing operation of the printing apparatus.

With a still further rotation of the impression cylinder 15, the forward end of printing paper S mounted on the impression cylinder 15 reaches a position opposed to the second blanket cylinder 14. Then, the contact mechanism as shown in FIG. 39 moves the second blanket cylinder 14 into contact with the impression cylinder 15. In this state, the forward end of printing paper S comes into contact with an end of the region of the second blanket cylinder 14 used for printing with the cyan ink, as shown in FIG. 45. The cyan ink has been transferred from the image area 67*c* of the plate P mounted on the second plate cylinder 12 to the region of the second blanket cylinder 13 used for printing with the cyan ink. Thus, with a further rotation of the second blanket cylinder 14 and impression cylinder 15, the cyan ink is transferred to the printing paper S to which the black ink has already been transferred.

Figure 46:
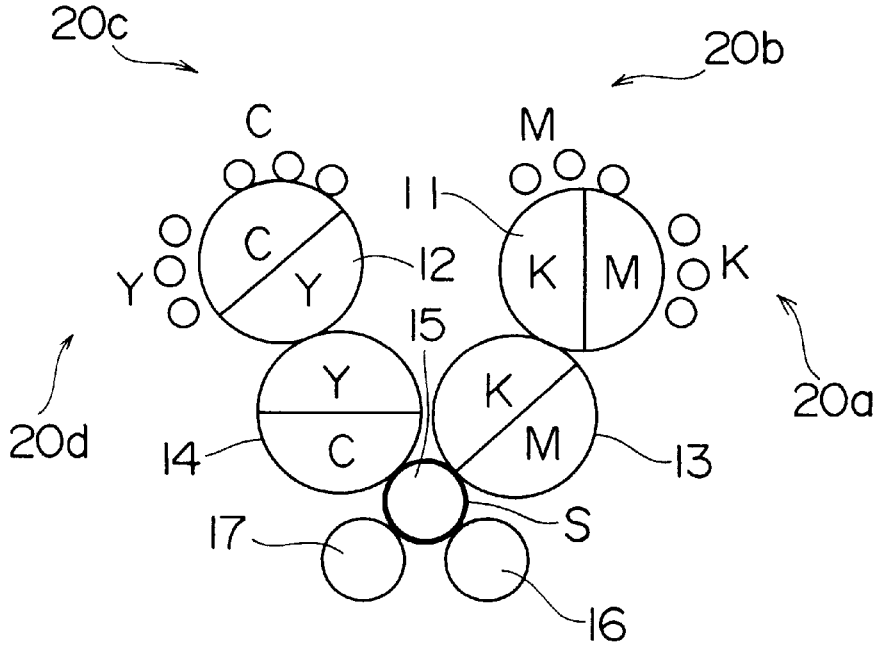
FIG. 46 is a still further explanatory view of the printing operation of the printing apparatus.

As the impression cylinder 15 continues to rotate with the first and second blanket cylinders 13 and 14 in this state, the printing paper S becomes completely wrapped around the impression cylinder 15 as shown in FIG. 46. Since the impression cylinder 15 has half the diameter of the first and second plate cylinders 11 and 12 and the first and second blanket cylinders 13 and 14, the printing paper S wrapped around the impression cylinder 15 comes, in its second rotation, into contact with the region of the first blanket cylinder 13 used for printing with the magenta ink. The magenta ink has been transferred from the image area 67*b* of the plate P mounted on the first plate cylinder 11 to the region of the first blanket cylinder 13 used for printing with the magenta ink. Thus, with a further rotation of the first blanket cylinder 13 and impression cylinder 15, the magenta ink is transferred to the printing paper S to which the black and cyan inks have already been transferred.

With a still further rotation of the impression cylinder 15, the printing paper S comes into contact with an end of the region of the second blanket cylinder 14 used for printing with the yellow ink. The yellow ink has been transferred from the image area 67*d* of the plate P mounted on the second plate cylinder 12 to the region of the second blanket cylinder 14 used for printing with the yellow ink. With a further rotation of the second blanket cylinder 14 and impression cylinder 15, therefore, the yellow ink is transferred to the printing paper S to which the black, cyan and magenta inks have already been transferred. This completes the four-color printing.

Figure 47:
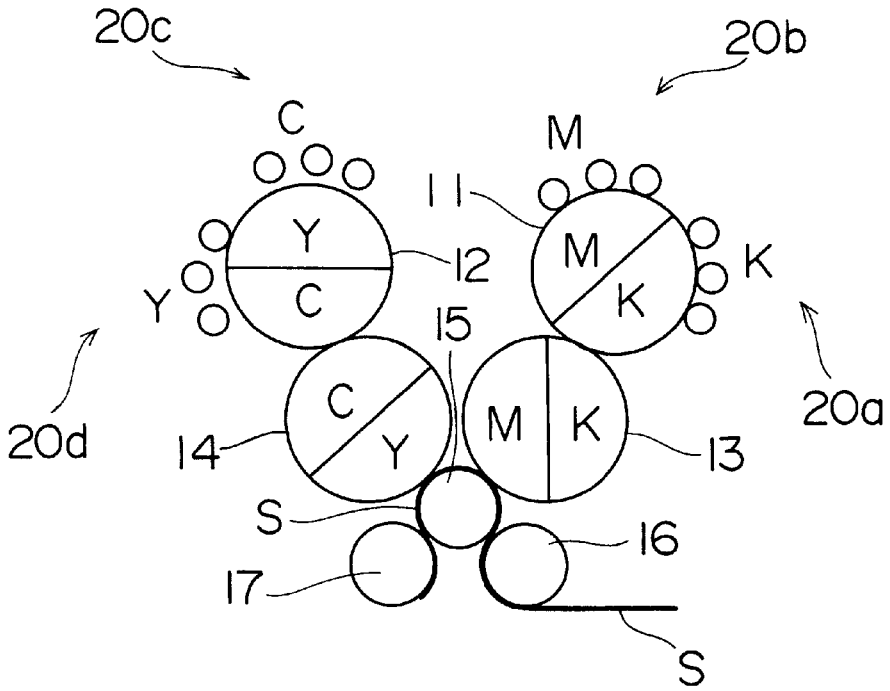
FIG. 47 is a still further explanatory view of the printing operation of the printing apparatus.

As shown in FIG. 47, the forward end of printing paper S printed in the four colors is passed from the impression cylinder 15 to the paper discharge cylinder 17. Meanwhile, printing paper S to be printed next is fed to the paper feed cylinder 16, and then transferred from the feed cylinder 16 to the impression cylinder 15.

Figure 48:
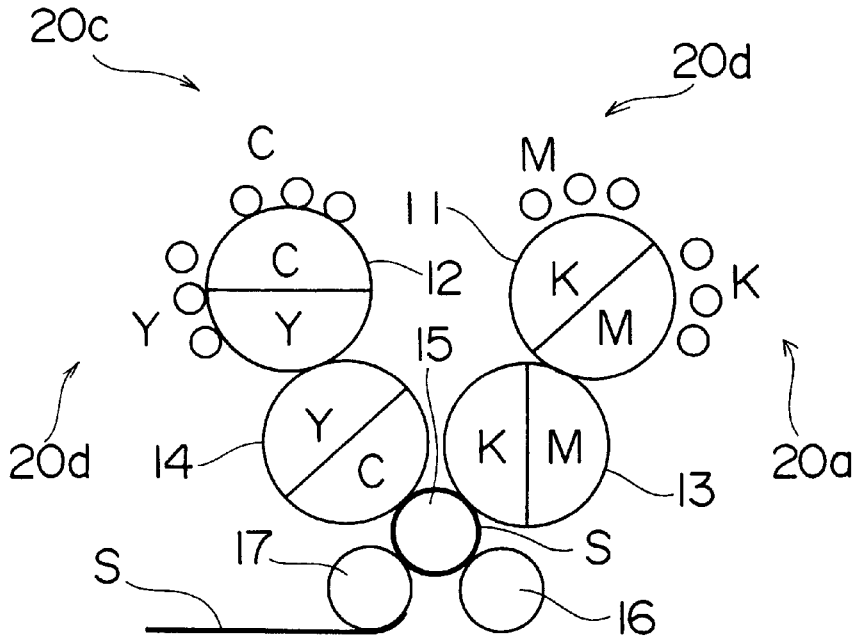
FIG. 48 is a still further explanatory view of the printing operation of the printing apparatus.

The printing paper S printed in the four colors is transported by the pair of chains 19 to the paper discharge station 28 along with one of the grippers of the paper discharge cylinder 17, as shown in FIG. 48.

As described above, the impression cylinder 15 has half the diameter of the first and second plate cylinders 11 and 12 and the first and second blanket cylinders 13 and 14. Consequently, the impression cylinder 15 rotates twice as the first and second plate cylinders 11 and 12 and the first and second blanket cylinders 13 and 14 rotate once. The printing paper S mounted peripherally of the impression cylinder 15 is printed in the four colors of yellow, magenta, cyan and black while the impression cylinder 15 rotates twice. Thus, the printing apparatus can continuously execute the four-color printing by feeding a new sheet of printing paper S from the paper feed cylinder 16 for every two rotations of the impression cylinder 15.

This printing apparatus may be used to perform monochromatic or other color printing besides the above four-color printing.

When this printing apparatus performs printing with only the black ink, for example, the same image is formed in the image areas 67*a* and 67*b* on the plate P mounted on the first plate cylinder 11. The ink feeder 20*a* is arranged to feed the black ink to both of the image areas 67*a* and 67*b* as described above. The other ink feeders 20*b*, 20*c* and 20*d* are kept away from the first and second plate cylinders 11 and 12. In this state, a new sheet of printing paper S is fed from the paper feed cylinder 16 for every rotation of the impression cylinder 15. As a result, with every rotation of the impression cylinder 15, the image in the black ink is transferred from the image area 67*a* or 67*b* in which the same image is formed to the printing paper S mounted peripherally of the impression cylinder 15, to achieve monochromatic printing.

The second plate cylinder 12 and second blanket cylinder 14 are not used in the above operation, Thus, the second blanket cylinder 14 may be retracted by the contact mechanism shown in FIG. 39. During the printing operation with the first plate cylinder 11 and first blanket cylinder 13, the second plate cylinder 12 may be moved to the image recording position for a prepress process to be carried out on the second plate cylinder 12.

In the foregoing embodiment, the plurality of ink applying rollers 291, 292 and 293 are moved away from the first plate cylinder 11, and the pair of stoppers 348 and the lever 351 are used as means for preventing the ink applying rollers 291, 292 and 293 from contacting the plate P regardless of rotation of the cam 241 on the first plate cylinder 11. Instead, the entire ink feeder 20 may be swung by the pair of right and left air cylinders 316 to prevent the ink applying rollers 291, 292 and 293 from contacting the plate P regardless of rotation of the cam 241 on the first plate cylinder 11.

In the foregoing embodiment, the arms 302, 308 and 312 are biased beforehand by the springs 303, 309 and 313 in the direction to place the ink applying rollers 291, 292 and 293 thereby supported in contact with the first plate cylinder 11. The arms 302, 308 and 312 are pushed by the cams 241 in the direction for separating the ink applying rollers 291, 292 and 293 from the first plate cylinder 11. Conversely, the arms 302, 308 and 312 may be biased beforehand in the direction to keep the ink applying rollers 291, 292 and 293 away from the first plate cylinder 11. The arms 302, 308 and 312 may then be pushed by the cams 241 in the direction for placing the ink applying rollers 291, 292 and 293 in contact with the first plate cylinder 11.

Further, in the foregoing embodiment, the plates P each having two image areas are mounted on the first and second plate cylinders, respectively. The two dampening water feeders 21*a* and 21*b* are arranged around the first plate cylinder 11 in the first printing position, and the two dampening water feeders 21*c* and 21*d* around the second plate cylinder 12 in the second printing position. However, a plate P having three or more image areas may be mounted on each of the first and second plate cylinders. In this case, it is necessary to arrange three or more dampening water feeders around the first plate cylinder 11 in the first printing position, and three or more dampening water feeders around the second plate cylinder 12 in the second printing position.

The present invention may be embodied in other specific forms without departing from the spirit or essential attributes thereof and, accordingly, reference should be made to the appended claims, rather than to the foregoing specification, as indicating the scope of the invention.

This application claims priority benefit under 35 U.S.C. Section 119 of Japanese Patent Applications No. 9-279442 and No. 9-279446 filed in the Japanese Patent Office on Sep. 26, 1997, the entire disclosure of which is incorporated herein by reference.

What is claimed is:

1. A printing apparatus having ink feeders for selectively feeding inks to a plurality of image areas on a plate or plates mounted on a plate cylinder, comprising:

a plate cylinder for supporting, peripherally thereof, plate means having a plurality of image areas;

a plurality of cams rotatable synchronously with said plate cylinder, said cams being arranged in positions laterally of said plate cylinder corresponding to said image areas;

a plurality of ink rollers arranged circumferentially of said plate cylinder for contacting a surface of said plate means to feed ink to said image areas;

a plurality of ink roller support arms for rotatably supporting said ink rollers, respectively; and an ink roller support arm moving mechanism including cam followers for contacting said cams to move said ink roller support arms successively, with rotation of said cams, between an ink feeding position in which said ink rollers contact said surface of said plate means and a retracted position in which said ink rollers are separated from said surface of said plate means.

2. A printing apparatus as defined in claim 1, wherein said plate cylinder is constructed for supporting, peripherally thereof, a single plate having a plurality of image areas.

3. A printing apparatus as defined in claim 1, wherein said plate cylinder is constructed for supporting, peripherally thereof, a plurality of plates each having a single image area.

4. A printing apparatus as defined in claim 1, further comprising:

an ink storage for storing the ink; and ink kneading rollers for transferring the ink from said ink storage to said ink rollers;

wherein said ink roller support arms being pivotable about axes of rotation of said ink kneading rollers in contact with said ink rollers, whereby said ink rollers are movable between said ink feeding position and said retracted position while contacting said ink kneading rollers.

5. A printing apparatus as defined in claim 1, further comprising:

an water applying roller for contacting said surface of said plate means to feed dampening water to said image areas;

water applying roller support arms for rotatably supporting said water applying roller; and a water applying roller support arm moving mechanism having cam followers for contacting said cams to move said water applying roller support arms, with rotation of said cams, between an dampening water feeding position in which said water applying roller contacts said surface of said plate means and a retracted position in which said water applying roller is separated from said surface of said plate means.

6. A printing apparatus as defined in claim 1, further comprising cam follower moving means for retracting said cam followers from said cams to prevent said cam followers from contacting said cams in time of rotation of said plate cylinder, thereby to stop said ink roller support arms in said ink feeding position.

7. A printing apparatus as defined in claim 1, further comprising ink roller moving means for stopping said ink roller support arms in said retracted position to prevent said ink rollers from contacting said plate means regardless of rotation of said cams occurring with rotation of said plate cylinder.

8. A printing apparatus as defined in claim 7, further comprising an ink feeder moving mechanism for moving all of said ink feeders including said ink rollers between a position opposed to said plate cylinder and a position separated from said plate cylinder.

9. A printing apparatus as defined in claim 8, further comprising a suspend mechanism for causing said ink roller moving means to stop said ink roller support arms in said retracted position when said ink feeder moving mechanism returns said entirety of said ink feeder including said ink rollers from said position separated from said plate cylinder to said position opposed to said plate cylinder, and thereafter for causing said ink roller moving means to release said ink roller support arms when, with rotation of said plate cylinder, said cams move to an angular position opposed to said cam followers.

10. A printing apparatus as defined in claim 5, further comprising:

a water feed roller for feeding the dampening water to said water applying roller; and a contact pressure adjusting mechanism for maintaining a fixed pressure of contact between said water applying roller and said water feed roller when said water applying roller is moved between said dampening water feeding position and said retracted position.

11. A printing apparatus as defined in claim 10, wherein said contact pressure adjusting mechanism includes biasing means for biasing said water applying roller and said water feeding roller toward each other, and maintaining means for maintaining a fixed distance between axes of said water applying roller and said water feed roller.

12. A printing apparatus as defined in claim 1, further comprising:

an water applying roller for contacting said surface of said plate means to feed dampening water to said image areas;

first arms for supporting said water applying roller;

a first arm moving mechanism for moving said first arms to reciprocate said water applying roller between a feeding position for contacting to said surface of said plate means and a retracted position separated from said surface of said plate means;

an intermediate roller for contacting said water applying roller to feed said dampening water to said water applying roller;

a fountain roller for transferring said dampening water from a dampening water source to said intermediate roller;

movable second arms for supporting said intermediate roller and said fountain roller;

biasing means for biasing said first arms or said second arms in a direction to move said water applying roller and said intermediate roller toward each other; and first and second contact elements disposed on said first arms and said second arms, respectively, for maintaining a fixed distance between axes of said water applying roller and said intermediate roller.

13. A printing apparatus having ink feeders for selectively feeding inks to two image areas on a plate or plates mounted on a plate cylinder, comprising:

a plate cylinder for supporting, peripherally thereof, plate means having two image areas;

two ink feeders arranged around said plate cylinder, each of said ink feeders having a plurality of ink rollers arranged circumferentially of said plate cylinder for feeding different color inks to said image areas;

a plurality of ink roller support arms for rotatably supporting said ink rollers, respectively;

an ink roller support arm moving mechanism for moving said ink roller support arms successively between an ink feeding position in which said ink rollers contact said surface of said plate means and a retracted position in which said ink rollers are separated from said surface of said plate means; and a stopper mechanism for stopping said ink roller support arms in said ink feeding position;

a retracting mechanism for stopping said ink roller support arms in said retracted position to prevent said ink rollers from contacting said plate means;

wherein said stop mechanism and said retracting mechanism are controllable to select between a mode for causing said two ink feeders to feed the inks to said two image areas, respectively, and a mode for causing one of said two ink feeders to fed one of the inks to both of said two image areas, with the other ink feeder rendered inoperative to feed the other ink to said image areas.

14. A printing apparatus as defined in claim 13, wherein said plate cylinder is constructed for supporting, peripherally thereof, a single plate having said two image areas.

15. A printing apparatus as defined in claim 13, wherein said plate cylinder is constructed for supporting, peripherally thereof, two plates each having a single image area.

16. A printing apparatus as defined in claim 13, wherein each of said ink feeders further comprises:

an ink storage for storing the ink; and ink kneading rollers for transferring the ink from said ink storage to said ink rollers;

wherein said ink roller support arms being pivotable about axes of rotation of said ink kneading rollers in contact with said ink rollers, whereby said ink rollers are movable between said ink feeding position and said retracted position while contacting said ink kneading rollers.

17. A printing apparatus as defined in claim 13, further comprising two dampening water feeders arranged around said plate cylinder, each of said dampening water feeders having a water applying roller for feeding dampening water to one of said two image areas.

18. A printing apparatus as defined in claim 17, wherein said plate cylinder is constructed for supporting, peripherally thereof, a single plate having said two image areas with a non-image area disposed therebetween, each of said dampening water feeders feeding said dampening water to a corresponding one of said two image areas and to said non-image area.

* * * * *